US006516509B1

(12) United States Patent
Ono et al.

(10) Patent No.: US 6,516,509 B1
(45) Date of Patent: Feb. 11, 2003

(54) METHOD OF MANUFACTURING A LIQUID JET HEAD HAVING A PLURALITY OF MOVABLE MEMBERS

(75) Inventors: Takayuki Ono, Kawasaki (JP); Koji Yamakawa, Yokohama (JP); Tsuyoshi Orikasa, Musashimurayama (JP); Toshio Kashino, Chigasaki (JP); Hiroyuki Kigami, Yokohama (JP); Kimiyuki Hayasaki, Yokohama (JP); Hisashi Fukai, Yokohama (JP); Kiyomitsu Kudo, Kawasaki (JP); Yoshie Asakawa, Nagano-ken (JP); Masayoshi Ohkawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/870,356

(22) Filed: Jun. 6, 1997

(30) Foreign Application Priority Data

| | | |
|---|---|---|
| Jun. 7, 1996 | (JP) | 8-146199 |
| Jun. 7, 1996 | (JP) | 8-146250 |
| Jul. 12, 1996 | (JP) | 8-203146 |
| Jul. 12, 1996 | (JP) | 8-203147 |

(51) Int. Cl.[7] ..... H05B 3/10; B21D 53/76

(52) U.S. Cl. ..... 29/611; 29/890.1; 29/281.4; 347/56; 347/61

(58) Field of Search ..... 29/611, 890.1, 29/830, 407.07, 407.08, 407.09, 281.4, 743; 347/92, 94, 56, 61; 269/22, 46; 414/676; 198/397.04, 397.05; 406/87, 88

(56) References Cited

U.S. PATENT DOCUMENTS

| | | | | | |
|---|---|---|---|---|---|
| 3,395,943 A | * | 8/1968 | Wilde et al. | ..... | 406/88 |
| 3,603,646 A | | 9/1971 | Leoff | | |
| 3,869,787 A | | 3/1975 | Umbaugh | | |
| 4,165,132 A | * | 8/1979 | Hassan et al. | ..... | 406/87 |
| 4,301,459 A | * | 11/1981 | Isayama et al. | ..... | 347/92 |
| 4,438,441 A | * | 3/1984 | Bolmgren et al. | ..... | 347/94 |
| 4,618,292 A | * | 10/1986 | Judge et al. | ..... | 406/87 |
| 4,723,129 A | | 2/1988 | Endo et al. | ..... | 347/56 |
| 4,785,986 A | * | 11/1988 | Daane et al. | ..... | 242/615.11 |
| 5,208,604 A | | 5/1993 | Watanabe et al. | ..... | 347/47 |

(List continued on next page.)

FOREIGN PATENT DOCUMENTS

| | | | | |
|---|---|---|---|---|
| EP | 0 436 047 | | 7/1991 | |
| EP | 0 483 843 | | 5/1992 | |
| EP | 0 636 480 | | 2/1995 | |
| EP | 0 737 582 | | 10/1996 | |
| JP | 57-137813 | | 8/1982 | |
| JP | 62-16129 | | 1/1987 | |
| JP | 1-11342 | | 1/1989 | |
| JP | 4-171131 | | 6/1992 | |
| JP | 6-9052 | * | 1/1994 | ..... 406/88 |
| JP | 6-177590 | | 6/1994 | |

*Primary Examiner*—Peter Vo
*Assistant Examiner*—A. Dexter Tugbang
(74) *Attorney, Agent, or Firm*—Fitzpatrick, Cella, Harper & Scinto

(57) ABSTRACT

A method for manufacturing a component provided with a number of liquid paths having movable members for use of liquid discharging comprises the steps of displacing the movable members provided for thin film material by use of such thin film material having the movable members on it, and a component provided with a plurality of recessed portions, and of placing the movable members, which are in the state of being displaced with respect to the recessed portions of the component correspondingly, hence making it possible to fabricate a liquid jet head without damaging or deforming such thin film material constituting the movable members. With the provision of the movable members, the discharging power and efficiency of the liquid jet head are significantly enhanced to obtain recorded images of high quality at higher speeds.

4 Claims, 28 Drawing Sheets

U.S. PATENT DOCUMENTS 5,226,758 A * 7/1993 Tanaka et al. ..... 406/88
5,243,755 A 9/1993 Inaba et al. ..... 29/890.1
5,278,585 A 1/1994 Karz et al. ..... 347/94
5,305,521 A 4/1994 Inaba et al.
5,373,633 A 12/1994 Satoi et al. ..... 29/890.1
5,457,485 A * 10/1995 Moriyama et al. ..... 347/92
5,478,174 A * 12/1995 Lenhart ..... 406/88
5,513,431 A * 5/1996 Ohno et al. ..... 29/890.1
5,657,539 A 8/1997 Orikasa et al. ..... 29/890.1
5,800,118 A * 9/1998 Kurome et al. ..... 198/397.05
5,820,117 A * 10/1998 Thompson et al. ..... 269/22

* cited by examiner

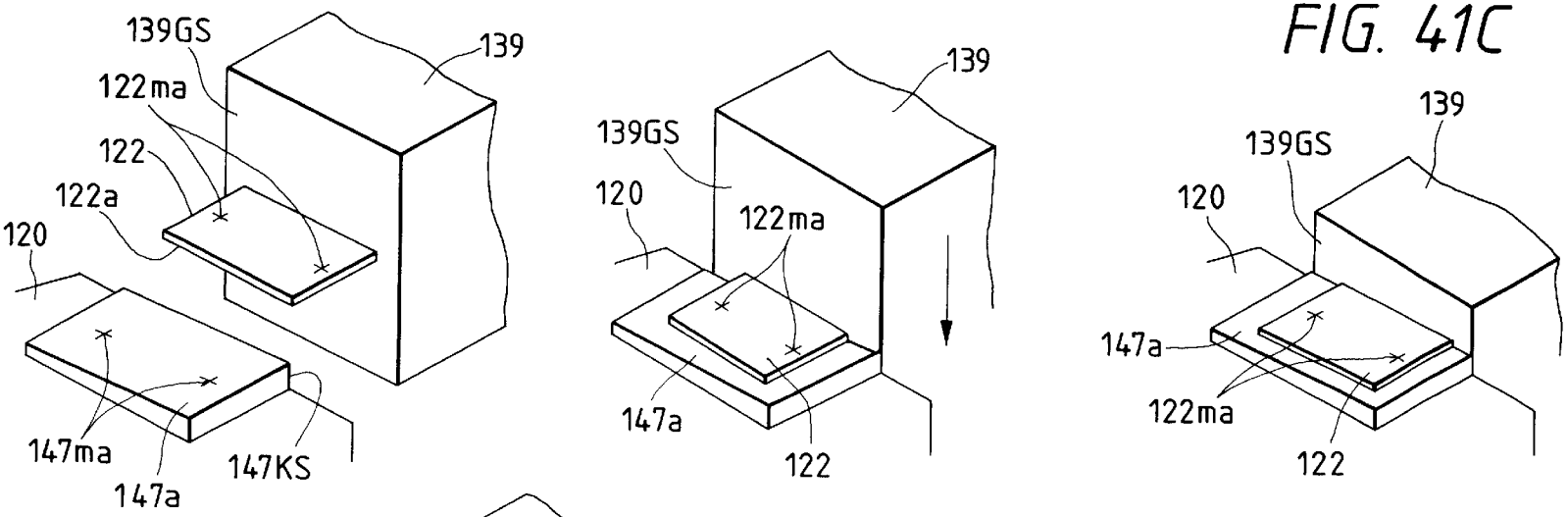
FIG. 41A
FIG. 41B
FIG. 41C
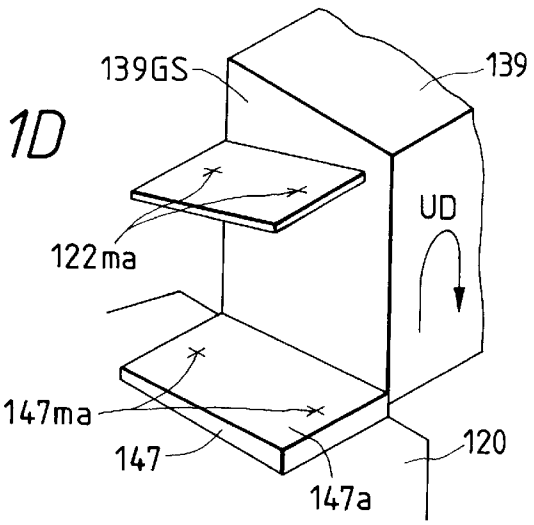
FIG. 41D
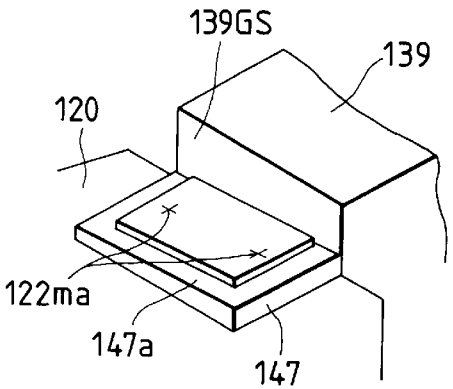
FIG. 41E

METHOD OF MANUFACTURING A LIQUID JET HEAD HAVING A PLURALITY OF MOVABLE MEMBERS

BACKGROUND OF THE INVENTION

1. Field of the Invention

The present invention relates to a method for manufacturing a liquid jet head having a structure that enables movable members to be displaced. More particularly, the invention relates to a method for manufacturing a head in accordance with a new discharging principle.

2. Related Background Art

In recent years, there has been developed a printing head, which uses the so-called bubble jet method whereby to heat ink and create bubbles for use of discharging ink onto a recording sheet for printing. Since this printing head is effective in enhancing the precision of printing, it is widely used practically.

For an assembling system for assembling a printing head using the bubble jet method, it is required to perform an accurate positioning in a range of micron order with respect to the heaters that heat ink, as well as to the discharge ports through which ink is discharge in the form of bubbles created by film boiling exerted by heat generated by heaters. For example, in order to attain a high precision of approximately 360 dpi as a printing accuracy, it is necessary to arrange 64 discharge ports at equal intervals in an area of approximately 4.5 mm. In this case, the arrangement pitch is approximately as minute as 70 micron.

Here, using a highly precise processing system such as a laser processor, the formation of discharge ports is possible at extremely small intervals as described above on the orifice plate installed on the front of a ceiling member in a high precision given within an allowable range. Also, for the formation of heaters, a highly precise etching technique is adopted to make it possible to form them on a heater board also within in a specific high precision within an allowable range.

When adhesively bonding this heater board and ceiling plate, it is necessary to position the heaters and the grooves provided for the ceiling plate in good precision.

As a method for executing this positioning, an image processing technique or the like is used to measure the positions of heaters and the groove of the ceiling plate, and then, while adjusting the position of the ceiling plate with respect to the heater board, these members are bonded (which is disclosed in the specification of Japanese Patent Laid-Open Application No. 4-171131). Also, there has been proposed a method whereby to provide a reference surface for the ceiling plate, which is caused to abut upon the cutting surface of the heater board, and then, while adjusting the position of the ceiling plate with respect to the heater board, these members are bonded.

Of these methods for adhesively bonding the heater board and ceiling plate, the later is simpler than the former in the equipment arrangement. Also, the line arrangement is made simpler, thus providing the advantage that the reduction of manufacturing costs is possible.

SUMMARY OF THE INVENTION

The present invention is designed to provide a method for manufacturing a component having movable members therefor, which is capable of presenting a good yield rate and obtaining a reliable accuracy in the process of manufacture with respect to the invention filed by the present inventors previously as an epoch-making presentation of discharging principle, and related structures, as well as excellent effects obtainable by the application thereof. Also, the invention is designed to solve the problems encountered in the conventional techniques of manufacture.

It is the primary object of the present invention to provide a method for adhesively bonding a thin film material having a number of movable members therefor on a desirable location of a liquid path portion in good precision simply and reliably without damaging the movable members.

It is another object of the present invention to provide a method for bonding a heater board and a ceiling plate, while adjusting the positions thereof without causing any damage to valves residing between the heater board and the ceiling plate in a process of the reference surface of the ceiling plate being caused to abut upon the cutting surface of the heater board for adhesively bonding them.

In order to achieve the object described above, the present invention provides a method for manufacturing a component having a number of liquid paths each with a movable member for use of liquid discharge. This methods comprises the steps of arranging a thin film material provided with a number of movable members and a component provided with a number of recessed portions corresponding liquid paths; and displacing the movable members corresponding to the recessed portions in a state of the movable members being displaced.

Also, the present invention relates to a method for manufacturing a liquid jet head using components produced by a method of manufacture comprising a step of placing a substrate having a number of heat generating elements arranged therefor with respect to the aforesaid component so as to position the heat generating elements corresponding to the movable members.

Also, the present invention relates to a liquid jet head produced by a method for manufacturing a liquid jet head provided with discharge ports for discharging liquid; air bubble generating areas for creating air bubbles in liquid; movable members arranged to face the air bubble generating areas, each capable of being displaced between a first position and a second position further away from each of said air bubble generating areas than the first position, this movable member being displaced from the first position to the second position by pressure exerted by each air bubble created in each of the air bubble generating areas, at the same time, causing each air bubble to expand larger in the upstream than the downstream in the direction toward the discharge port for discharging liquid from each of the discharge ports.

Also, in order to achieve the object described above the present invention is designed for a method for manufacturing a liquid jet head provided with a separation wall having movable members capable of being displaced, and with an elemental substrate having heat generating elements for displacing the movable members, including the following steps of:

preparing the separation wall and the elemental substrate;

coating liquid on the separation wall or on the elemental substrate; and positioning the separation wall to the elemental substrate to cause the separation wall to be closely in contact with the elemental substrate through liquid.

The present invention also relates to a method for shifting a thin film material to cause a thin film material of 50 $\mu$m thick or less to float on a base for use thereof by tilting the base to utilize the weight of the thin film material own for shifting the thin film material.

The present invention also relates to a method for positioning a thin film material, which comprises the steps of carrying a thin film material, which is caused to float by a method for shifting a thin film material referred to in the preceding paragraph, and of causing the thin film material to abut upon an abutting reference to position the thin film material.

The present invention also relates to a method for manufacturing a liquid discharging member comprising a step of positioning a thin film material by the application of a positioning method referred to in the preceding paragraphs when the thin film material is used for a liquid jet head structured by a member having liquid flow paths and an elemental substrate arranged therefor.

Also, the present invention relates to a method for manufacturing a liquid jet head provided with a thin film material between a ceiling plate having liquid flow paths and an elemental substrate having heat generating elements arranged therefor, comprising a step of causing the thin film material to float on a base, and tilting the base to utilize the weight of the thin film own to allow it to abut upon the reference surface of the base for provisional positioning.

Also, the present invention relates to a liquid jet head manufactured using the method of manufacture described in the preceding paragraph, and being provided with a plurality of discharge ports for discharging liquid; an elemental substrate having a plurality of heat generating elements arranged therefor to create air bubbles in liquid by giving heat to the liquid; liquid flow paths having supply paths for supplying liquid to the heat generating elements from the upstream side of the heat generating elements; and movable members formed by thin film material arranged to face the heat generating elements, each having a free end on the discharge port side to lead pressure exerted by the creation of air bubble to the discharge port side by displacing the free end by means of the pressure thus exerted.

Also, the present invention relates to a liquid jet head manufactured by the method of manufacture referred to in the preceding paragraph, being provided with a plurality of discharge ports for discharging liquid; a plurality of grooves for constituting a plurality of first liquid flow paths conductively connected directly with each of the discharging ports; a grooved ceiling plate having a recessed portion to constitute a first common liquid chamber integrally for supplying liquid to the plurality of first liquid flow paths; an elemental substrate having a plurality of heat generating elements arranged therefor for creating air bubbles in liquid by giving heat to the liquid; and a separation wall formed by thin film material arranged between the grooved ceiling plate and the elemental substrate to partly constitute the wall of a second liquid flow path facing the heat generating elements, at the same time, having movable members each capable of being displaced to the first liquid flow path side by pressure exerted by the creation of air bubbles in a position facing the heat generating elements.

Also the present invention relates to a method for positioning a sheet member structured by including the following steps of:

arranging a carrier jig having a connecting surface and magnetically holding a sheet member formed by magnetic material in a position facing a base having the installation surface allowing the connecting surface of the sheet member to abut upon the installation surface of the base;

performing the positional adjustment for the sheet member held by the carrier jig with respect to the specific position of the base in a state of the one directional position of the carrier jig being regulated with respect to the installation surface of the base; and causing the sheet member whose position has been adjusted with respect to the specific position of the base to part from the carrier jig.

Also, the present invention relates to a method for positioning a sheet member structured by including the following steps of:

arranging a carrier jig having a connecting surface and magnetically holding a sheet member formed by magnetic material in a position abutting upon and following the installation surface of the base having the installation surface allowing the connecting surface of the sheet member to abut upon the installation surface of the base;

causing the connecting surface of the sheet member held by the carrier jig to part from the installation surface of the base, and performing the positional adjustment of the sheet member held by the carrier jig with respect to the specific position of the base in a state of the one directional position of the carrier jig being regulated with respect to the installation surface of the base; and causing the sheet member whose position has been adjusted with respect to the specific position of the base to part from the carrier jig.

Also, the present invention relates to a method for positioning a sheet member structured by including the following steps of:

arranging a carrier jig having a connecting surface and magnetically holding a sheet member formed by magnetic material in a position abutting upon and following the installation surface of the base having the installation surface allowing the connecting surface of the sheet member to abut upon the installation surface of the base;

causing the connecting surface of the sheet member held by the carrier jig to slide and contact with the installation surface of the base, and performing the positional adjustment of the sheet member held by the carrier jig with respect to the specific position of the base in a state of the one directional position of the carrier jig being regulated with respect to the installation surface of the base; and causing the sheet member whose position has been adjusted with respect to the specific position of the base to part from the carrier jig.

Also, the present invention relates to a method for positioning a sheet member structured by including the following steps of:

arranging a carrier jig magnetically holding an edge orthogonal to the connecting surface of a sheet member formed by magnetic material in a position to enable the connecting surface of the sheet member to face the installation surface of the base allowing the connecting surface to abut upon the installation surface of the base;

performing the positional adjustment of the sheet member held by the carrier jig in the other direction thereof along the installation surface with respect to the specific position of the base in accordance with the positional marking arranged for the installation surface in a state of the one directional position of the carrier jig being regulated with respect to the installation surface of the base; and causing the sheet member whose position has been adjusted with respect to the specific position of the base to part from the carrier jig.

Also, the present invention relates to a method for positioning a sheet member structured by including the following steps of:

arranging a carrier jig provided with a first positional marking and magnetically holding an edge orthogonal to the connecting surface of a sheet member formed by magnetic material in a position to enable the connecting surface of the sheet member to face the installation surface of the base allowing the connecting surface to abut upon the installation surface of the base;

performing the positional adjustment of the sheet member held by the carrier jig in the other direction thereof along the installation surface with respect to the specific position of the base in accordance with a second positional marking provided for the installation surface of the base and the first positional marking provided for the jig in a state of the one directional position of the carrier jig being regulated with respect to the installation surface of the base; and causing the sheet member whose position has been adjusted with respect to the specific position of the base to part from the carrier jig.

Also, the present invention relates to a system for positioning a sheet member structured by including the following units:

a unit of positional adjustment mechanism provided with a jig selectively holding the edge of a sheet member orthogonal to the connecting surface of the sheet member, being arranged to face a base having the installation surface to arrange the sheet member thereon;

a position detecting unit for detecting the relative position of the sheet member held by the carrier jig with respect to the installation surface of the base; and a unit of positional adjustment mechanism for controlling the operation of positional adjustment for the sheet member held by the carrier jig with respect to the installation surface of the base in accordance with the detection output from the position detecting unit in a state of the edges of the carrier jig and the base abutting upon each other between them to regulate one direction of the carrier jig with respect to the installation surface of the base.

Other objective and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIG. 35A shows the entire process, and FIG. 35B is a view illustrating the step (I) represented in FIG. 35A.

FIGS. 41A, 41B, 41C, 41D, and 41E are views which illustrate the method for positioning a sheet member in accordance with the present invention, and the operation of the positioning apparatus using such method in accordance with a fourth embodiment thereof.

DETAILED DESCRIPTION OF THE PREFERRED EMBODIMENTS

Figure 1A:
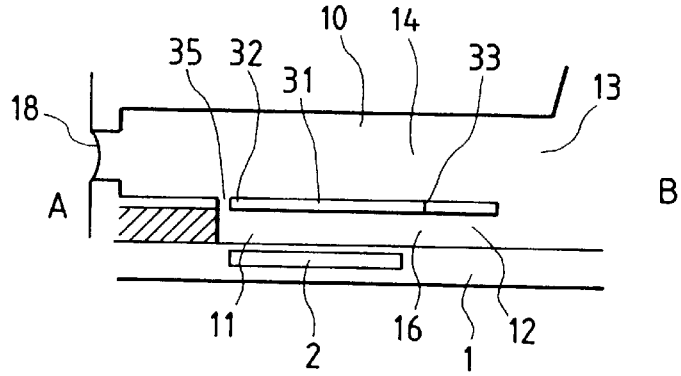
FIGS. 1A, 1B, 1C and 1D are cross-sectional views showing one example of a liquid jet head in accordance with the present invention.

Before describing a method for manufacturing an ink jet head of the present invention, the description will be made of an ink jet recording head operating in accordance with the new discharging principle, which is the object of manufacture using the method given below.

Hereinafter, with reference to accompanying drawings, the description will be made of an ink jet head in accordance with the new discharging principle.

At first, an example will be described, in which the propagating direction of pressure exerted by the creation of air bubbles and the developing direction of each air bubble are controlled in order to enhance the discharging power and discharging efficiency.

FIGS. 1A, 1B, 1C and 1D are cross-sectional views showing the liquid jet head of the present embodiment, taken in the direction of the liquid flow path. FIG. 2 is a partly broken perspective view showing this liquid jet head.

For the liquid jet head of the present embodiment, the heat generating elements 2 that cause thermal energy to act upon liquid (each in a form of heat generating resistor of 40 $\mu$m×105 $\mu$m in accordance with the present embodiment) are arranged on an elemental substrate 1 as discharge energy generating element for discharging liquid, and on this elemental substrate, liquid flow paths 10 are arranged corresponding to the heat generating elements 2. The liquid flow paths are conductively connected with the discharge ports 18, and at the same time, connected with a common liquid chamber 13 conductively, thus receiving liquid from this common liquid chamber 13 in an amount corresponding to the liquid which has been discharged from each of the discharge ports 18.

Above each liquid flow path 10 on the elemental substrate, a plate type movable member 31 having a flat portion is arranged in a cantilever fashion, which is formed a material having elasticity such as metal, and structured to face each of the heat generating element 2 described above. One end of this movable member 31 is fixed to a base (a supporting member) 34 or the like formed by patterning photosensitive resin on the wall of the liquid flow path and the elemental substrate. In this way, the movable member is supported. At the same time, a fulcrum (pivotal portion) 33 is structured.

This movable member 31 is arranged in a position facing the heat generating element 2 away from the heat generating element by approximately 15 $\mu$m to cover it so that the movable member has the fulcrum (pivotal portion; fixed end) 33 on the upstream side of a large flow running from the common liquid chamber 13 to the discharge port side through the movable member by means of the discharging operation of liquid, and that it has the free end (free edge portion) 32 on the downstream side of this fulcrum 33. Between the heat generating element 2 and the movable member 31 becomes an air bubble generating area 11. In this respect, the kinds, configurations, and arrangements of the heat generating elements and movable members are not necessarily limited to those which have been described. As described later, it should be good enough if only these elements and members are in a configuration and arrangement that enable them to control the development of air bubbles and the propagation of pressure as well. Here, the description will be made of the liquid flow path described above by dividing into two areas; with the movable member 31 as boundary, the portion that conductively connected with the discharge port 18 directly is defined as the first liquid flow path, and the portion having the air bubble generating area 11 and liquid supply path 12 is defined as the second liquid flow path 16 so as to facilitate the description of flow of liquid that will be referred to late.

The heat generating element 2 is actuated to heat liquid in the air bubble generating area 11 between the movable member 31 and the heat generating element 2. Then, an air bubble is created in the liquid in accordance with the film boiling phenomenon as disclosed in the specification of U.S. Pat. No. 4,723,129. Pressure exerted by the creation of the air bubble and the air bubble act upon the movable member 31 priorly. The movable member 31 is displaced to be open largely to the discharge port side centering on the fulcrum 33 as shown in FIGS. 1B and 1C or FIG. 2. Due to the displacement or the state of the displacement of the movable member 31, the propagation of pressure exerted by the creation of the air bubble and the development of the air bubble itself are led to the discharge port side.

Here, the description will be made of one of the fundamental discharging principles of the present invention. One of the most important principles of the present invention is that each of the movable members arranged to face an air bubble is displaced from the first position where it resides normally to the second position that is the position after displacement by the pressure exerted by the air bubble or the air bubble itself, and that the pressure exerted by the creation of the air bubble or the air bubble itself brought about by the displacement of the movable member 31 is led to the downstream side where the discharge port is arranged.

Figure 3:
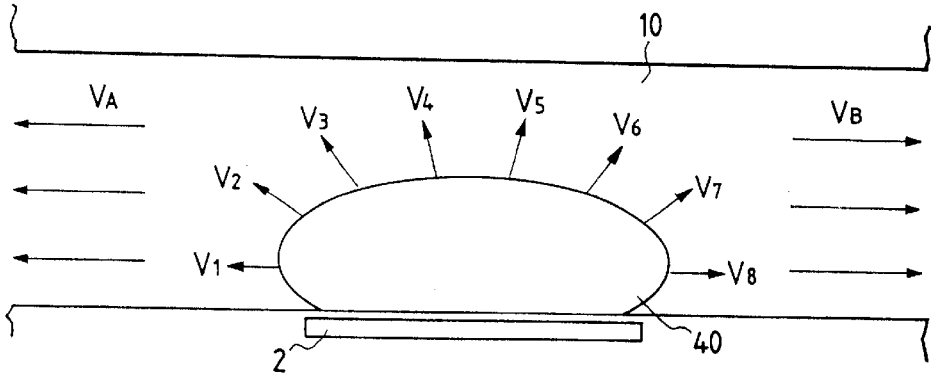
PRIOR ART FIG. 3
FIG. 3 is a view which schematically shows the pressure propagation from an air bubble in the conventional head.

In comparison of FIG. 3 which schematically shows the conventional structure of liquid flow path without using movable member and FIG. 4 for the present invention, this principle will be described further in detail. Here, in this respect, the propagating direction of pressure in the direction of the discharge port is defined as VA, and the propagating direction of pressure to the upstream side is defined as VB. As shown in FIG. 3, there is no structure for the conventional head that regulates the propagating direction of pressure exerted by the creation of the air bubble. As a result, the pressure propagating directions of the air bubble are brought in the direction of vertical line of the surface of the air bubble as indicated by the reference marks V1 to V8. Of pressures thus orientated, those having influence most on the liquid discharge, in particular, are the components in the pressure propagating direction toward VA, that is, those designated by reference marks V1 to V4, which reside in the pressure propagating directions closer to the discharge port portion from the position almost in a half of the air bubble. These are important components that directly contribute to the condition of liquid discharge efficiency, liquid discharging power, discharging speeds, and others. Further, the V1 functions better because it is closest to the discharge port side VA. On the contrary, the V4 has a comparatively smaller component in the direction toward the discharge port VA.

Figure 4:
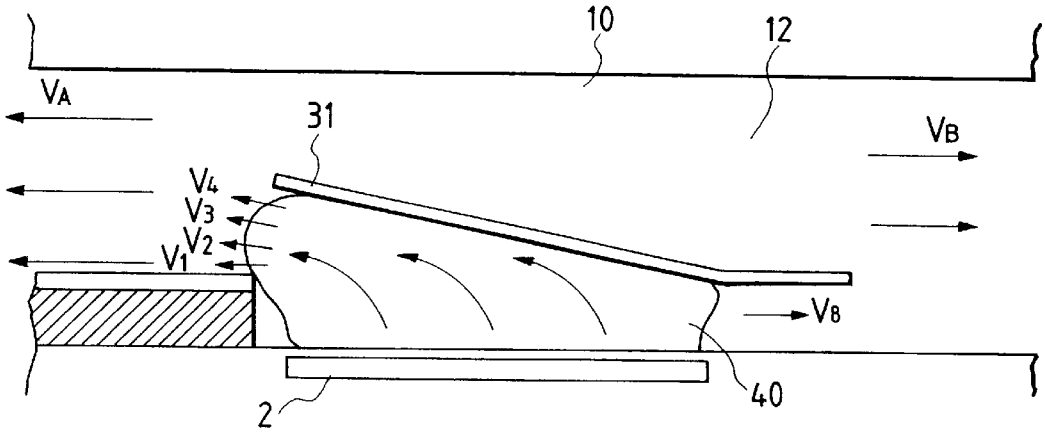
FIG. 4 is a view which schematically shows the pressure propagation from an air bubble in the head of the present invention.

In contrast, the present invention as represented in FIG. 4 makes it possible to operate the movable member 31 so that the propagating directions of pressure exerted by the creation of the air bubble, which are directed variously at V1 to V4 in the case shown in FIG. 3, are led to the downstream side (discharge port side) to change them in the pressure propagating direction toward VA. In this way, the pressure exerted by the creation of the air bubble 40 is made to contribute to discharge directly and efficiently. Then, the developing direction of the air bubble itself is also led to the downstream side as in the pressure propagating directions V1 to V4, thus enabling it to be developed larger in the downstream side than in the upstream side. The developing direction of the air bubble itself is controlled like this by means of the movable member, and the pressure propagating direction of the air bubble is controlled. Thus, it is made possible to attain the fundamental enhancement of the discharging efficiency, discharging power, discharging speeds, and others.

Now, reverting to FIGS. 1A, 1B, 1C, and 1D, the discharging operation of the liquid jet head of the present embodiment will be described in detail.

Figure 1B:
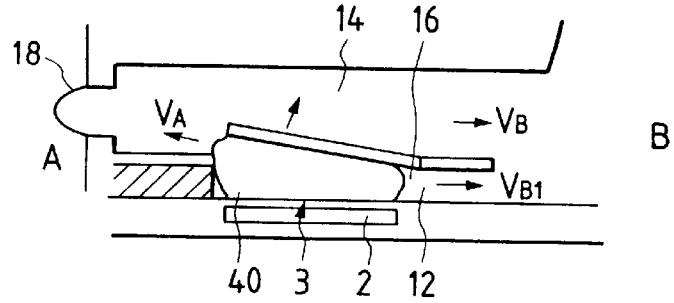
Figure 1C:
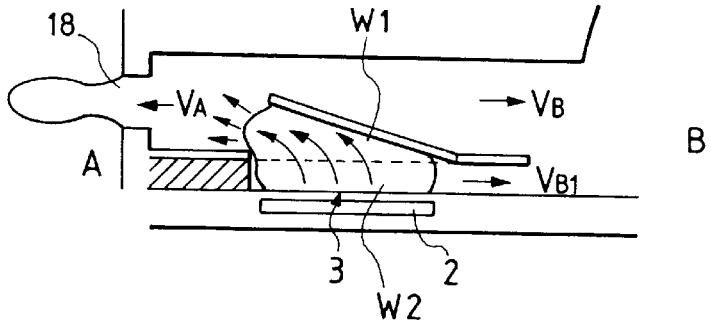
Figure 2:
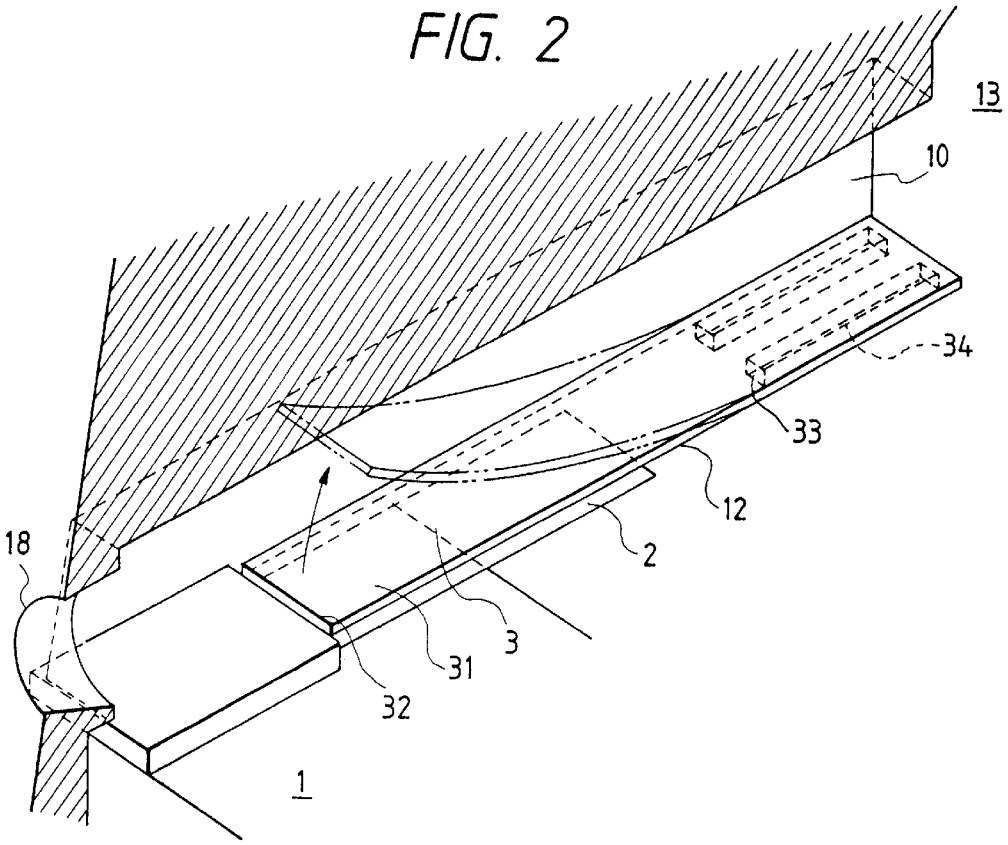
FIG. 2 is a partly broken perspective view which shows the liquid jet head of the present invention.

FIG. 1A shows the state before electric energy or the like is applied to the heat generating element 2, which is a state before the heat generating element generates heat. Here, what is important is that the movable member 31 is located in a position to face at least the downstream side portion of the air bubble with respect to the air bubble that has been created by the head of the heat generating element. In other words, the movable member 31 is arranged up to the position on the downstream at least from the center 3 of the area of the heat generating element in this structure of the liquid flow path (that is, the downstream form the line passing the center 3 of the area of the heat generating element, which is perpendicular to the longitudinal direction of the liquid flow path).

FIG. 1B shows a state that electric energy or the like is applied to the heat generating element 2 to heat it. Thus, liquid filled in the air bubble generating area 11 is partly heated to create the air bubble following film boiling.

At this juncture, the movable member 31 is displaced from the first position to the second position by means of pressure exerted by the creation of the air bubble 40, thus leading the propagating direction of the pressure exerted by the creation of the air bubble to the discharge port side. Here, what is important is that, as referred to earlier, the free end 32 of the movable member 31 is arranged in the downstream side (discharge port side), while the fulcrum 33 is arranged in the upstream side (common liquid chamber side) so that at least a part of the movable member is allowed to face the downstream portion of the heat generating element, that is, the downstream portion of the air bubble.

FIG. 1C shows a state that the air bubble 40 is further developed. Here, in accordance with the pressure following the creation of the air bubble 40, the movable member 31 is further displaced. The air bubble 40 thus created is developed larger on the downstream than the upstream, and at the same time, it is developed larger still beyond the first position of the movable member 31 (the position indicated by a dotted line). In this way, as the air bubble 40 is being developed, the movable member 31 is gradually displaced. Thus, it becomes possible to lead the developing direction of the air bubble toward the direction in which the pressure propagating direction of the air bubble 40 and its voluminal shift are easily effectuated. In other words, the developing direction of the air bubble toward the free end side is orientated to the discharge port 18 evenly. This is considered to be a factor that contributes to the enhancement of the discharging efficiency. The movable member 31 presents almost no obstacle in propagating the pressure waves in the direction of the discharge port following the air bubble or the creation of the air bubble. The propagating direction of the pressure and the developing direction of the air bubble can be controlled efficiently corresponding to the magnitude of the pressure to be propagated.

Figure 1D:
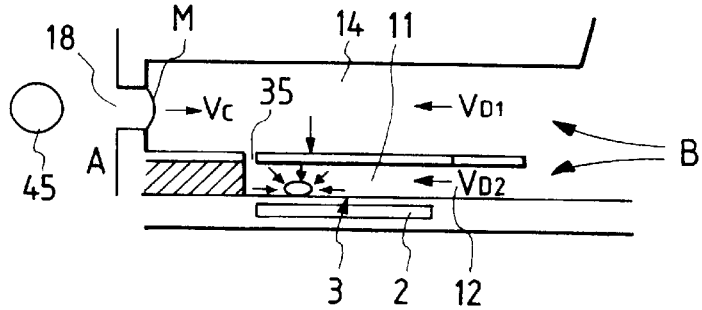

FIG. 1D shows a state that the air bubble 40 is contracted due to the reduction of the pressure in the air bubble subsequent to the film boiling described above. In this state, the air bubble disappears.

The movable member 31, which is displaced to the second position, is returned to the initial position shown in FIG. 1A (the first position) by means of the negative pressure exerted by the contraction of the air bubble and the restoring force provided by the spring of the movable member 31 itself as well. Also, when the air bubble disappears, liquid is caused to flow in from the upstream side (B), that is, from the common liquid chamber side as the flows of liquid designated by reference marks $V_{D1}$, and $V_{D2}$, and also, from the discharge port side as designated by $V_c$, in order to make up the contracted volume of the air bubble on the air bubble generating area 11, as well as the voluminal portion of liquid that has been discharged.

Now, the description has been made of the operation of the movable member following the creation of an air bubble, and also, of the discharging operation of liquid. Hereinafter, the description will be made of the liquid refilling for the liquid jet head in detail.

Here, using FIGS. 1A to 1D, the description will be made of the mechanism of liquid supply further in detail in accordance with the present invention.

Following the state shown in FIG. 1C, the air bubble 40 enters the defoaming process after its volume becomes the greatest. At this juncture, liquid that makes up the volume that has been reduced due to defoaming is caused to flow in the air bubble generating area 11 from the discharge port 18 side of a first liquid flow path 14 and from the common liquid chamber 13 side of a second liquid flow path 16 as well.

For the conventional liquid flow structure that does not contain any movable member 31, the amount of liquid flowing in the defoaming position from the discharge port side and the liquid amount flowing in from the common liquid chamber are determined by the magnitude of flow resistance between the portion nearer to the discharge port than to the air bubble generating area and the portion nearer to the common liquid chamber (that is, determined by the flow resistance and the inertia). Therefore, if the flow resistance is smaller on the side near to the discharge port, a large amount of liquid flows in the defoaming position from the discharge port side, which makes the backward amount of meniscus greater. Particularly when the flow resistance on the side nearer to the discharge port is made smaller in order to enhance the discharging efficiency, the backward amount of meniscus M becomes greater. As a result, it takes more time to execute refilling, which hinders a higher speed printing.

In contrast, for the liquid jet head structured in accordance with the present embodiment, the movable member 31 is provided. Therefore, the backward progress of the meniscus comes to a stop when the movable member 31 returns to the original position when defoaming, provided that the upper side of the volume W of the air bubble is given as $W_1$ with the first position being defined as the boundary, and the air bubble generating area 11 side as $W_2$. After that, the voluminal portion of the liquid supply for the remaining $W_2$ is made up by the liquid supply from the flow $V_{D2}$, which is mainly from the second liquid flow path. In this way, whereas the backward amount of the meniscus becomes as large as almost a half of the volume of the air bubble W conventionally, it is possible to suppress the backward amount of the meniscus to almost a half of the $W_1$, which is already smaller than the conventional backward amount of the meniscus.

Further, the liquid supply for the voluminal portion $W_2$ can be executed compulsorily mainly from the upstream side ($V_{D2}$) of the second liquid flow path 16 along the surface of the movable member 31 on the heat generating side. Therefore, refilling can be implemented at a higher speed.

Here, characteristically, when refilling is executed using the pressure exerted at the time of deforming for the conventional head, the vibration of meniscus becomes great, leading to the degrading of image quality. However, with the high-speed refilling described above, it is possible to suppress and make the vibration of the meniscus extremely small, because the liquid flow is suppressed on the area of the first liquid flow path 14 on the discharge port side and the air bubble generating area 11 on the discharge port side as well.

Thus, with the structure arranged in accordance with the present invention, it is possible to attain the compulsory refilling to the air bubble generating area 11 through the second liquid flow path 16 of the liquid supply path 12, and also, attain a high-speed refilling by suppressing the backward progress and vibration of the meniscus. Therefore, the stabilized discharges and a high-speed repetition of discharges can be implemented. Also, when applying it to the field of recording, the enhancement of image quality and high-speed recording can be implemented.

The structure arranged in accordance with the present invention is dually provided with the effective functions given below. In other words, it is possible to suppress the propagation of pressure exerted by the creation of the air bubble to the upstream side (back waves). Conventionally, in an air bubble created on a heat generating element, most of the pressure exerted by the air bubble on the common liquid chamber side (upstream side) becomes a force that pushes back liquid (back waves) toward the upstream side. The back waves bring about not only the pressure on the upstream side, but also, the shifting amount of liquid caused thereby, and the inertia following such shifting of liquid. This event results in the unfavorable performance of liquid refilling into the liquid flow paths, leading also to the hindrance of high-speed driving. In accordance with the present invention, such action working upon the upstream side is suppressed at first by means of the movable member 31, and then, the further enhancement of refilling supply performance is made possible.

Now, the description will be made further of the structures and effects characteristic of the present embodiment as given below.

The second liquid flow path 16 is provided with a liquid supply path 12 having the inner wall (the surface of the heat generating element does not fall remarkably) which is essentially connected with the heat generating element 2 flatly on the upstream of the heat generating element 2. In this case, the liquid supply to the air bubble generating area and to the surface of the heat generating element 2 is executed as indicated by the reference mark $V_{D2}$ along the surface on the side nearer to the air bubble generating area 11 of the movable member 31. As a result, the stagnation of liquid on the surface of the heat generating element 2 is suppressed to make it possible to easily remove the deposition of gas remaining in liquid, as well as the so-called remaining bubbles yet to be defoamed. Also, there is no possibility that the heat accumulation on liquid becomes too high. Therefore, it is possible to perform more stabilized creation of bubbles repeatedly at high speeds. In this respect, the description has been made of the liquid supply path 12 having an inner wall, which is essentially flat, but the present invention is not necessarily limited to it. It should be good enough if only the liquid supply path has a smooth inner wall connected with the surface of the heat generating element smoothly, and is configured so that there is no possibility that liquid is stagnated on each of the heat generating elements and that any large disturbance of flow takes place in supplying liquid.

Also, the liquid supply to the air bubble generating area is executed from the $V_{D1}$ through the side portion (slit 35) of the movable member. However, in order to lead the pressure toward the discharge port more effectively when each of the air bubbles is created, a large movable member is adopted to cover the entire area of the air bubble generating area (to cover the surface of the heat generating element totally) as shown in FIGS. 1A to 1D. In this case, the liquid flow from the $V_{D1}$ to the air bubble generating area 11 may be blocked if the mode is such that the flow resistance between the air bubble generating area 11 and the area near to the discharge port on the first liquid flow path 14 becomes larger when the movable member 31 returns to the first position. With the head structure described above, there is provided the flow $V_{D1}$ for liquid supply to the air bubble generating area. As a result, the liquid supply performance becomes extremely high, and there is no possibility that the liquid supply performance is lowered even if the structure is arranged so that the removable member 31 covers the air bubble generating area 11 totally for the enhancement of discharging efficiency.

Figure 5:
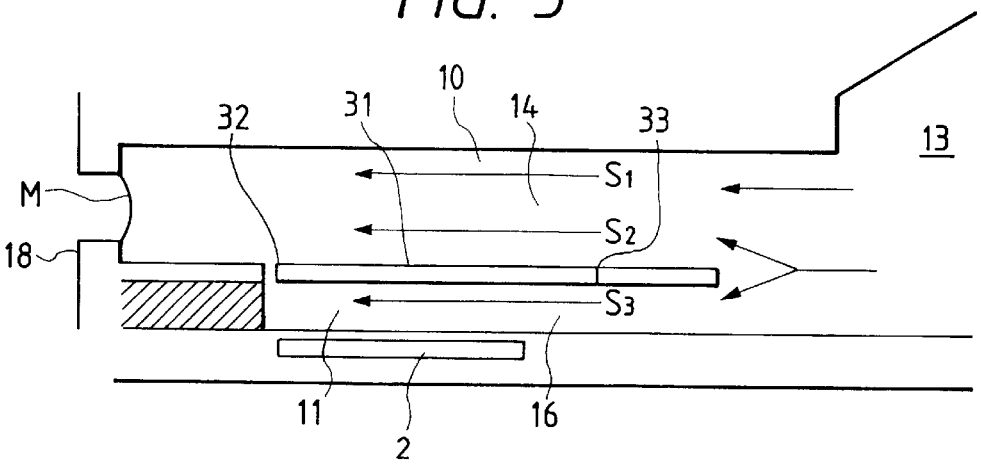
FIG. 5 is a view which schematically illustrates the flow of liquid in accordance with the present invention.

Now, as to the positions of the free end 32 of the movable member 31 and the fulcrum 33, it is arranged that the free end is relatively on the downstream side than the fulcrum as shown in FIG. 5. Since the structure is arranged in this way, it becomes possible to implement the function to lead the pressure propagating direction and developing direction of the air bubble toward the discharge port side effectively when foaming is effectuated as described earlier. Further, with this positional relationship, it is made possible to produce not only favorable effects on the discharging functions, but also, make the flow resistance smaller for liquid running in the liquid flow path 10 as liquid is being supplied, thus obtaining the effect that refilling is possible at higher speeds. This is because, as shown in FIG. 5, the free end and the fulcrum 33 are arranged not to present resistance to the flows S1, S2, and S3 running in the liquid flow path 10 (including the first liquid flow path 14 and the second liquid flow path 16) along the meniscus M, which has progressed backward due to discharging, returning to the discharge port 18 by means of capillary force or along liquid supply being supplied subsequent to defoaming.

To supplement this, as shown in FIGS. 1A to 1D, the free end 32 of the movable member 31 extends over the heat generating element 2 to face the downstream side of the center 3 of the area (that is the line perpendicular to the longitudinal direction of the liquid flow path, passing the center (central portion) of the area of the heat generating element), which divides the heat generating element 2 into the upstream side and the downstream side. In this way, the pressure generated on the downstream side of the central position 3 of the heat generating element, which contributes greatly to liquid discharging, or the air bubble, is received by the movable member 31. Thus, the pressure and air bubble are led to the discharge port side for the fundamental enhancement of the discharging efficiency and discharging power. Further, the upstream side of the air bubble is also utilized to produce many favorable effects.

Also, with the structure described above, the free end of the movable member 31 effectuates a mechanical displacement instantaneously. This function is also considered to contribute effectively to discharging liquid.

Figure 6:
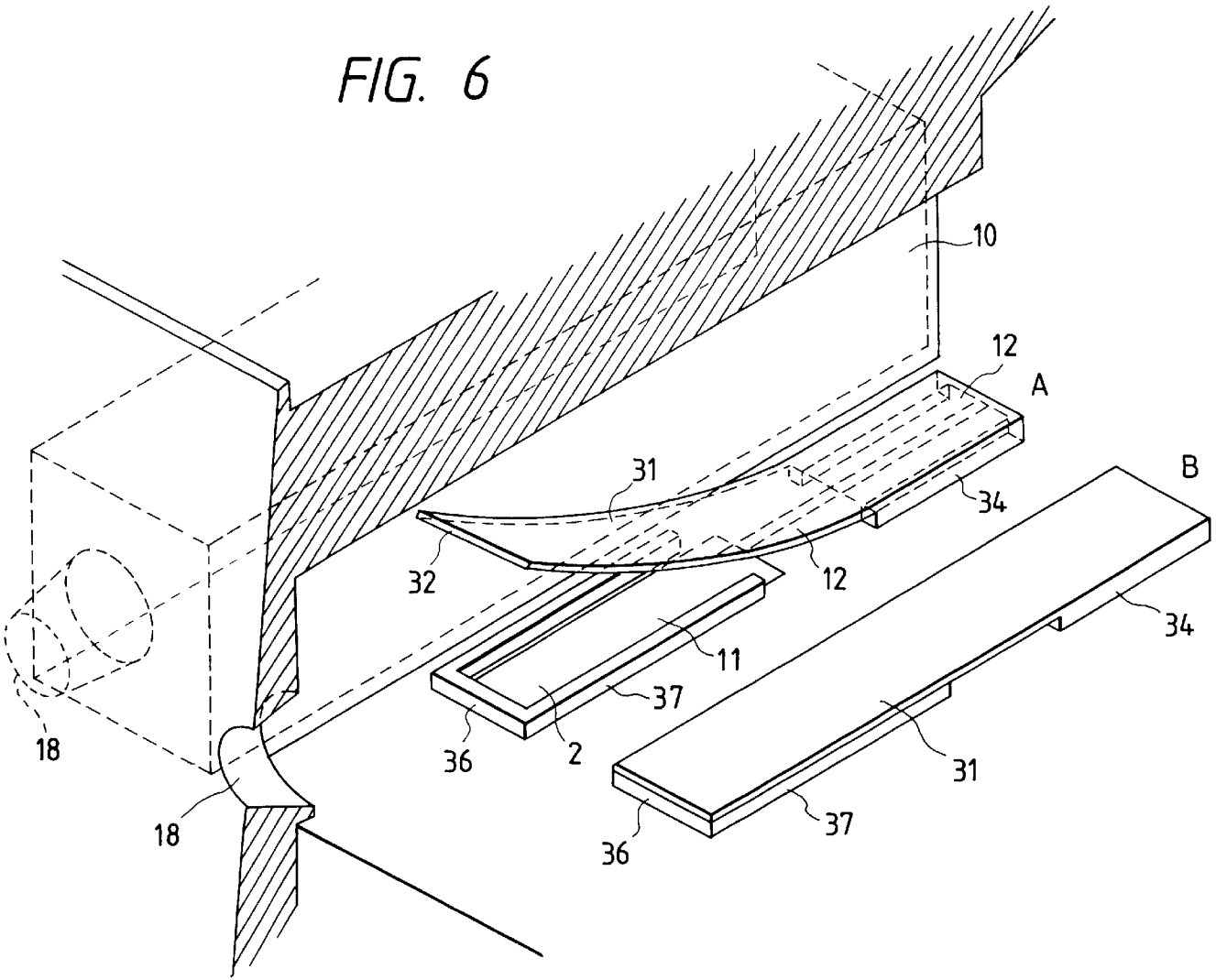
FIG. 6 is a partly broken perspective view which shows the liquid jet head in accordance with a second embodiment of the present invention.

FIG. 6 shows an ink jet head of a second embodiment in accordance with the new discharging principle. In FIG. 6, a reference mark A indicates the state that the movable member is displaced (the air bubble is not shown); B indicated the initial position of the movable member (the first position). In this state B, it is assumed that the air bubble discharging area 11 is essentially closed. (Here, although not shown, there is a liquid flow wall between A and B to separate one flow path from the other.)

For the movable member shown in FIG. 6, the base 34 is arranged for each of the side ends, and between these two bases, the liquid supply path 12 is provided. Thus, liquid supplied becomes possible along the surface of the movable member on the heat generating element side, and also, from the liquid supply path having the surface connected with the surface of the heat generating element substantially flatly or smoothly.

Here, in the initial position (first position) of the movable member, the movable member 31 is closely located or is closely in contact with the downstream wall 36 and side wall 37 of the heat generating element arranged on the downstream side and in the width of the heat generating element. Thus it is essentially closed on the discharge port 18 side of the air bubble generating area 11. Therefore, the pressure exerted by the air bubble at the time of foaming, particularly the pressure on the downstream side of the air bubble, is caused to act upon the free end side of the movable member intensively without allowing it to escape.

Also, at the time of defoaming, the movable member returns to the first position, and then, the liquid supply to the heat generating element at this juncture makes it possible to keep the discharge port side of the air bubble generating area closely closed essentially. As a result, it is possible to suppress the backward progress of the meniscus and various other effects referred to in the description of the previous embodiment. Also, as to the effects of refilling, the same functions and effects are obtainable as in the previous embodiment.

Also, for the present embodiment, the bases 31 that support and fix the movable member 31 as shown in FIG. 2 and FIG. 6 are arranged on the upstream away from each heat generating element 2. At the same time, each width of the bases is made narrower than the liquid flow path 10. Thus, the liquid supply to the liquid supply path 12 is performed as described above. Also, the configuration of each base 34 is not necessarily limited to this embodiment. It should be good enough if only the bases are configured to make the smooth refilling possible.

In this respect, the gap between the movable member 31 and the heat generating element is set at approximately 15 $\mu$m for the present embodiment, but it should be good enough if only the gap is set in a range that enables the pressure exerted by the creation of the bubble to be transferred to the movable member sufficiently.

Now, the description has been made of the main principle of liquid discharge. For the present embodiment and those following it, the description will be made of the embodiments for which the passage of liquid flow is structured by plural flow paths to make it possible to separate liquid for the respective uses; one is liquid for use of foaming by the application of more heat (foaming liquid), and the other is liquid mainly for use of discharging (discharging liquid).

Figure 7:
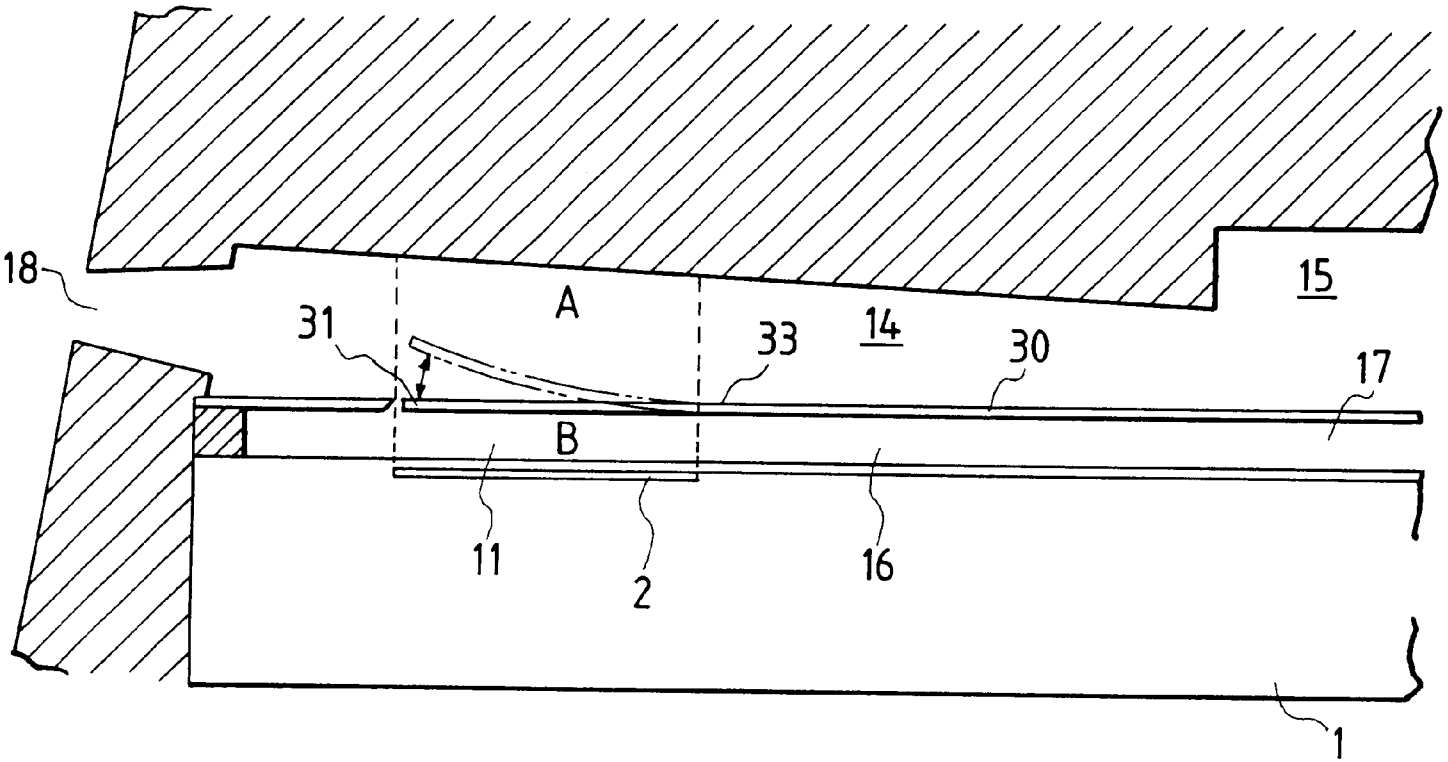
FIG. 7 is a cross-sectional view which shows the liquid jet head (two flow paths) in accordance with a third embodiment of the present invention.
Figure 8:
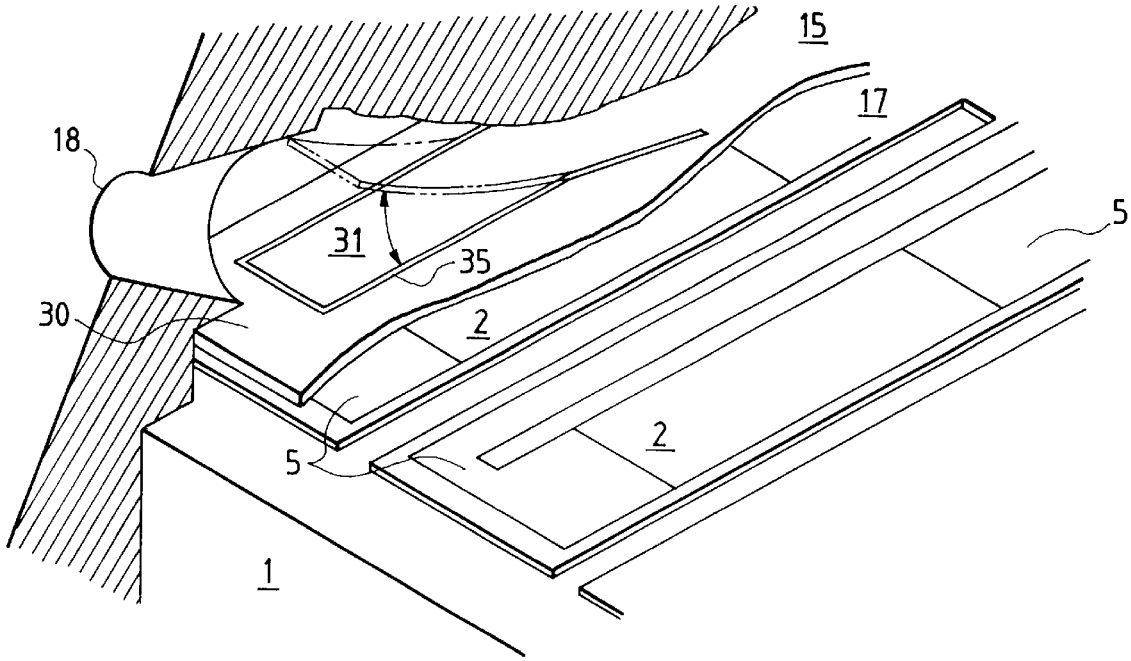
FIG. 8 is a partly broken perspective view which shows the liquid jet head in accordance with a third embodiment of the present invention.

FIG. 7 is a cross-sectional view schematically showing the liquid jet head in accordance with the present embodiment, taken in the liquid flow path direction thereof. FIG. 8 is a partially broken perspective view showing this liquid jet head.

The liquid jet head of the present embodiment is provided with the second liquid flow path 16 for use of foaming on an elemental substrate 1 where each of the heat generating elements 2 is arranged to give thermal energy to liquid for the creation of air bubbles, and then, the first liquid flow path 14 for use of discharging liquid is arranged on it, which is directly connected with each of the discharge ports 18 conductively.

The upstream side of the first liquid flow path 14 is conductively connected with a first common liquid chamber 15 to supply discharging liquid to a plurality of first liquid flow paths 14. The upstream side of the second liquid flow path 16 is conductively connected with a second common liquid chamber 17 to supply foaming liquid to a plurality of second liquid flow paths 16.

However, if the same liquid is adopted as foaming liquid and discharging liquid, it may be possible to provide only one common liquid chamber, which is shared by them for different uses.

Between the first liquid flow path 14 and the second liquid flow path 16, there is arranged a separation wall 30 formed by an elastic metal or the like to separate the first liquid flow path and the second liquid flow path. In this respect, if it is better not to mix liquids to be used for foaming and discharging as far as the circumstances permit, the distribution of the first liquid flow path 14 and the second liquid flow path 16 should be separated by the provision of the separation wall. However, if there is no problem even by mixing foaming liquid and discharging liquid, the separation wall is not necessarily provided with such function as to implement the complete separation.

The portion of the separation wall, which is positioned in the projection space to the upper part of the surface direction of the heat generating element (hereinafter referred to as a discharge pressure generating area; areas designated by reference marks A and B with respect to the air bubble generating area 11), is arranged to function as a movable member 31 prepared in a cantilever fashion, which is provided with a free end by means of a slit 35 on the discharge port side, and the fulcrum 33 positioned on the common liquid chambers (15 and 17) side. This movable member 31 is arranged to face the air bubble generating area 11 (B). Therefore, it operates to be open to the discharge port side of the first liquid flow path by means of foaming of the foaming liquid (in the direction indicated by arrows in FIG. 7). In FIG. 8, too, the separation wall 30 is arranged through the space that constitutes the second liquid flow path 16 on the elemental substrate 1 having on it the heat generating resistor unit serving as the heat generating elements 2 and wire electrodes 5 to apply electric signals to the heat generating resistor unit.

The relationship between the arrangements of the fulcrum 33 and the free end 32 of the movable member 31 and each of the heat generating elements 2 is arranged to be the same as the case referred to in the previous embodiment.

Also, in the description of the previous embodiment, the structural relationship between the liquid supply path 12 and the heat generating element 2 is referred to. The same description is applicable to the structural relationship between the second liquid flow path 16 and each of the heat generating elements 2 for the present embodiment.

Now, in conjunction with FIGS. 9A and 9B, the operation of the liquid jet head will be described.

When driving the head, the same water ink is used for driving as discharging liquid to be supplied to the first liquid flow path 14 and as foaming liquid to be supplied to the second liquid flow path 16.

Heat generated by each of the heat generating elements 2 acts upon the foaming liquid in the air bubble generating area of the second liquid flow path, thus creating each air bubble 40 in the foaming liquid by means of film boiling phenomenon as disclosed in the specification of U.S. Pat. No. 4,723,129 in the same manner as referred to in the description of the previous embodiment.

For the present embodiment, foaming pressure cannot escape in the three directions but toward the upstream side of the air bubble generating area. Therefore, the pressure exerted by the creation of air bubble is propagated intensively to the movable member 6 side arranged in the discharge pressure generating area, and then, along the development of the air bubble, the movable member 6 is displaced from the state shown in FIG. 9A to the liquid flow path side as shown in FIG. 9B. By this movement of the movable member, the first liquid flow path 14 and the second liquid flow path 16 are largely connected conductively, thus enabling the pressure exerted by the creation of air bubble to be propagated mainly in the direction toward the discharge port side of the first liquid flow path (direction indicated by an arrow as A). By this propagation of pressure and the mechanical displacement of the movable member as described earlier, liquid is discharged from the discharge port.

Figure 9A:
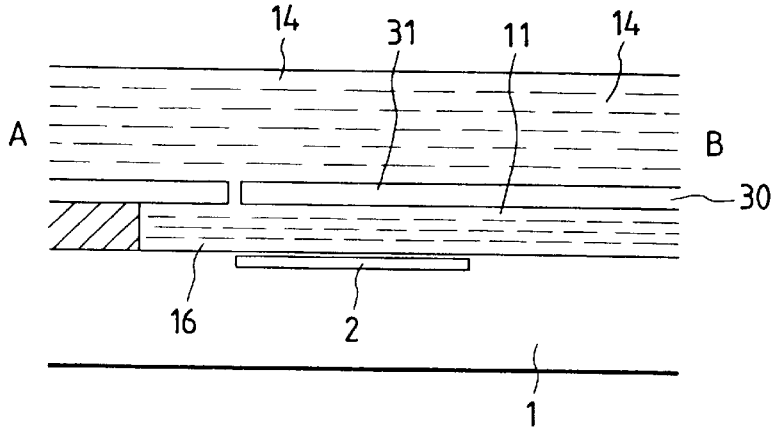
FIGS. 9A and 9B are views which illustrate the operation of a movable member.

Now, when the movable member 31 returns to the position shown in FIG. 9A following the contraction of the air bubble, discharging liquid is supplied from the upstream side of the first liquid flow path 14 in an amount corresponding to the amount of discharging liquid that has been discharged. This supply of discharging liquid is in the direction in which the movable member is closed in the same manner as the previous embodiment described above. Therefore, refilling of discharging liquid is not hindered by the presence of the movable member.

The functions and effects of the principal part of this liquid jet head, such as the propagation of foaming pressure following the displacement of the movable member, the developing direction of the air bubble, the prevention of back waves, are the same as those heads described in conjunction with the first embodiment and others. Besides, it has more advantages given below by adopting the two-liquid flow path structure as arranged for the present embodiment.

In other words, in accordance with the structure of the present embodiment, discharging liquid and foaming liquid can be separate ones, and then, it is made possible to discharge the discharging liquid by means of the pressure exerted by foaming of the foaming liquid. As a result, such highly viscous liquid as polyethylene glycol or the like, which presents insufficient discharging power due to insufficient foaming effectuated by the conventional heating, can be discharged in good condition in such a manner that a liquid of the kind is supplied to the first liquid flow path, while liquid (such as a mixture of ethanol and water =4:6 in approximately 1 to 2 cp) that promotes foaming of the liquid or liquid having a low boiling point is supplied to the second liquid flow path in order to perform good foaming operation.

Also, as foaming liquid, it becomes possible to select such a liquid that generates no burning residue or any other deposit on the surface of the heat generating element when receiving heat. Then, foaming can be stabilized likewise so as to make good discharging possible.

Further, with the head structured of the present invention, it is also possible to demonstrate the effects referred to in the description of the previous embodiment. Therefore, the highly viscous liquid and others can be discharged with a high discharging efficiency and high discharging power. Also, even for the liquid whose nature is not very strong against heating, it is equally possible to discharge such liquid with a high discharging efficiency and high discharging power as described above without damaging it thermally if this liquid is supplied to the first liquid flow path, while the liquid, whose nature is such that it does not change its properties thermally and presents good foaming, is supplied to the second liquid flow path.

Now, the description has been made of the embodiments of the principal parts of the liquid jet head and the liquid discharging in accordance with the present invention. Hereinafter, in conjunction with the accompanying drawings, the description will be made of the examples of embodying modes preferably applicable to those embodiments described above. In the description given below, however, there are some cases where either one of the embodiments of the one liquid flow mode and two-liquid flow mode described above, but, unless otherwise specifically mentioned, such description will be applicable to both embodying modes.

(Ceiling Configuration of the Liquid Flow Path)

Figure 10:
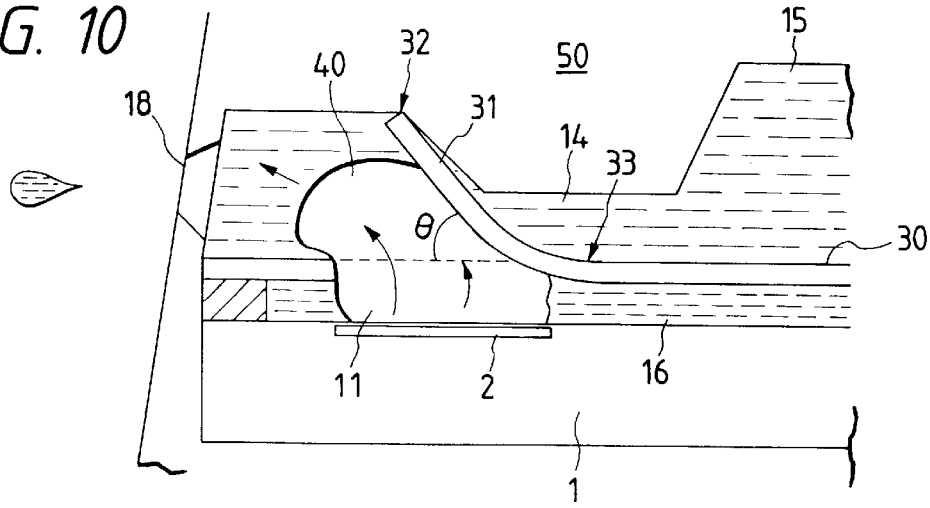
FIG. 10 is a view which illustrates the structure of a movable member and a first liquid flow path.

FIG. 10 is a cross-sectional view of the liquid jet head of the present invention, taken in the direction of its liquid flow path. Here, a grooved member 50, which is arranged to constitute the first liquid flow path 14 (or the liquid flow path 10 in FIGS. 1A to 1D), is provided on the separation wall 30. The height of the ceiling of the liquid flow path ceiling is made larger in the vicinity of the position of the free end 32 of the movable member 31 so that the operational angle θ is made larger for the movable member 31. The operational range of the movable member 31 is determined by taking the structure of liquid flow paths, durability of the movable member, foaming power, and others into consideration, but conceivably, it should be desirable that the operation is possible up to the angle including the angle in the axial direction of each discharge port.

Also, as shown in FIG. 10, the transfer of the discharging power becomes better still if the displacement height of the free end of the movable member 31 is made larger than the diameter of the discharge port. Further, as shown in FIG. 10, the height of the liquid flow path ceiling in the position of the fulcrum 33 of the movable member 31 is made smaller than that of the ceiling of the liquid flow path in the position of the free end 32 of the movable member 31. As a result, when the movable member 31 is displaced, the pressure waves are prevented from escaping to the upstream side more effectively.

(Relationship of Arrangement between the Second Liquid Flow Path and the Movable Member)

Figure 11A:
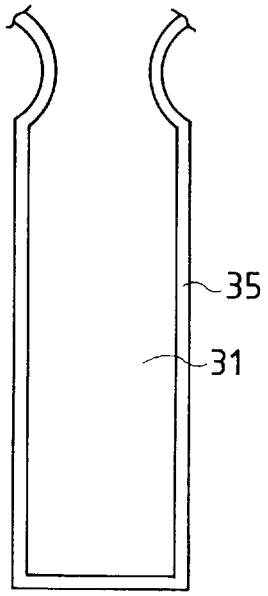
FIGS. 11A, 11B, and 11C are views which illustrate the structure of a movable member and a liquid flow path.
Figure 11B:
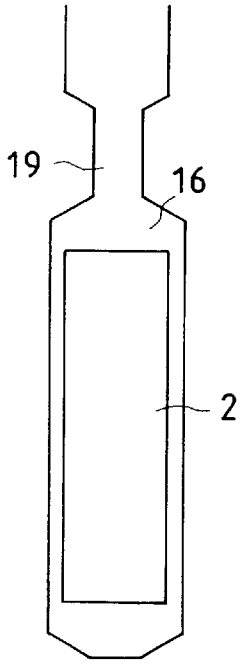
Figure 11C:
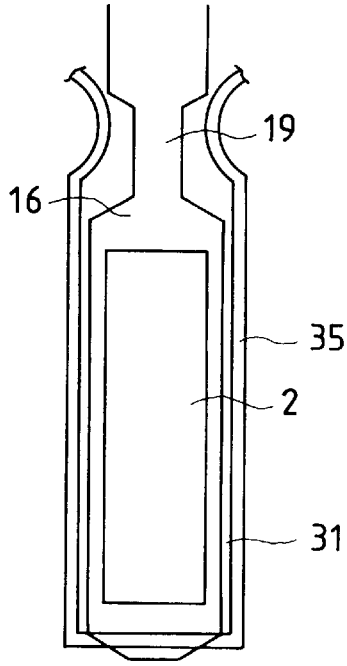

FIGS. 11A to 11C are views illustrating the relationship of the arrangement between the movable member 31 and the second liquid flow path 16; FIG. 11A shows the separation wall 30 and the vicinity of the movable member 31, being observed from above; FIG. 11B shows the second liquid flow path 16 after removing the separation wall 30, being also observed from above; and FIG. 11C is a view schematically showing the relationship of the arrangement between the movable member 31 and the second liquid flow path 16 by overlapping each of these elements. Here, all the figures illustrate the front side where the discharge port 18 is arranged underneath each one of them.

The second liquid flow path 16 of the present embodiment is provided with a narrower portion 19 on the upstream side of the heat generating element 2 (here, the upstream side means the one in the large flow from the second common liquid chamber side to the discharge port 18 through the position of the heat generating element, movable member 31, and the first liquid flow path), and this path is structured like a chamber (foaming chamber) arranged to suppress foaming pressure so that it does not escape easily to the upstream side of the second liquid flow path 16.

If such narrower portion should be provided for the conventional head whose foaming and discharging paths are one and the same in anticipation that pressure exerted by each of the heat generating elements on each liquid chamber side does not escape to the common liquid chamber side, it is necessary to arrange the structure so as not to make the sectional area too small for the liquid flow path in the narrower portion, taking liquid refilling operation fully into consideration.

However, for the present embodiment, most of liquid in the first liquid flow path is used for discharging, while the arrangement can be made to suppress the consumption of foaming liquid in the second liquid flow path where each of the heat generating elements is provided. It may be possible, therefore, that the refilling amount of foaming liquid to the air bubble generating area 11 of the second liquid flow path is made smaller. As a result, the gap in the narrower portion described above is made as extremely small as several μm to ten and several pm in order to further suppress the escape of foaming pressure exerted in the second liquid flow path to its circumference. The pressure is led toward the movable member side intensively. Then, as this pressure can be utilized as discharge power through the movable member 31, it is possible to obtain higher discharging efficiency, and discharging power as well. In this respect, however, the configuration of the second liquid flow path 16 is not necessarily limited to the one adopted for the structure described above. It should be good enough if only such configuration is made so that the foaming pressure is effectively led to the movable member 31.

In this respect, as shown in FIG. 11C, the side end of the movable member 31 covers a part of the wall that constitutes the second liquid flow path 16 in order to prevent the movable member 31 from falling off into the second liquid flow path, making the separation between the discharging liquid and the foaming liquid more reliable. Also, the escape of air bubble from the slit is suppressed in order to enhance both the discharging power and discharging efficiency more. In this way, the refilling effect from the upstream side is further improved by the utilization of pressure exerted at the time of defoaming.

Figure 9B:
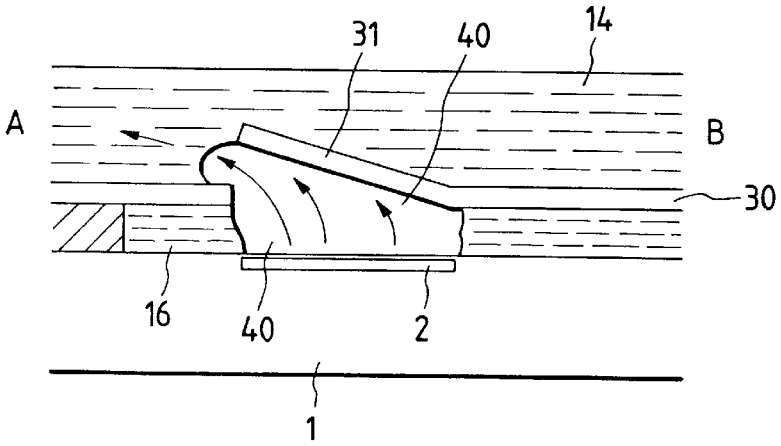

Here, in FIG. 9B and FIG. 10, the air bubble created in the air bubble generating area of the second liquid flow path 16 is partly expanded into the first liquid flow path 14 side following the displacement of the movable member 31 to the first liquid flow path 14 side. However, by arranging the height of the second liquid flow path to allow the air bubble to expand in this manner, it is possible to enhance the discharging power more as compared with the case where no expansion is possible. In order to effectuate such expansion of the air bubble into the first liquid flow path 14, it is preferable to make the height of the second liquid flow path 16 lower than the maximum height of the air bubble. This height should preferably be made from several μm to 30 μm. Here, the height is set at 15 μm for the present embodiment.

(Movable Member and Separation Wall)

Figure 12A:
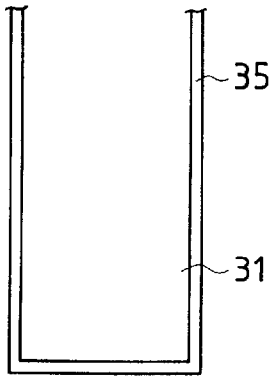
FIGS. 12A, 12B, and 12C are views which illustrate the other configurations of the movable member.
Figure 12B:
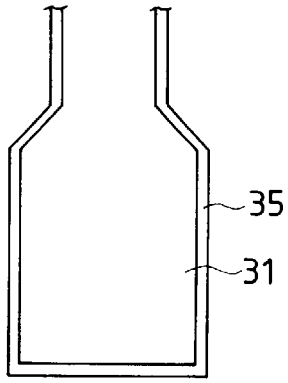
Figure 12C:
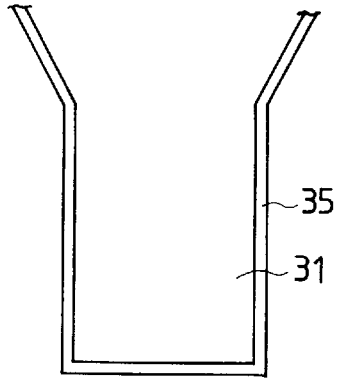
Figure 13:
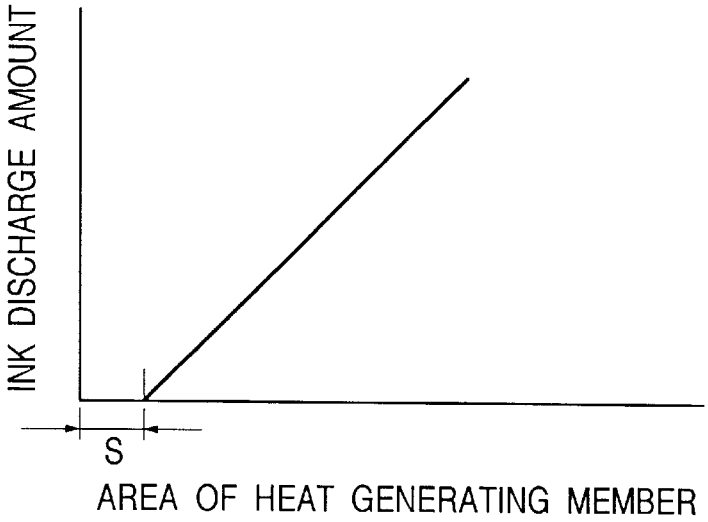
FIG. 13 is a view which shows the relationship between the ink discharge amount and the area of a heat generating element.

FIGS. 12A to 12C are views that shows other configurations of the movable member 31. A reference numeral 35 designates each slit arranged for each of them. By means of the slit 35, the movable member 31 is constituted. FIG. 12A shows an oblongly elongated configuration; FIG. 12B shows the configuration having narrower portion on the fulcrum side to facilitate the movement of the member; FIG. 12C shows the configuration having the widening portion on the fulcrum side to enhance the durability of the member. As the configuration that presents an easier movement and good durability, it is preferable to configure the member to present its fulcrum side whose width is narrower in circular shape as shown in FIG. 11A. However, it should be good enough if only the movable member is configured not to occupy the second liquid flow path side, while facilitating its movement, and present excellent durability.

For the previous embodiment, the flat type movable member 31 and the separation wall 30 having this movable member is formed by nickel of 5 μm thick. However, the material is not necessarily limited to it. As the material for the formation of a movable member and a separation wall, it should be good enough if only such material has solvent resistance to foaming liquid and discharging liquid, while having elasticity that allows good operation as a movable member, and also, properties that enable a fine slit to be formed therefor.

For the material of the movable member, it is preferable to use highly durable metal, such as silver, nickel, gold, iron, titanium, aluminum, platinum, tantalum, stainless steel, or phosphor bronze, or alloys thereof, or resin having acrylonitrile, butadiene, styrene or other nitrile group, resin having polyamide or other amide group, resin having polycarbonate or other carboxyl group, resin having polyacetal or other aldehyde group, resin having polysulfone or other sulfone group, or resin having liquid crystal polymer or the like and its chemical compound, such metal as having high resistance to ink as gold, tungsten, tantalum, nickel, stainless steel, or tantalum, or its alloys and those having them coated on its surface for obtaining resistance to ink, or resin having polyamide or other amide group, resin having polyacetal or other aldehyde group, resin having polyether ketone or other ketone group, resin having polyimide or other imide group, resin having phenol resin or hydroxyl group, resin having polyethylene or other ethyl group, resin having polypropylene or other alkyl group, resin having epoxy resin or other epoxy group, resin having melamine resin or other amino group, resin having xylene resin or other methylol group, and its compounds, and further, ceramics such as silicon dioxide and its compound.

For the material of the separation wall, it is preferable to use resin having good properties of resistance to heat and solvent, as well as good formability as typically represented by engineering plastics in recent years, such as polyethylene, polypropylene, polyamide, polyethylene telephthalate, melamine resin, phenol resin, epoxy resin, polybutadiene, polyurethane, polyether etherketone, polyether sulfone, polyarylate, polyimide, polysulfone, or liquid crystal polymer (LCP) and its compound or silicon dioxide, silicon nitride, nickel, gold, stainless steel or other metals, its alloys or those coated with titanium or gold.

Also, the thickness of the separation wall should be determined by the material and configuration from the viewpoint of whether or not desired strength and operativity are obtainable as a movable member using them. However, it is preferable to obtain a thickness of 0.5 μm to 10 μm.

In this respect, the width of the slit 35 that forms the movable member 31 is set at 2 μm for the present embodiment. However, if it is desired to prevent any mixture of liquids when foaming liquid and discharging liquid are different ones, the width of the slit 35 is made a gap of a dimension that allows the formation of meniscus between both liquids, and the distribution of liquids themselves should be suppressed. For example, if liquid of approximately 2 cp (centipoise) is used as foaming liquid and liquid of approximately 100 cp or more is used as discharging liquid, it is possible to prevent its mixture even by the slit of 5 μm wide, but it is preferable to make it 3 μm or less.

As the movable member of the present invention, a thickness of μm order (t μm) is taken into account. It is not intended to use any movable member having a thickness of cm order. For the movable member having a thickness of μm order, it is desirable to take into account some variations resulting from manufacture if the width of slit (W μm) of μm order is set as an objective range therefor.

If the thickness of the member, which faces the free end and or side end of the movable member 31 having a slit to be formed therefor, is equal to that of the movable member (see FIGS. 9A, 9B, FIG. 10 and others), it is possible to suppress the mixture of foaming and discharging liquids stably by defining the relationship between the width and thickness of the slit within the range give below in consideration of the variations that may be brought about by manufacture. In other words, although condition is limited, if a highly viscous ink (5 cp, 10 cp, or the like) is used with respect to foaming liquid having a viscosity of 3 cp or less from the viewpoint of designing, it is possible to arrange a structure capable of suppressing the mixture of these liquids for a long time, provided that it is arranged to satisfy the relationship of $W/t<=1$.

Also, the slit that gives a condition "essentially closed state" as referred to in the description of the present invention is made more reliable, if it is processed within an order of several μm.

As described above, if the functions are separated with respect to foaming liquid and discharging liquid, the movable member functions essentially as a partitioning member. However, when the movable member shifts along the creation of each air bubble, it is observable that slight amount of foaming liquid is mixed with discharging liquid. Discharging liquid for image formation has, in general, a colorant density of approximately 3% to 5% for ink jet recording. With this in view, any significant change is not considered to be brought about if foaming liquid is mixed with discharging droplet within a range of 20% or less. Therefore, it is to be understood that the mixture of foaming liquid and discharging liquid, which makes such mixture 20% or less of the discharging droplet, is included in the range of the present invention.

In this respect, with the structure arranged for the present embodiment, the mixture of foaming liquid is 15% at the upper limit even if viscosity changes. With foaming liquid of 5 cp or less, this mixing ratio is approximately 10% at the upper limit, although it depends on driving frequencies.

If the viscosity of discharging liquid is defined as 20 cp or less in particular, it is possible to reduce this mixture (to 5% or less) when the viscosity is made smaller.

Subsequently, in conjunction with the accompanying drawings, the relationship between the arrangements of heat generating elements and the movable members on this head will be described. However, the configurations and dimensions of the movable members and heat generating elements are not necessarily limited to those given below. Here, it is possible to effectively utilize pressure exerted by the heat generating elements for discharging pressure at the time of foaming.

Figure 16:
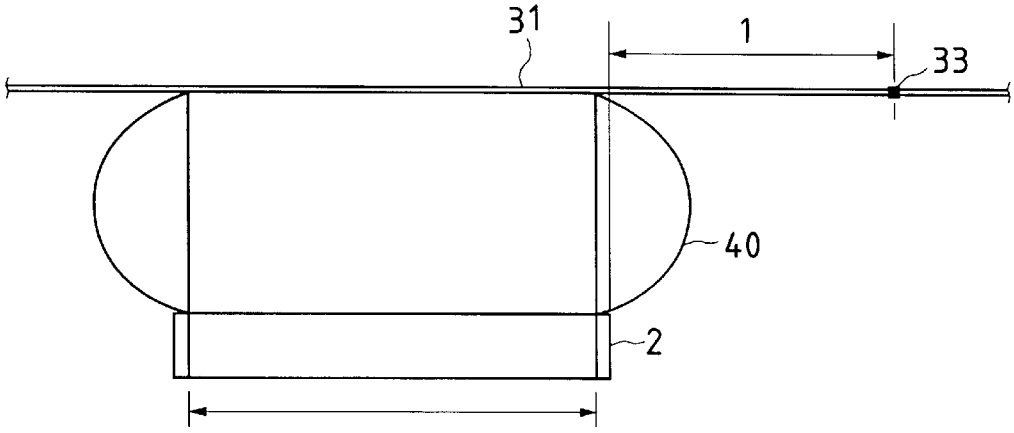
FIG. 16 is a view which illustrates the relationship of the arrangement between a heat generating element and a movable member.

For the conventional technique used for the ink jet recording method, that is, the so-called bubble jet recording method in which with the provision of energy such as heat for ink, ink is caused to change its states abruptly accompanied by its voluminal change (the creation of air bubble), and by means of active force resulting from the changes of states, ink is discharged from each of the discharge ports, thus allowing such ink to adhere to a recording medium for the formation of images, the area of a heat generating area and the discharge amount of ink are proportionally related as shown in FIG. 16. However, it is clear that there exists the ineffective foaming area S that does not contribute to discharging ink. Also, from the burning condition on the heat generating element, such ineffective foaming area S is present on the circumference of the heat generating element. As the results of such observation, it is considered that a width of approximately 4 μm on the circumference of each heat generating area is not related to foaming.

Consequently, in order to utilize foaming pressure efficiently, it should be effective to arrange the movable member so that the movable region of the movable member can cover the foaming effective area from immediately above it, which is approximately 4 μm or more inside from the circumference of each heat generating element. For the present embodiment, the foaming effective area is defined as being inner side from the circumference of each heat generating element, but it is not necessarily limited to this definition depending on the kinds of heat generating elements and the formation methods thereof.

Figure 14A:
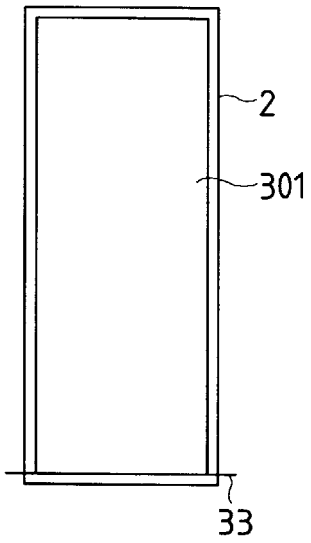
FIGS. 14A and 14B are views showing the relationship of the arrangement between a movable member and a heat generating element.
Figure 14B:
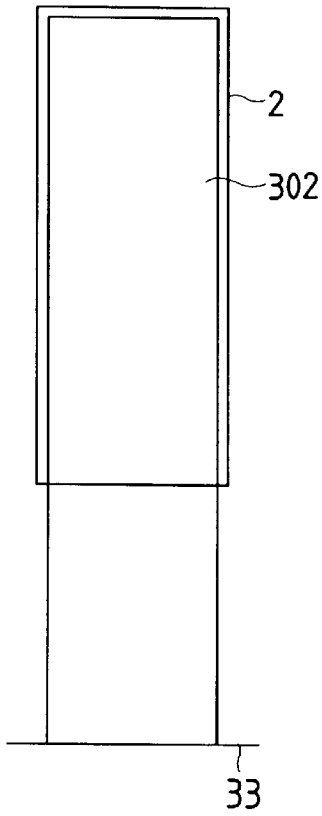

FIGS. 14A and 14B are views schematically illustrate each state where the movable members 301 and 302, having different total areas of movable range, are arranged with respect to a heat generating element 2 of 58×150 μm, respectively.

The dimension of the movable member 301 is 53×145 μm, which is smaller than the area of the heat generating element 2. However, this dimension is the same as that of the foaming effective area of the heat generating element 2. The movable member is arranged to cover the foaming effective area. On the other hand, the dimension of the movable member 302 is 53×220 μm, which is larger than the area of the heat generating element 2 (if the width dimension is made the same, the dimension between the fulcrum and the movable leading end becomes longer than that of the heat generating element). This member is also arranged to cover the foaming effective area as in the movable member 301. With respect to these two kinds of movable members 301 and 302, measurement is taken as to the durability and discharging efficiency thereof. The measuring condition is as follows:

Foaming liquid : Ethanol 40% water solution

Discharging ink : Colorant ink

Voltage : 20.2 V

Frequency : 3 kHz

The results of the experiment carried out under this condition are:

As to the durability of the movable members:

(a) The fulcrum of movable member 301 is damaged by the application of $1\times10^7$ pulses;

(b) No damages are caused on the movable member 302 even by the application of $3\times10^8$ pulses. Also, it is confirmed that the kinetic energy obtainable from the discharging amount and discharging speed with respect to the input energy is enhanced approximately 1.5 to 2.05 times.

From the results thus obtained, it is found better that the movable member is arranged to cover the foaming effective area from immediately above it, and that the area of the movable member is larger than that of the heat generating element.

Figure 15:
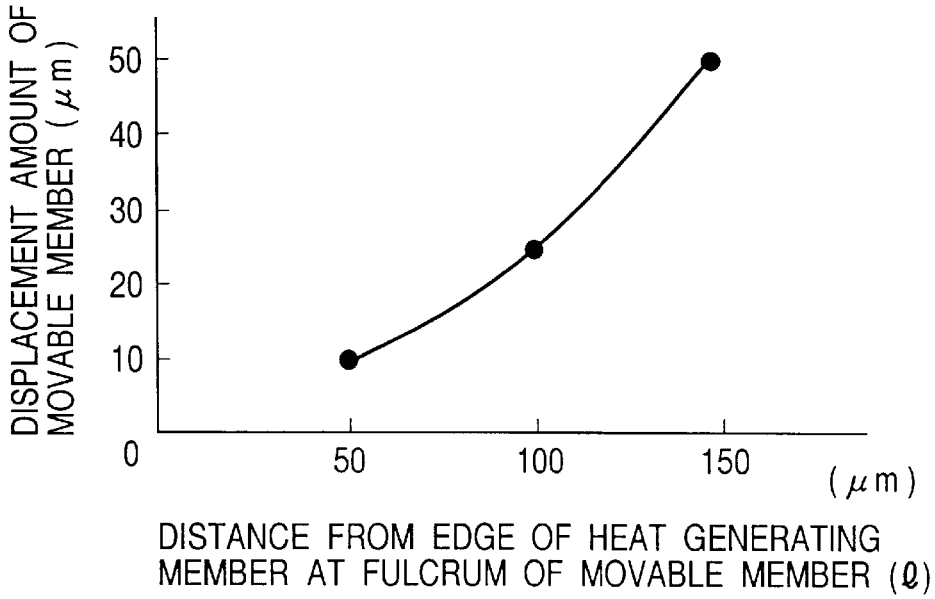
FIG. 15 is a view which shows the relationship between the edge of a heat generating element, the distance to the fulcrum, and the amount of displacement of a movable member.

FIG. 15 is a view which shows the relationship between the distance from the edge of a heat generating element to the fulcrum of a movable member and the discharging amount of the movable member. Also, FIG. 16 is a sectionally structural view which shows the positional relationship between the heat generating element 2 and the movable member 31, which is observed in the direction for the side face. The heat generating element 2 used here is 40×105 μm. It is understandable that the greater the distance from the edge of a heat generating element 2 to the fulcrum 33 of a movable member, the larger is the discharging amount. Therefore, it is desirable to determine the position of the fulcrum of the movable member after obtaining an optimal amount of displacement thereof depending on the required amount of ink discharge, the structure of flow path for the discharging liquid, and the configuration of the heat generating element.

Also, if the fulcrum of the movable member is positioned immediately above the foaming effective area of the heat generating element, the durability of the movable member is lowered due to foaming pressure exerted directly on the fulcrum, in addition to the stress caused by the displacement of the movable member. In accordance with the experiments conducted by the invention hereof, the movable wall is damaged by the application of $1\times10^6$ pulses when the fulcrum is placed just above the foaming effective area, and it is clear that the durability is lowered. Therefore, the probability of the practical use of a movable member is improved by placing its fulcrum in a position other than immediately above the foaming effective area of the heat generating element even if the configuration and material of the movable member do not present a remarkably high durability. However, if only the configuration and material are selected, it is possible to use a movable member in good condition even when the fulcrum thereof is positioned immediately above the foaming effective area. With the structure thus arranged, it is possible to obtain an excellent liquid jet head in its high discharging efficiency and durability.

(Elemental Substrate)

Now, the description will be made of the structure of an elemental substrate having heat generating elements arranged therefor to give heat to liquid as given below.

Figure 17A:
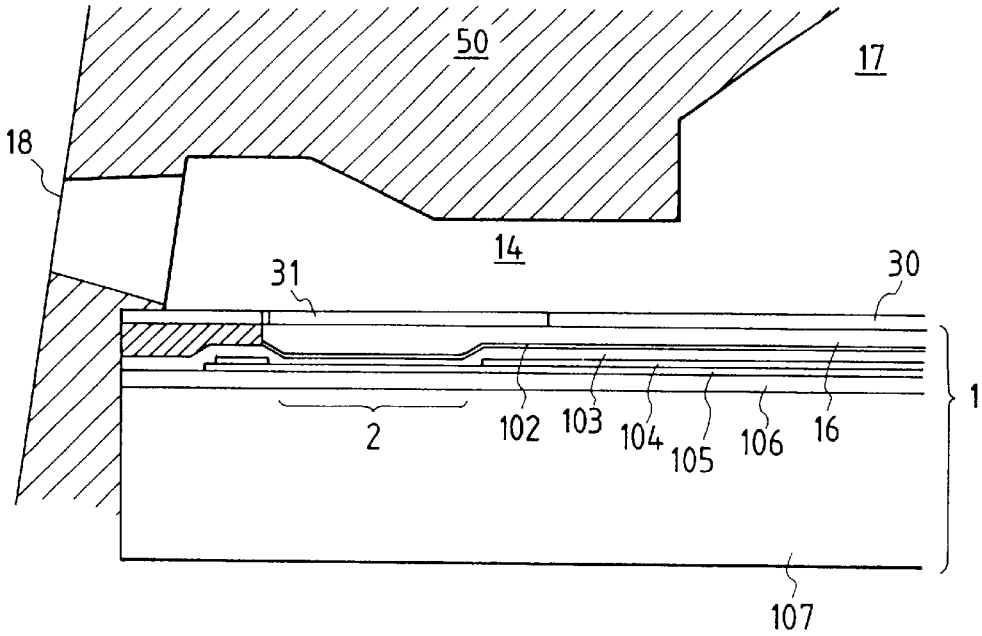
FIGS. 17A and 17B are vertically sectional views showing the liquid jet head of the present invention.
Figure 17B:
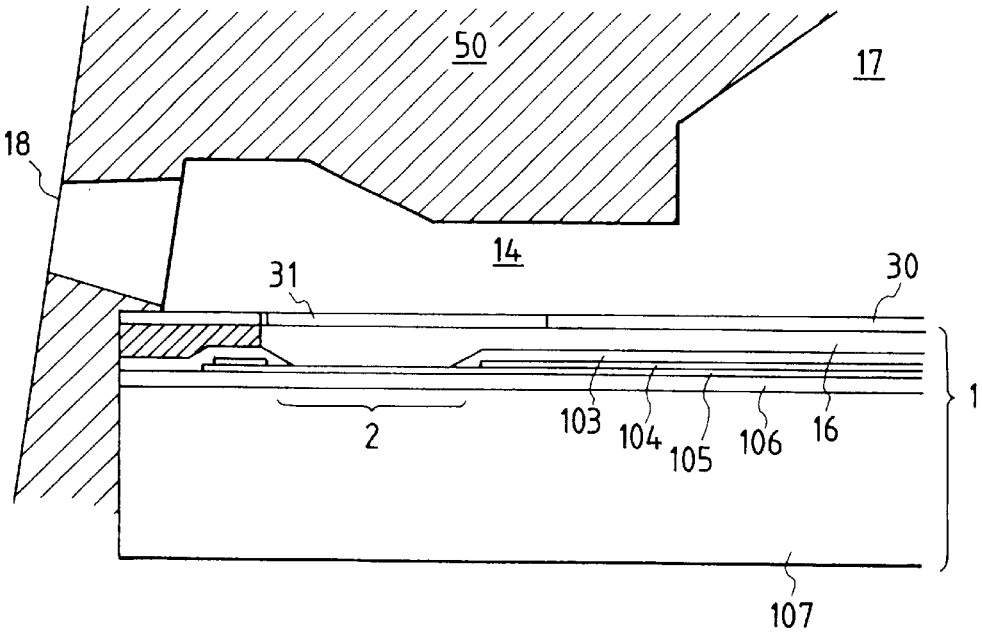

FIGS. 17A and 17B are vertically sectional views of liquid jet heads of the present invention; FIG. 17A shows a head having a protection film to be described later; and FIG. 17B shows a head having no protection film.

On the elemental substrate, a grooved member 50 is arranged. The grooves thereof constitute the second liquid flow path 16, separation wall 30, first liquid flow path 14, and first liquid flow path.

For the elemental substrate 1, silicon oxide or silicon nitride film 106 is formed on a substrate 107 of silicon or the like for the purpose of insulation and heat accumulation, and on it, hafnium boride ($HfB_2$), tantalum nitride (TaN), tantalum aluminum (TaA1) or other electric resistance layer 105 (0.01 to 0.2 μm thick) aluminum wire electrodes (0.2 to 1.0 μm thick) or the like, are laminated and patterned as shown in FIGS. 11A to 11C. Voltage is applied to the resistance layer 105 from two wire electrodes 104 to cause current to ran on the resistance layer, thus generating heat. On the resistance layer across wire electrodes, a protection layer of silicon oxide or silicon nitride is formed in a thickness of 0.12 to 2.0 μm. Further, on it, an anti-cavitation layer of tantalum or the like is filmed (in a thickness of 0.1 to 0.6 μm). In this way, the resistance layer 105 is protected from ink or various other liquids.

Particularly, since the pressure and shock waves generated by the creation of air bubbles, and defoaming are extremely strong, the durability of the rigid and brittle oxide film is reduced significantly. Therefore, the tantalum (Ta) or other metal is used as the anti-cavitation layer.

Also, it may be possible to arrange a structure that does not require the protection layer described above by means of the combination of liquid, the structure of liquid flow path, and resistive material. FIG. 17B shows the example thereof. As the material for the resistance layer that does not require such protection layer, an alloy of iridium-tantalum-aluminum or the like may be cited.

Then, for the structure of heat generating elements adopted for each of the embodiments described above, it may be possible to provide only resistance layer (heat generating layer) between the electrodes or to include the protection layer to protect the resistance layer.

For the present embodiment, heat generating elements are used, each having heat generating unit structured by resistance layer generating heat in response to electric signals. However, the present invention is not limited to the use of such heat generating elements. It should be good enough if only each of the heat generating elements is capable of creating air bubbles in liquid sufficiently so as to enable liquid to be discharged. For example, the optothermal transducing elements whose heat generating unit generates heat when receiving layer beam or other light or some other heat generating elements provided with heat generating unit that generates heat when receiving high frequency.

Here, for the elemental substrate 1 described above, it may be possible to incorporate transistors, diodes, lathes, shift registers and other functional elements integrally in the semiconductor manufacturing process besides the resistance layer 105 constituting the heat generating unit and the electrothermal transducing elements structured by the wire electrodes that supply electric signals to the resistance layer.

Also, in order to drive each heat generating unit of the electrothermal transducing elements arranged for the elemental substrate described above for discharging liquid, rectangular pulses are applied to the resistance layer 105 through the wire electrodes 104, thus causing the resistance layer between the wire electrodes to generate heat abruptly. For each head of the previous embodiments, electric signals are applied at 6 kHz to drive each of the heat generating element at the voltage of 24 V, with pulse width of 7 $\mu$sec, and current of 150 mA. With such operation, ink liquid is discharged from each of the discharge ports. However, the condition of the driving signals is not necessarily limited to the one described above. It should be good enough if only driving signals are such as to enable foaming liquid to foam appropriately.

(Structure of Head Having Two-Flow Path Structure)

Now, the description will be made of the structural example of a liquid jet head as given below, for which different liquids can be supplied to the first and second common liquid chambers separately in good condition, and the reduction of part numbers can be attempted for the implementation of cost reduction.

Figure 18:
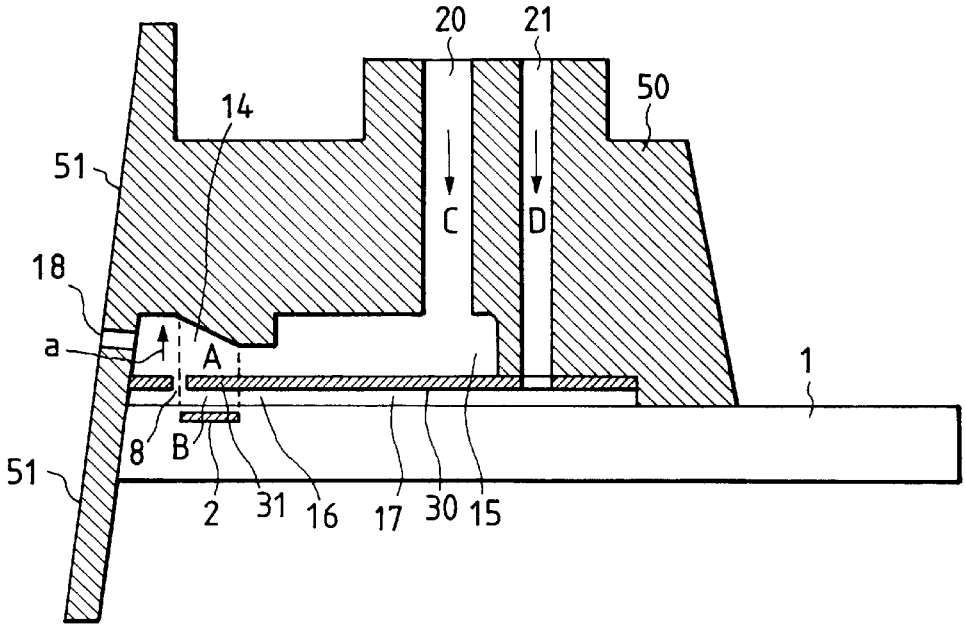
FIG. 18 is a cross-sectional view which illustrates the supply path of the liquid jet head of the present invention.
Figure 19:
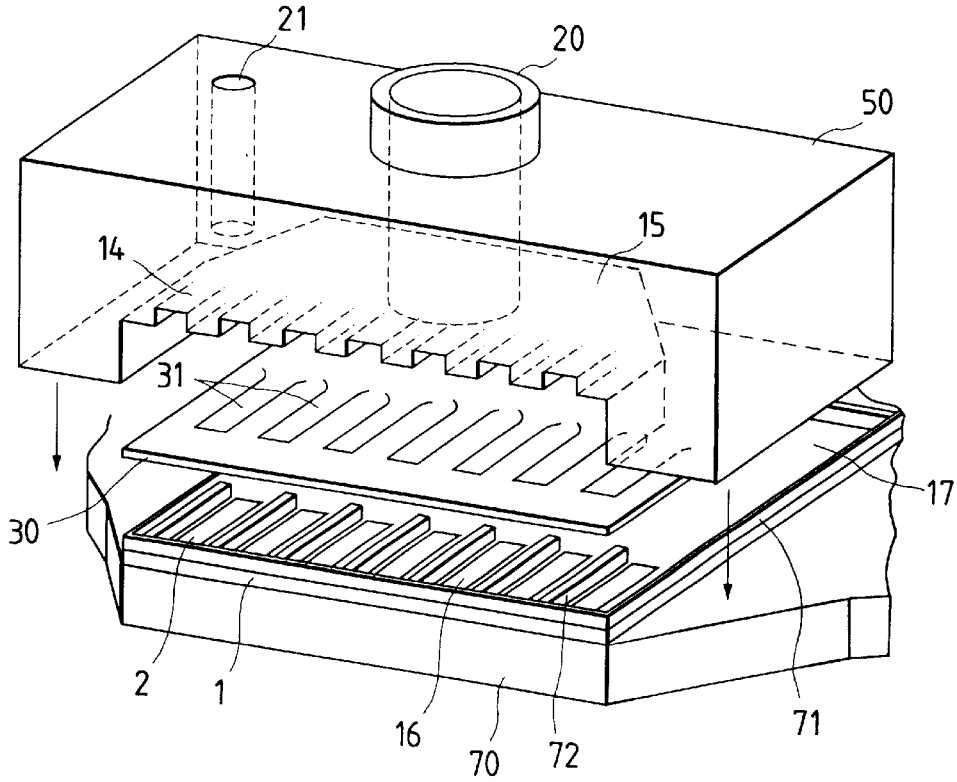
FIG. 19 is an exploded perspective view which shows the head of the present invention.

FIG. 18 is a view which schematically shows the structure of a liquid jet head of the kind. Here, the same reference marks are used for the same constituents as in the previous embodiment, and the detailed description thereof will be omitted.

For the present embodiment, the grooved member 50 comprises an orifice plate 51 having discharging ports; a plurality of grooves constituting a plurality of first liquid flow paths 14; and a recessed portion to form a first common liquid chamber 15 to supply liquid (discharging liquid) to each of the first liquid flow paths 14, thus presenting the outline of the structure thereof.

A separation wall 30 is bonded to the lower side portion of the grooved member 50 to form a plurality of first liquid flow paths 14. The grooved member 50 is provided with the first liquid supply path 20 that reaches the interior of the first common liquid chamber 15 from the upper part of the grooved member. Also, the grooved member 50 is provided with the second liquid supply path 21 that reaches the interior of a second common liquid chamber from the upper part of the grooved member through the separation wall 30.

The first liquid (discharging liquid) is supplied to the first common liquid chamber 15 through the first liquid supply path 20 as indicated by an arrow C in FIG. 18, and then, supplied to the first liquid flow path 14. The second liquid (foaming liquid) is supplied to the second common liquid chamber 17 through the second liquid supply path 21 as indicated by an arrow D in FIG. 18, and then, supplied to the second liquid flow path 16.

For the present embodiment, the second liquid supply path 21 is arranged in parallel with the first liquid supply path 20, but the arrangement is not necessarily limited to this structure. The arrangement can be made in any way if only the second liquid supply path is conductively connected with the second common liquid chamber 17 through the separation wall 30 arranged on the outer side of the first common liquid chamber 15.

Also, the thickness (diameter) of the second liquid supply path 21 may be determined in consideration of the supply amount of the second liquid. There is no need for the second liquid supply path 21 to be configured in circle. It may be configured in rectangle or the like. Also, the second common liquid chamber 17 may be formed by partitioning the grooved member 50 by means of the separation wall 30.

For the method of fabrication assembling, the frame of the common liquid chamber and the wall of the second liquid flow path are formed by dry film on the elemental substrate, and then, the second common liquid chamber 17 and the second liquid flow path 16 may be formed by bonding the elemental substrate 1 and the bonded element of the grooved member 50 and the separation wall 30 fixed to the grooved member.

For the present embodiment, the elemental substrate 1, having a plurality of electrothermal transducing elements arranged therefor as heat generating elements to generate heat for the creation of air bubbles exerted by film boiling in foaming liquid, is arranged on a supporting element 70 formed by aluminum or the other metal.

On the elemental substrate 1, there are arranged a plurality of grooves to constitute the liquid flow path 16 formed by the wall of the second liquid flow path, a recessed portion to constitute the second common liquid chamber (common foaming liquid chamber) 17 conductively connected with a plurality of foaming liquid flow paths to supply foaming liquid to each of the foaming liquid paths, and the separation wall 30 having the movable wall 31 described earlier.

A reference numeral 50 designates the grooved member. This grooved member is provided with a groove to constitute the discharge liquid flow path (first liquid flow path) 14 when being bonded to the separation wall 30; a recessed portion to constitute the first common liquid chamber (common discharging liquid chamber) 15 to supply discharging liquid to each of the discharging liquid flow paths; the first supply path (discharging liquid supply path) 20 to supply discharging liquid to the first common liquid chamber; and the second supply path (foaming liquid supply path) 21 to supply foaming liquid to the second common liquid chamber 17. The second common liquid chamber 21 is connected to the communication path conductively connected with the second common liquid chamber 17 through the separation wall 30 arranged on the outer side of the first common liquid chamber 15. By means of this communication path, foaming liquid is supplied to the second common liquid chamber 15 without any mixture with discharging liquid.

In this respect, the positional relationship between the elemental substrate 1, separation wall 30, and grooved ceiling plate 50 is such that the movable member 31 can be arranged corresponding to the heat generating elements on the elemental substrate 1, and that the discharging liquid flow paths 14 are arranged corresponding to the movable member 31. Also, for the present embodiment, an example is shown in which one second supply path is arranged for the grooved member, but depending on the amount of supply, a plurality thereof may be arranged therefor. Further, the sectional areas for flow paths of the discharging liquid supply path 20 and foaming liquid supply path 21 may be determined in proportion to the respective supply amounts.

Here, by optimizing the sectional areas of such flow paths, it becomes possible to make the components that constitute the grooved member smaller.

In accordance with the present embodiment described above, it is possible to reduce the numbers of parts by arranging the grooved ceiling plate to function as one and the same member for the second liquid supply path to supply second liquid to the second flow path and the first liquid supply path to supply first liquid to the first liquid flow path, and curtail the number of processes, hence attaining the reduction of costs.

Also, since the structure is arranged so that the supply of second liquid to the second common liquid chamber conductively connected with the second liquid flow path is performed by means of the second liquid flow path in the direction penetrating the separation wall that separate the first liquid and the second liquid, it is possible to bond the separation, grooved member, and heat generating element formation substrate together only one-time process. Therefore, the fabrication is made easier with the enhancement of bonding precision, leading to discharging liquid in good condition.

(Method for Manufacturing Liquid Jet Head)

Now, the description will be made of the manufacturing process of a liquid jet head in accordance with the present invention.

For the liquid jet head shown in FIG. 2, bases 34 are formed by patterning the dry film or the like for the provision of the movable member 31 on the elemental substrate 1, and the movable member 31 is bonded on the bases 34 or fixed by welding. Then, a grooved member having a plurality of grooves to constitute each of the liquid flow paths 10, discharge ports 18, and common liquid chamber 13 is bonded to the elemental substrate 1 in a state that the grooves and the movable member correspond to each other. For the manufacturing process if the liquid jet head having the two-flow path structure as shown in FIG. 7 and FIGS. 9A and 9B, the wall of the second liquid flow path 16 is formed on the elemental substrate 1, and the separation wall 30 is fixed on it. Further on it, the grooved member, having the groove to constitute the first liquid flow path, and others arranged thereon, is fixed. Or after the wall of the second liquid flow path 16 is formed, a grooved member 50, having a separation wall 30 is fixed in advance, is bonded on this wall.

For a head manufacturing process of the kind, the handling of the separation wall is particularly important. In other words, since this separation wall is extremely thin and formed precisely, it is necessary to position the separation wall accurately without damaging its function. Therefore, in accordance with the present invention, when the elemental substrate and the grooved member are positioned by shifting them relatively so that the grooves and the movable member are arranged to correspond to each other, it is practiced to avoid the protrusion of the movable member to the bonding side so as not to damage the movable member formed on the separation wall. Also, the present invention teaches a method for positioning the separation wall in a desired location accurately. Further, it teaches a method for fixing the separation wall easily, while keeping its positioned state in good condition when fixing the separation wall.

(Embodiment 1)

Figure 23A:
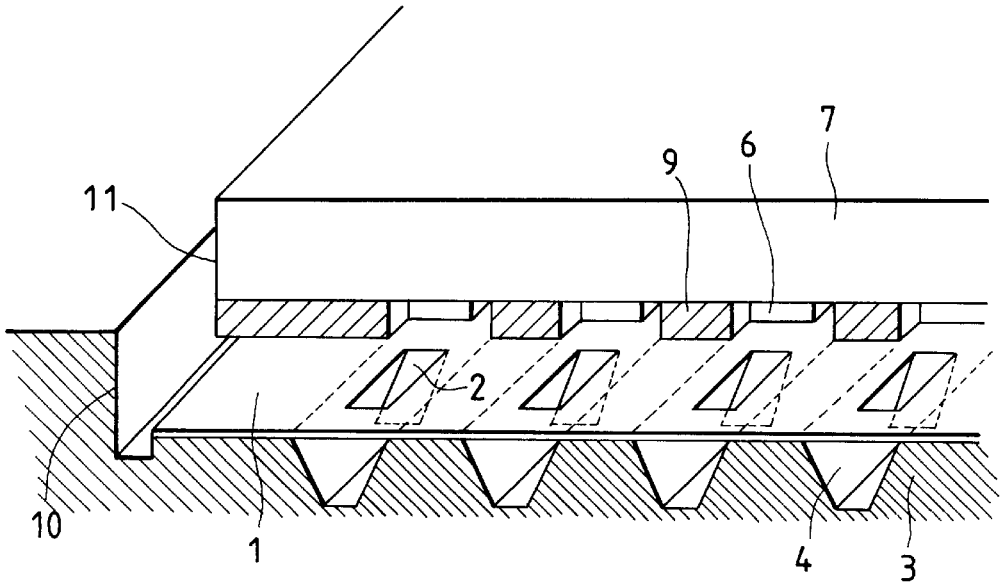
FIGS. 23A and 23B are views schematically showing the state of a ceiling plate and a heater board being bonded in accordance with the present invention.
Figure 23B:
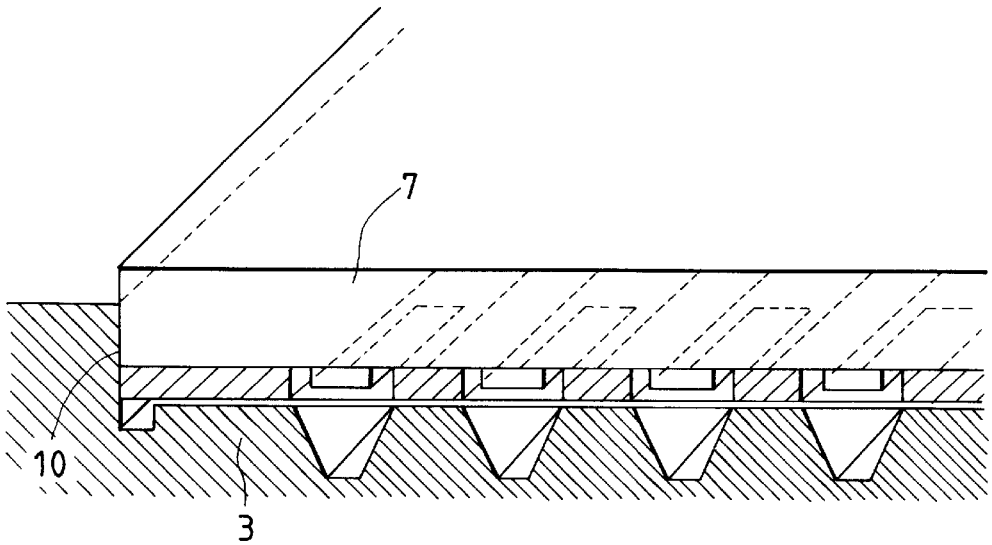

FIGS. 23A and 23B are views which schematically illustrate the state where each of the valves is displaced to the groove side from the contact surface between the ceiling plate and thin film, and then, the ceiling plate with valves and the heater board are bonded. FIG. 23A schematically shows the state before the ceiling plate with valves and the heater board are bonded; FIG. 23B schematically shows the state after the ceiling plate and heater board are bonded.

In FIGS. 23A and 23B, a reference numeral 7 designates the heater board. For the heater board 7, heaters 6 and the dry film 9 for the formation of the wall of the second liquid flow path are provided in advance. On the other hand, a reference numeral 3 designates the ceiling plate. For the ceiling plate 3, grooves 4 are formed by means of molding or the like to constitute the first liquid flow path.

For the present embodiment, the ceiling plate 3 and the think film 1 that provides the separation wall are positioned at first, and then, bonded. For the separation wall the movable member 2 are provided, and the positioning is performed so as to arrange each movable member 2 to correspond to each of the grooves 4 provided for the ceiling plate 3.

Subsequently, the heater board 7 is bonded to the bonded element of the ceiling plate 3 and the separation wall 1. The heater board 7 is caused to shift while in contact with the separation wall for positioning when the heater board 7 is bonded to the separation wall 1. However, if any one of the movable member 2 provided for the separation wall 1 should be protruded upward from the separation wall, there is a possibility that the movable member is deformed or damaged by the heater board 7. Therefore, in accordance with the present embodiment, the movable members (valves) 2 are displaced to the groove 4 side from the contact surface of the separation wall 1 at first. Then, the reference surface of the ceiling plate 113 is caused to abut upon the cutting surface 112 so that the ceiling plate 113 and the heater board 117 are bonded while the positions thereof are being adjusted. In this respect, a reference numeral 10 designates the reference surface of the ceiling plate, and 11, the cutting surface of the heater board.

For the present embodiment, vacuum suction is used as a method for displacing each of the movable members to the groove side.

Figure 20:
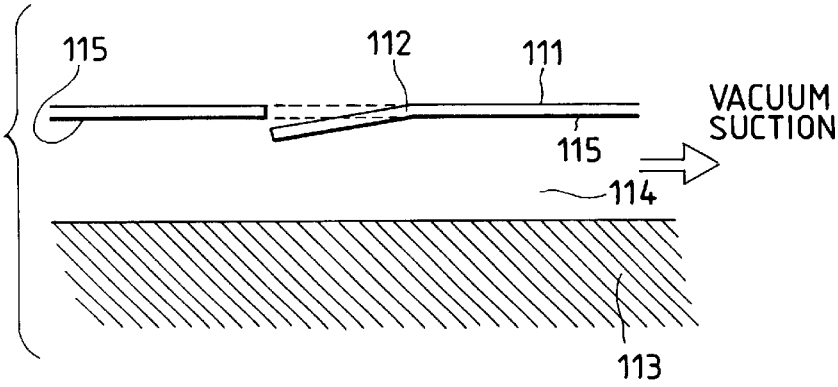
FIG. 20 is a view which schematically shows the state of a valve being displaced by the application of vacuum suction force in accordance with the present invention.

FIG. 20 is a view which schematically shows the distinctive features of the present embodiment in the best way.

A reference numeral 111 designates the thin film; 112, a valve (movable member); 113 the ceiling plate (grooved member); 114 a groove; and 115, the contact surface of the ceiling plate and the thin film.

When the ceiling plate and the elemental substrate (not shown) are positioned while shifting them relatively, vacuum suction is conducted from the ink supply port of the ceiling plate 113. By means of such suction force, the valves 112 are slightly displaced to the groove 114 side from the contact surface of the ceiling plate 113 and the thin film 111.

The thin film having the valves is 3 $\mu$m to 20 $\mu$m, while the vacuum suction force is −500 mmHg to −700 mmHg. For the present embodiment, the thin film is 3 $\mu$m, and the vacuum force applied is −670 mmHg. In this case, the displacement amount of the valves is 30 to 40 $\mu$m in the groove direction.

When the valves are displaced as described above, it is possible to secure the bonding state of each members easily in good condition without causing any deformation or damage to the valves.

After that, these bonding elements are fixed by fixing means such as spring, and with the installation of chip tank and others, a liquid jet heat is obtained.

(Embodiment 2)

In accordance with the present embodiment, a method is shown for displacing the valves by means of magnetic force. Here, in this case, the material of the thin film having the valves is selected from among metallic ones. Also, with the exception of the method for displacing valves, it is possible to obtain a liquid jet head as in the embodiment 1.

Figure 21:
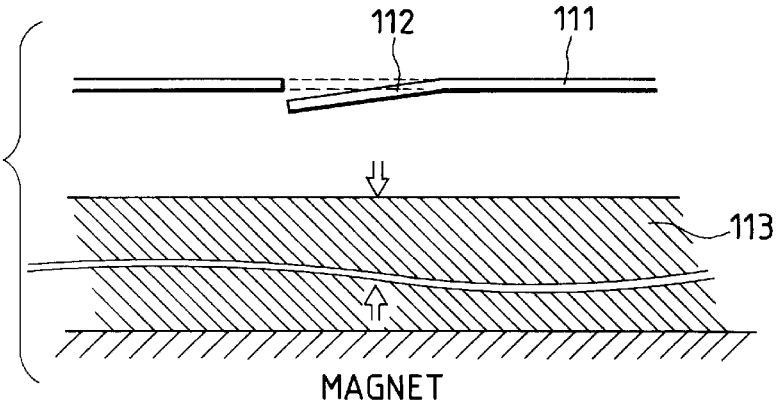
FIG. 21 is a view which schematically shows the state of a valve being displaced by means of magnetic force in accordance with the present invention.

FIG. 21 is a view which schematically shows distinctive features of the present embodiment in the best way.

For the present embodiment, the ceiling plate 113 having the separation wall being arranged therefor is fixed to a electromagnet, a permanent magnet, or some other magnetic body, and then, by means of magnetic attraction, the metallic valves are slightly displaced to the groove 11 side. In this respect, after bonding the ceiling plate and the heater board (elemental substrate) which is not shown, the bonded element is demounted from the magnetic body, and magnetism is removed from the thin film.

(Embodiment 3)

The present embodiment is also a method for displacing the valves by means of magnetic force as in the embodiment 2. Here, however, the embodiment is a method for displacing them by means of magnetism provided for them, and the utilization of its force of repulsion. Also, with the exception of the method for displacing the valves, it is possible to obtain a liquid jet head as in the embodiment 1.

Figure 22:
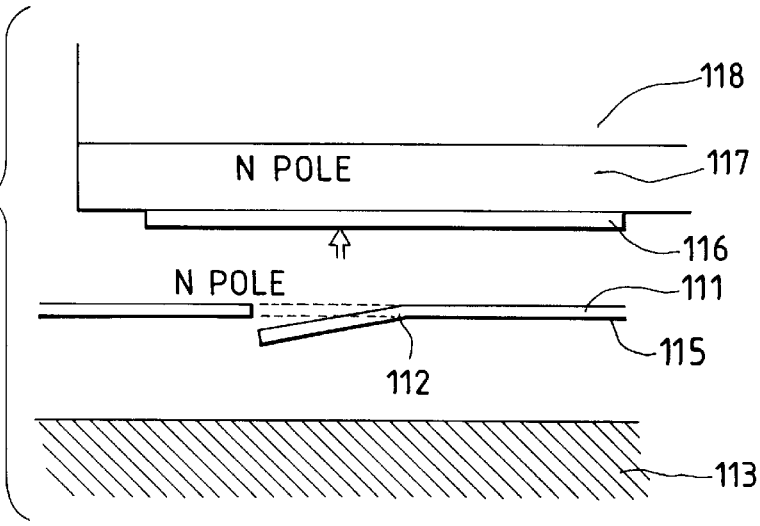
FIG. 22 is a view which schematically shows the state of a valve being displaced by means of magnetic force in accordance with the present invention.

FIG. 22 is a view which schematically shows the distinctive features of the present embodiment in the best way.

The material of the thin film having the valves 2 is also selected from among the metallic ones as in the embodiment 2. A reference numeral 116 designates a heater; 117, a heater board, 118, an auxiliary member for the heater board, which is formed by magnetic material.

At first, magnetism of the same pole is applied to the upper face of the thin film 1, heater board 117 and heater board auxiliary member 118. Then, force of repulsion takes place between the ceiling plate and heater board to enable the valves 112 to be displaced from the contact surface of the ceiling plate and thin film to the groove side slightly.

In this respect, after the ceiling plate having the valves, and the heater board are bonded together, magnetism is removed from the thin plate and heater board auxiliary member.

(Embodiment 4)

As a method for arranging valves (movable members) to face a member having recessed portions (grooves) in a state of the valves being displaced, there is the one in which the valves are in contact with the grooved member unlike those embodiments in which the valves are not in contact with the grooved member. For example, a method is cited, in which using the surface of fine balls (each having a diameter of approximately 40 $\mu$m to 80 $\mu$m) corresponding to each of the movable members to displace it slightly. The method of manufacture in accordance with the present invention is such that each movable member is caused to face each of the recessed portions while being kept in the state of being displaced, thus making it possible to displace the movable member reliably.

(Embodiment 5)

The embodiments 1 to 4 are the methods whereby to bond the thin film material having movable members that have been bonded to another member (such as a ceiling plate or an elemental substrate). In the process where the thin film material is bonded to the members other than such member, it is necessary to position the thin film material in good precision. Therefore, in such case, it is desirable to place the thin film material directly and closely in contact with the elemental substrate or the ceiling plate. However, if the thin film material should shift to the next process in this state, which means the thin film material is not reliably held on the desired position of the elemental substrate or the ceiling plate, a tact or another is needed in the carrying process of the elemental substrate or the ceiling plate. This additional operation hinders the intended enhancement of the production yield of liquid jet heads.

Therefore, the present embodiment is designed to provide a method for manufacturing a liquid jet head capable of provisionally fix the thin film material by the application of the liquid which does not exert any influence to ink in order to obtain an excellent production yield.

Figure 29:
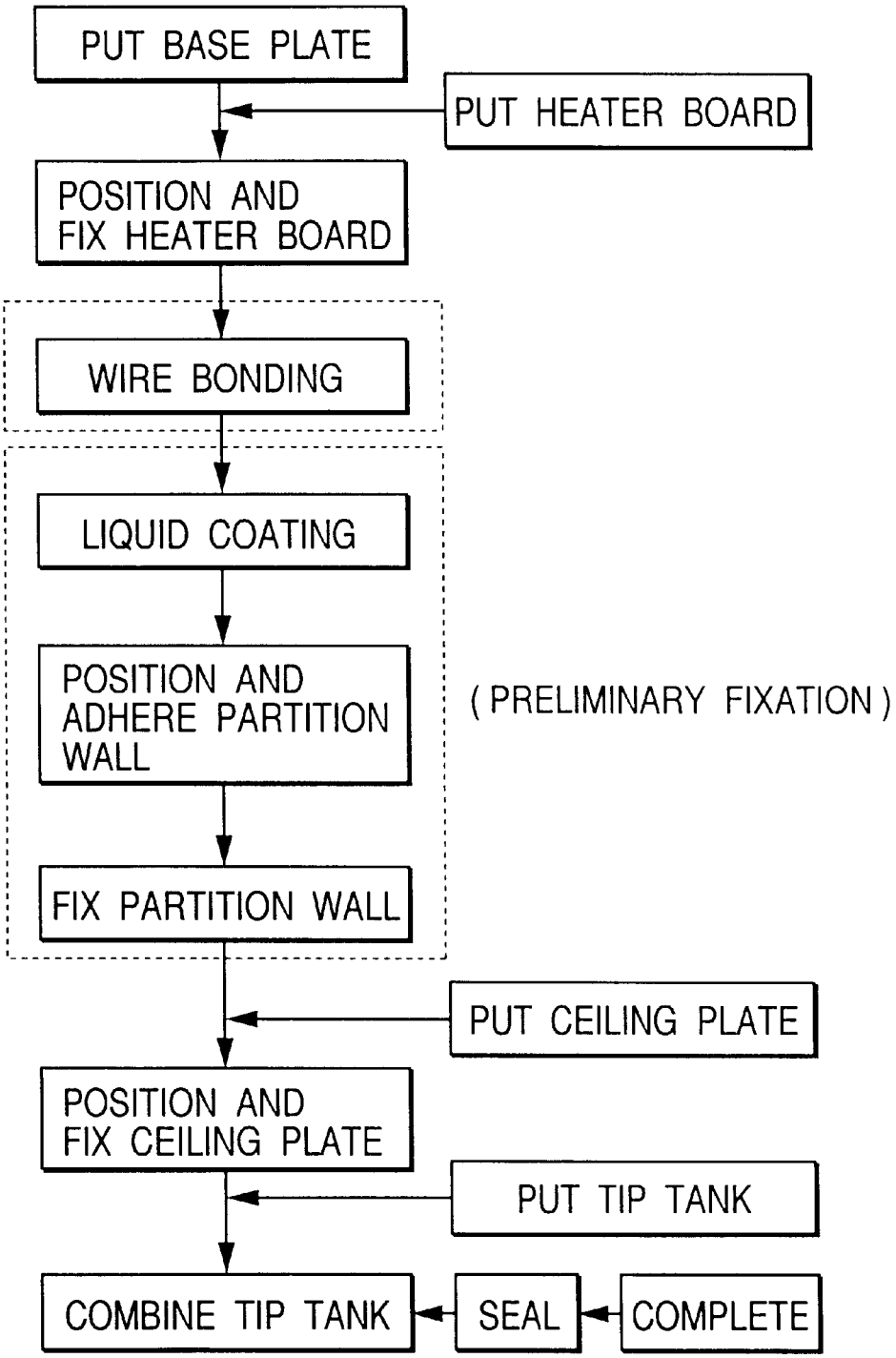
FIG. 29 is a flowchart which shows a method for manufacturing a liquid jet head in accordance with the present invention.

FIG. 29 is a flowchart which shows the method of manufacture in accordance with the present embodiment. As shown in FIG. 29, a base plate 70, serving as the supporting element, is put in a manufacturing system at first, which is set at a given position, that is installed.

Then, an elemental substrate having heat generating elements are integrally formed therefor, that is, a heater board 1, is put in the manufacturing system. After that, the heater board 1 shifts on the base plate 70, and then, positioned with respect to the base plate 70 and bonded to the base plate 70 by bonding agent or other fixing means. When the heater board 1 is thus fixed to a desired position on the base plate 70, the contact pad of the heater board is wire bonded to the printed-circuit board installed on the base plate in advance.

Thus, the electric wiring is performed as required for the heat generating elements and others on the heater board 1. It may be possible to perform this wire bonding process after those of liquid coating, bonding of the separation wall 30, and fixation of the separation wall 30 as required.

When the heater board 1 is fixed on the base plate 70, and at the same time, the wire bonding is performed therefor, the liquid that does not affect water and ink, that is liquid containing alcohol such as methanol or ethanol, is coated or applied by spraying means.

Then, in continuation of this liquid coating process, the separation wall 30 is put in the manufacturing system. The separation wall 30 is placed with respect to a desired position on the heater board 1 having the liquid thus coated or applied, and stacked thereon. In this way, by the surface tension of the liquid the separation wall 30 is held on the desired position on the heater board 1 and provisionally fixed.

Thus, when the separation wall 30 is provisionally fixed to the heater board 1, these members shift to the next state in the manufacturing system in this state. At this state, these members are bonded and fixed by means of bonding agent or bump on the circumference of the heater board 1 and separation wall 30 adhering to each other.

Then, the ceiling plate 50 is put in the manufacturing system. The ceiling plate shifts to the desired position on the separation wall 30 fixed to the heater board 1 by means of bonding agent or bump. After that, the ceiling plate 50 is fixed to the separation wall 30 by means of bonding agent or the like in a state that the ceiling plate 50 is positioned to the separation wall 30 on the desired position.

Lastly, the chip tank is put in the manufacturing system, and then, when the base plate 70, heater board 1, separation wall 30, ceiling plate 50, and the chip tank are integrally put together, sealing agent is applied to the required portions appropriately to seal them, thus completing a liquid jet head.

In this respect, the liquid used for provisional fixation of the separation wall 30 on the heater board 1 does not affect ink or other recording liquid at all, and does not present any hinderance. Usually, such liquid is exhausted outside the head by the recovery process before discharging.

Here, also, if foaming liquid is used as such liquid, it becomes possible to perform the usual discharge without exhausting this liquid.

Now, for the method of manufacture structured for the present embodiment as described above, which comprises, in particular, the steps of coating liquid, bonding the separation wall, and others, several modes of provisionally fixing the separation wall will be described.

FIG. 24 to FIG. 28 are views which schematically illustrate the first to fifth modes of provisional fixation step for a liquid jet head manufactured by the method embodying the present invention.

Figure 24:
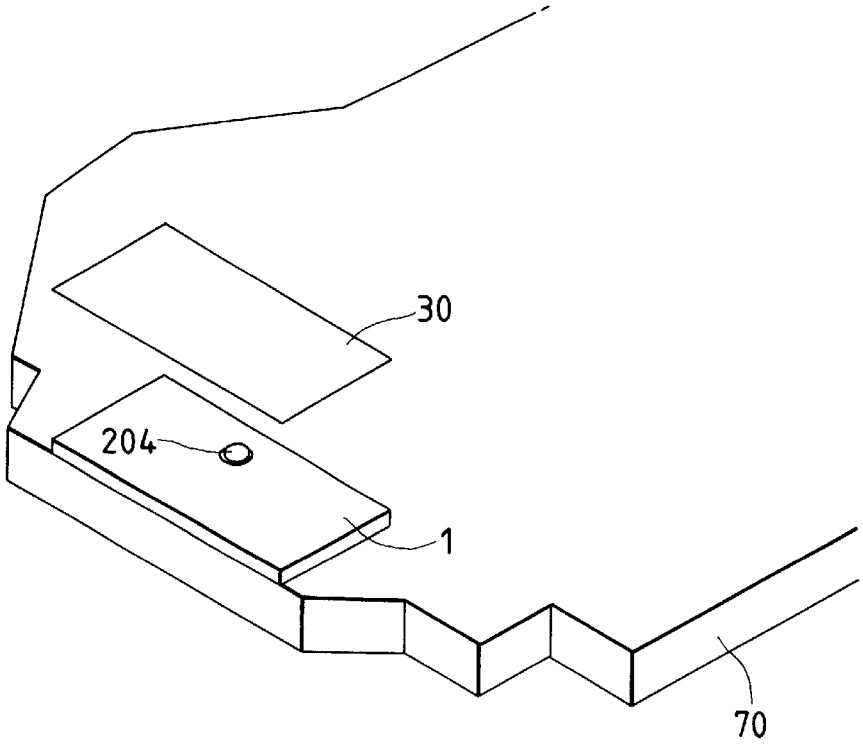
FIG. 24 is a view which schematically shows a method for manufacturing a liquid jet head in accordance a first embodiment of the present invention.

For the first mode shown in FIG. 24, the elemental substrate having heat generating elements incorporated in it or arranged integrally therefor, that is, the heater board 1 is fixed on the supporting element, that is, the base plate 70, is wire bonded with the printed-circuit board electrically in the manufacturing process of a liquid jet head in accordance with the present invention. On this heater board 1, a droplet 204 of water or some other appropriate liquid water is applied. Then, on the heater board 1 having such droplet 204 being provided thereon, the separation wall 30 is placed to be positioned and caused to adhere to each other. In this way, the separation wall 30 adheres to the heater board for the provisional fixation. Liquid like water is suitable used as the adhesive liquid for the heater board 1 and the separation wall 30. Some liquid other than water that does not affect ink may be used for the purpose. In this way, by means of the surface tension of the applied liquid, the separation wall 30 is held on the desired position on the heater board 1.

For the liquid jet head thus manufactured, if only a droplet 204 like water or some other liquid is provided for the elemental substrate having the heat generating elements are arranged, that is, on the heater board 1, and it is good enough if only the separation wall 30 is caused to adhere to it, and through the droplet 204, the separation wall 30 is pressed firmly onto the heater board 1. Then, the separation wall 30 is in closely contact with the heater board 1, thus making it possible to hold the separation wall 30 more rigidly with respect to the heater board 1. Also, only one droplet 204 is good enough as its amount to hold the separation wall 30 sufficiently with respect to the heater board 1.

Figure 25:
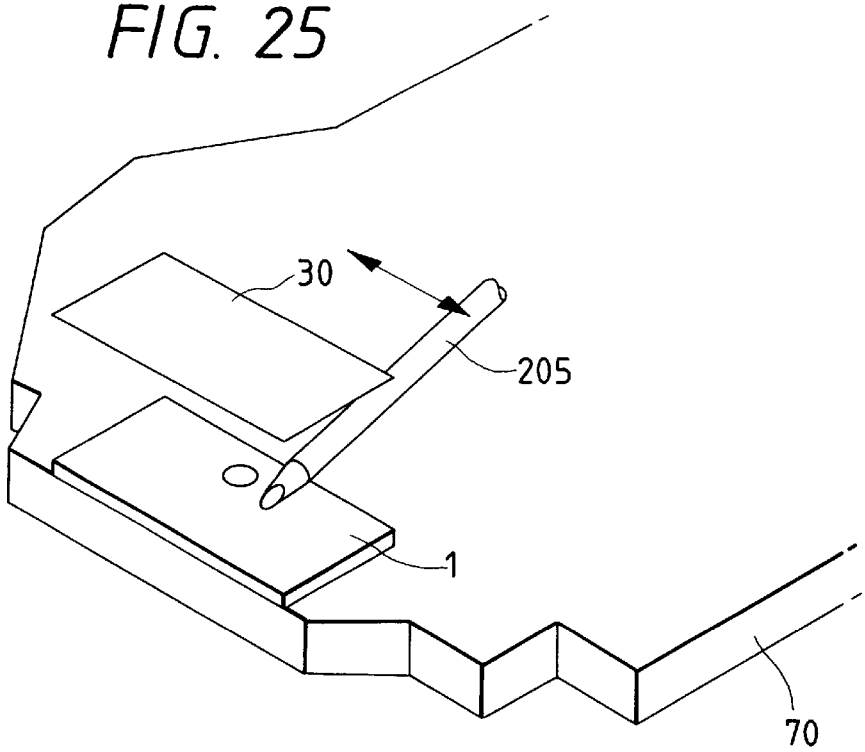
FIG. 25 is a view which schematically shows a method for manufacturing a liquid jet head in accordance a second embodiment of the present invention.

For the second mode shown in FIG. 25, the droplet 204 is also provided on the elemental substrate having heat generating elements arranged therefor, that is, on the heater board 1 as in the first mode. Then, by means of a liquid spreading jig 205, the droplet 204 applied to the heater board is caused to thinly spread. On it, the separation wall 30 is placed for positioning. Thus, the separation wall 30 adheres to the elemental substrate, that is, to the heater board 1 for the provisional fixation. For the present move, since water or some other liquid that does not affect ink, and caused to spread by means of the liquid spreading jig 205, the separation wall 30 is in contact with the liquid having comparatively wide area when it adheres to it. As a result, the separation wall is not easily movable. It is held in good condition to make its provisional fixation possible with respect to the heater board 1.

Figure 26:
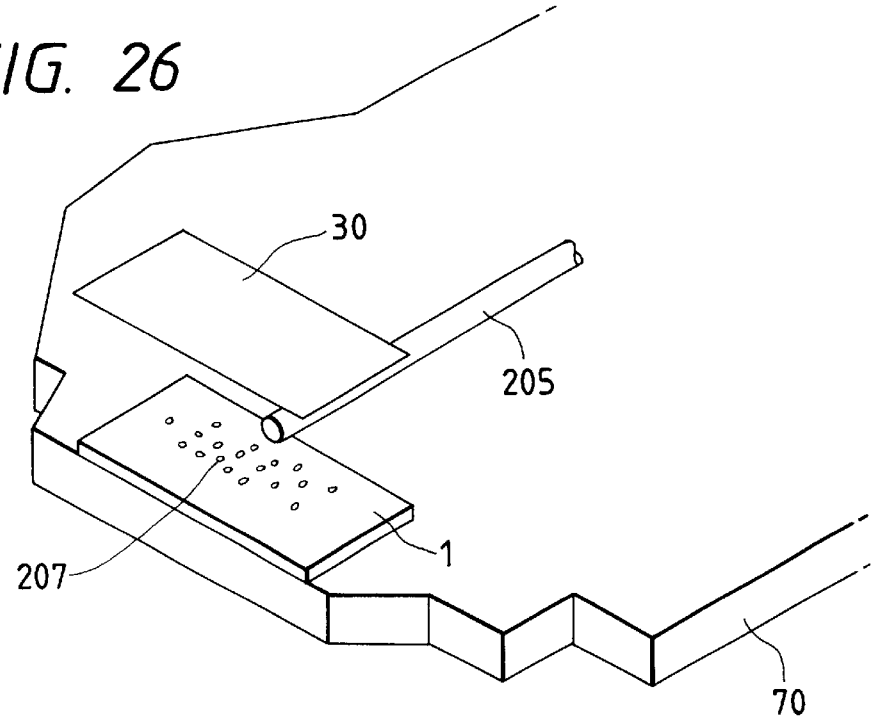
FIG. 26 is a view which schematically shows a method for manufacturing a liquid jet head in accordance a third embodiment of the present invention.

Also, the third mode is shown in FIG. 26. In accordance with this mode, liquid 207 provided on the elemental substrate having the heat generating elements arranged therefor, that is on the heater board 1, is in the form of mist. In other words, the liquid is provided as a number of fine droplets. Then, on it, the separation wall 30 is placed for adhesion. The liquid coating jig 206 that is used for coating liquid is provided with nozzle having fine holes at its leading end. From this nozzle, liquid 207 is discharged and sprayed onto the heater board 1. In this way, the liquid applied to the heater board 1 is in a form of mist on the heater board 1. As a result, the separation wall 30 is not easily movable when it is in contact with the liquid. Then, the separation wall is held suitably in good condition for its provisional fixation.

Figure 27:
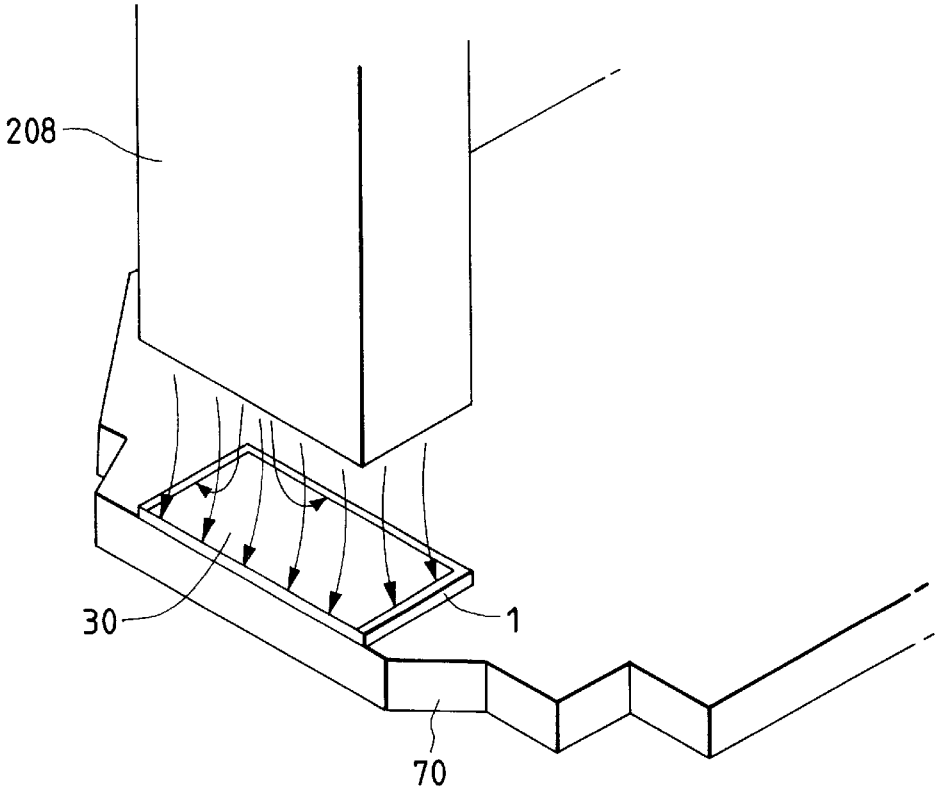
FIG. 27 is a view which schematically shows a method for manufacturing a liquid jet head in accordance a fourth embodiment of the present invention.

In accordance with the fourth mode shown in FIG. 27, liquid is applied to the elemental substrate having heat generating elements arranged therefor, that is, the heater board 1, and then, the separation wall 30 is stacked on it to be combined therewith. After that, air is blown out from the conduit 208 onto the separation wall 30 and the heater board 1. With the air being blown out from the conduit 208, the separation wall 30 is firmly pressed to be in contact with the heater board 1. In this way, the separation wall 30 is held in good condition for its provisional fixation.

Figure 28:
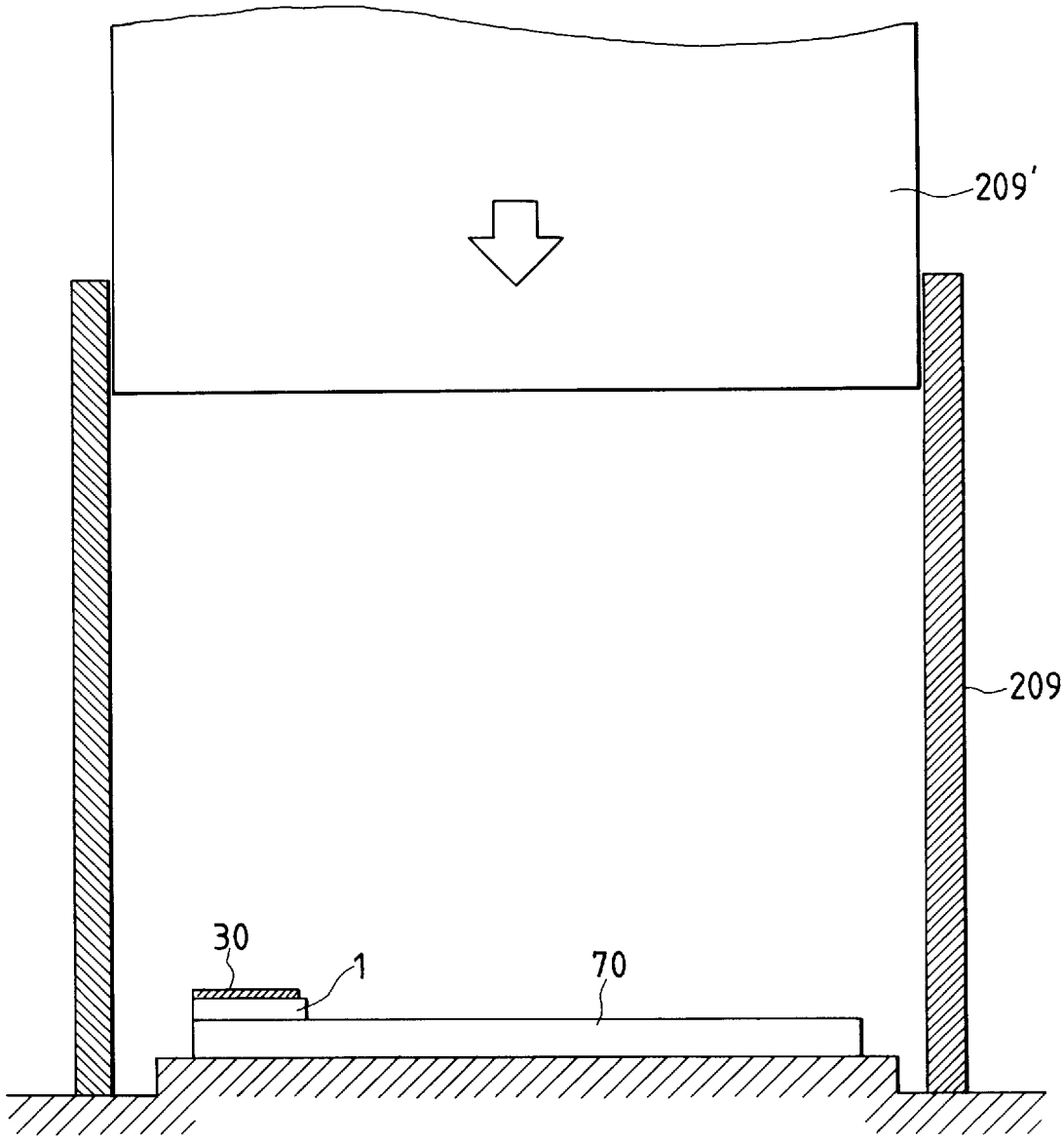
FIG. 28 is a view which schematically shows a method for manufacturing a liquid jet head in accordance a fifth embodiment of the present invention.

Furthermore, the fifth mode is shown in FIG. 28. In accordance with the mode shown in FIG. 28, liquid is applied to the elemental substrate having the heat generating elements arranged therefor, that is, to the heater board 1, and then, the separation wall 30 is stacked on it to be combined therewith. After that, a pair of a cylinder 209 and a piston 209' are arranged to surround the circumference of the heater board 1 and the separation wall 30 to airtightly close the heater board 1 and the separation wall 30. Subsequently, an external force is applied to the piston 209' to give pressure to the gas in the cylinder 209. With the pressure thus exerted in the cylinder 209, the separation wall 30 is caused to be in closely in contact with the heater board 1. In this way, the heater board 1 and the separation wall 30 are suitably fixed provisionally. For this mode, it is possible to enhance the close contact between the heater board 1 and the separation wall 30 by the combined use of the cylinder 209 and the piston 209' to provide a suitable adhesion between them.

As described above, in the process of combining the heater board 1 and the separation wall 30 by means of close adhesion between them for a liquid jet head to be manufactured in accordance with the embodiment of the present invention, liquid is applied to the heater board 1 in the form of droplet or thinly spread, or in the form of mist. After that, the separation wall 30 is combined for its provisional fixation. Further, by the application of external force such as static or dynamic air pressure to the heater and separation wall in its combined state so that heater board 1 and the separation wall 30 are kept in contact closely with each other. In this way, it is possible to enhance the close contact between the heater board 1 and the separation wall 30, thus obtaining the state of provisional fixation for both of them at lower costs without requiring any tact in this respect.

Here, the description has been made of the examples in which the separation wall is fixed to the heater board provisionally. It is of course possible to fix the separation wall with the ceiling plate provisionally in the same manner.

Also, when magnetic force is used for displacing valves as in the embodiment 2 described earlier, it is possible to provisionally fix the separation wall by use of this magnetic force. In such case, then, the provisional fixation of the separation wall is performed on a jig that generates magnetic force.

(Embodiment 6)

The present embodiment describes a method preferably applicable up to positioning the thin film material with respect to the elemental substrate or the ceiling plate.

Conventionally, when positioning the thin film material described above, it is generally practiced that the thin film material is directly positioned by use of cylinder, cam, air, or the like as reference member with force being applied to such medium. However, with such method as this, there is a fear that the thin film material is damaged.

In accordance with the present embodiment, an extremely small amount of air is supplied to the lower surface of the thin film material to form a fine air layer between the thin film material and the base, thus enabling the thin film material to shift without touching it directly. Also, by tilting this base at this juncture, the weight of the thin film material own is utilized to allow it to abut upon the abutting reference surface. In this way, it may be possible to prevent the thin film material from being bent or folded. Further, by use of a medium having micro hole diameters on the adsorbing surface thereof, it is possible to minimize the deformation of the thin film material, and to fix it reliably as well.

Figure 35A:
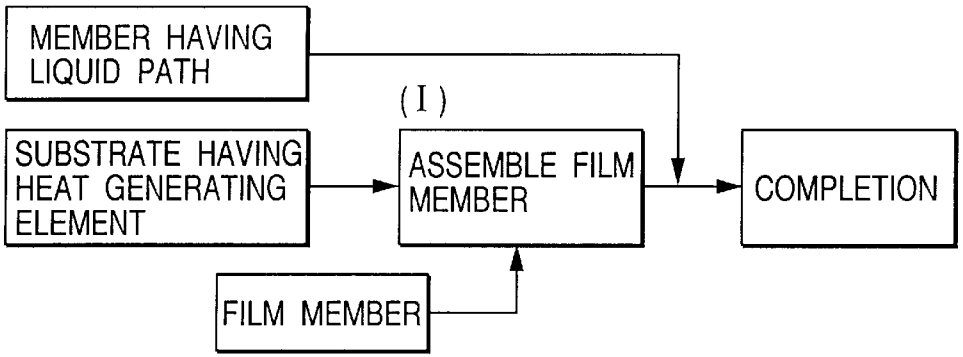
FIGS. 35A and 35B are block diagrams showing the manufacturing process of a liquid jet head.
Figure 35B:
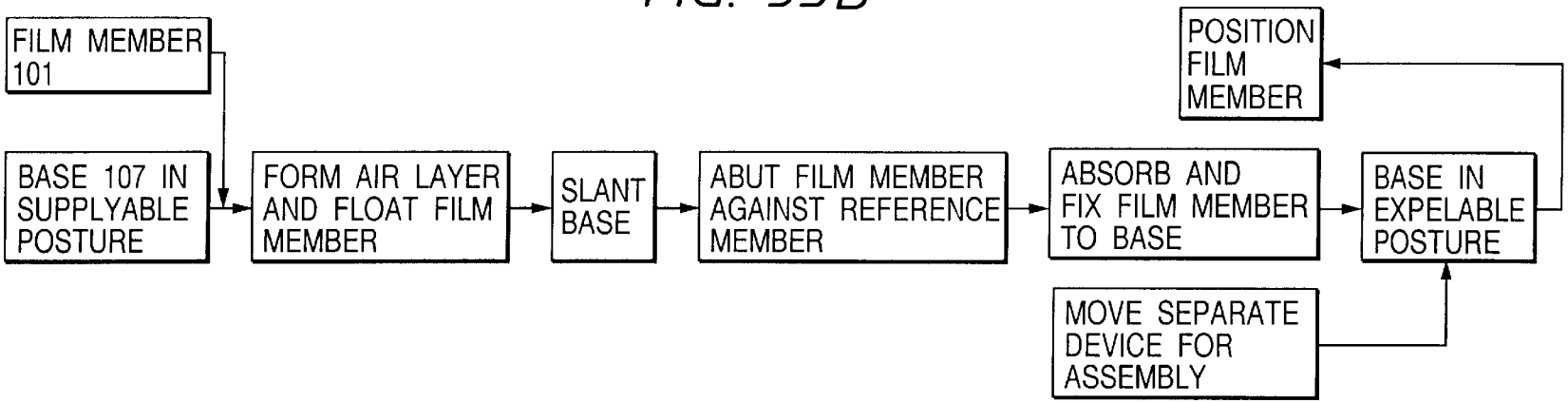

FIGS. 35A and 35B are block diagrams which illustrate the manufacturing processes of a liquid jet head in accordance with the present embodiment. FIG. 35A shows the entire process. FIG. 35B illustrates the process designated by a reference mark (I) in FIG. 35A.

In FIG. 35A, the substrate having heat generating elements arranged therefor and the thin film material are assembled. Further, on it, a member having liquid flow paths is bonded to complete the member for use of a liquid jet head.

Now, in conjunction with FIG. 35B, the description will be made of the process to assemble the thin film material with the substrate having the heat generating elements arranged therefor. By use of the base for shifting use, the thin film material 101 is caused to float, and supplied onto the base 107 for positioning use, which is postured to be able to perform supplying. On the base, an air layer is formed to enable the thin film material to float. Then, the base is tilted to allow the thin film material to abut upon the abutting reference member. After that, the thin film material is adsorbed for its provisional fixation. Then, the base is postured to be able to perform exhausting, while shifting another system for use of assembling, thus positioning the thin film material with respect to the substrate having the heat generating elements arranged therefor.

Now, the detailed description will be made of the method for positioning the thin film material with respect to the movable members, separation wall, and others described above.

Figure 30:
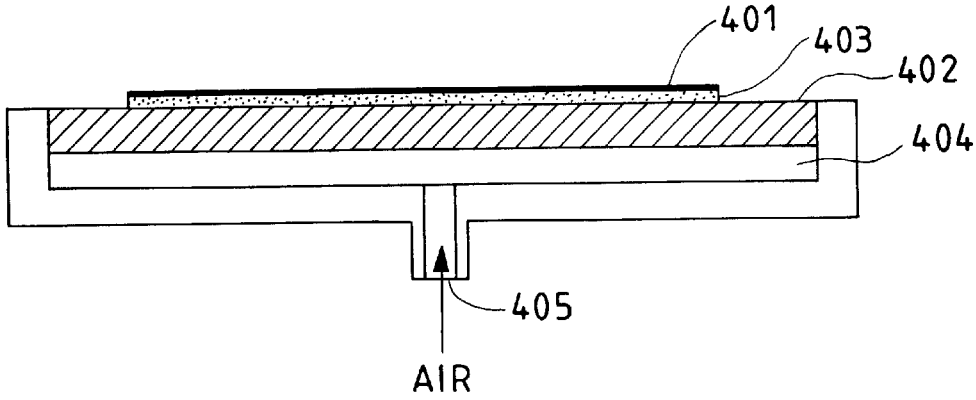
FIG. 30 is a view which schematically shows the principle with respect to the floating of a thin film material in accordance with the third embodiment.

FIG. 30 is a view which schematically illustrates the floating principle of a thin film material in accordance with the present embodiment.

In FIG. 30, a reference numeral designates a thin film material; 402, a medium having micro hole diameters; 403, a minute air layer; 404, an air pool; and 405, an air supply port. At first, the compressed air that has been adjusted by a regulator is supplied to the air pool 404 through the air supply port 405. After that, the compressed air accumulated in the air pool 404 flows to the entire reverse side of the thin film material through fine holes of the medium 402 having the micro hole diameters, thus forming a minute air layer 403 between the think film material 401 and the medium 404 having micro hole diameters. For the present embodiment, Ni plate of 3 to 50 $\mu$m and resin sheet are used as the thin film material 401. For the medium 402 having micro hole diameters, a porous element having fine diameter holes of 20 $\mu$m whose flatness is processed to 4 $\mu$m or less is used. Also, the supplied air is 2 kgf/cm$^2$, and the air layer formed then is 50 $\mu$m with respect to the thin film material of 3 $\mu$m, and approximately 30 $\mu$m with respect to the thin film material of 30 $\mu$m. As a result, the material floats without being affected by static electricity or the like. In some cases, however, the supply of deelectrifying blow from the air supply port 405 makes the floating effect greater. Also, it may be possible to form micro holes on a thin substrate by means of etching or the like to prepare the medium 402 having micro hole diameters instead of the porous element.

Figure 31:
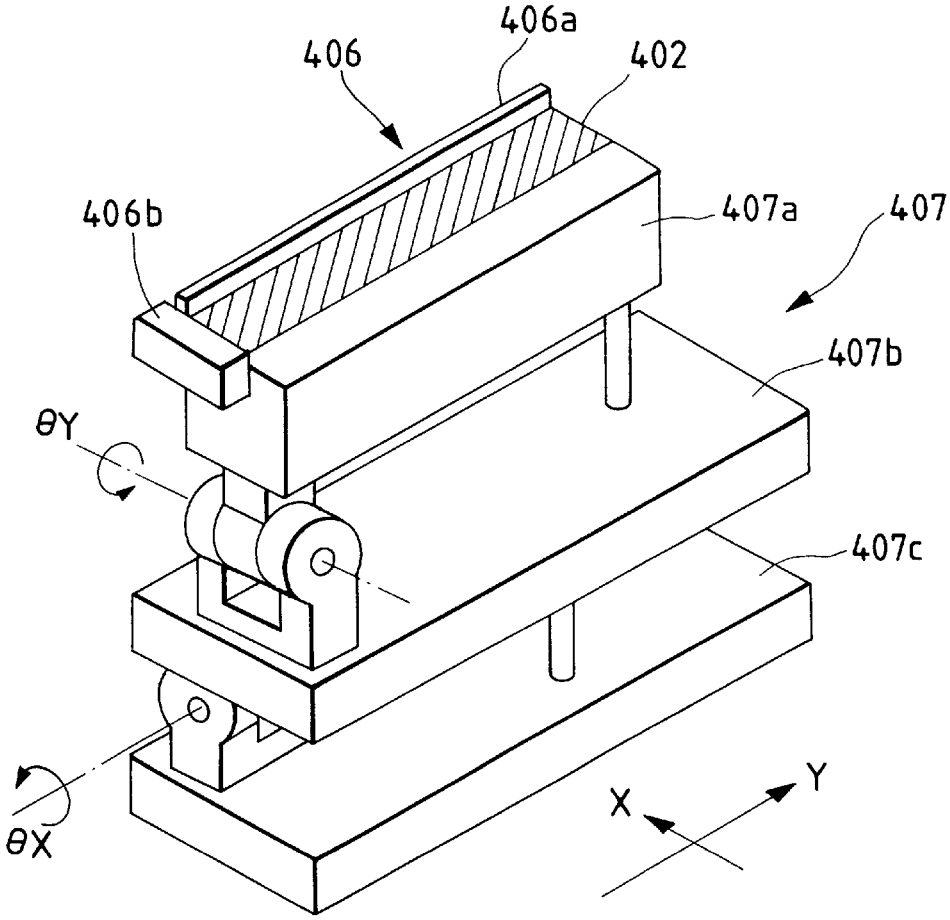
FIG. 31 is a view which shows the principle with respect to the floating of a thin film material.

FIG. 31 is a view which schematically shows the method whereby to cause the thin film material to abut upon the reference member in accordance with the present embodiment.

A reference numeral 406 designates an abutting reference member; 406*a*, an abutting reference member in the direction Y; 406*b*, an abutting member in the direction X; 407*a*, an upper base; 407*b*, a middle base; and 407*c*, a lower base.

By means of the floating principle described above, the thin film material placed on the base 407*a* is allowed to float, and then, the base 407*a* is tilted by θ in the direction Y with the base 407 as its reference so that abutting in the direction Y is performed by the abutting reference member 406*b*. After that, the base 407*b* is tilted by θ in the direction X with the base 407*c* as its reference, while keeping the current state, so that abutting in the direction X is performed by the abutting reference member 406*a*. In this way, by use of the weight of the thin film material own, abutting each in the directions X and Y is executed by tilting the bases 407*a* and 407*b* accordingly.

In this respect, it should be good enough if only the bases for abutting operation are capable of being tilted by θ in the directions X and Y in the end, respectively, and the order of tilting may be arbitrary or it may be executed at a time. Also, it is better to modify the sequence of the tilting operations, and the angles as well, depending on the size of the objective thin film material or some other factors.

Figure 32:
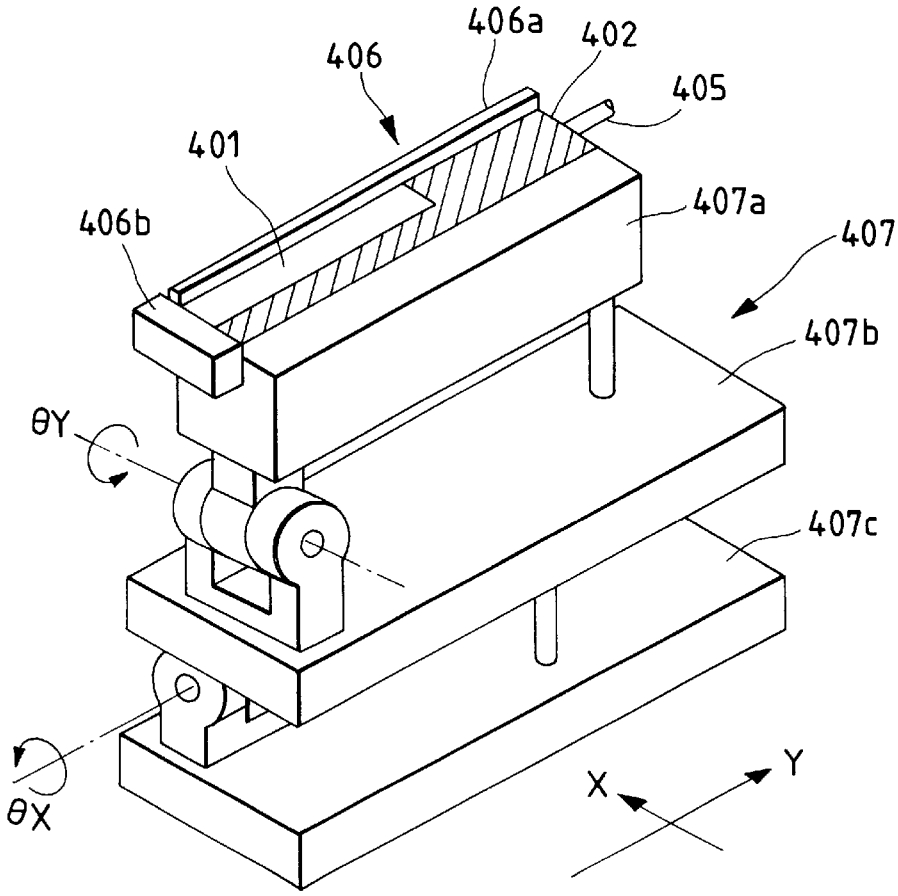
FIG. 32 is a view which schematically shows the state of the provisional positioning of a thin film material being terminated.

Thereafter, the air, being supplied for the formation of the air layer between the thin film material 401 and the medium 402 having micro hole diameters, is suspended. At the same time, the thin film material is adsorbed to the medium 402 having micro hole diameters for its provisional fixation. Then, the bases 407*a* and 407*b* return to the original positions, and the reference members 406*a* and 406*b* are retired in the directions X and Y, thus terminating the provisional positioning. FIG. 32 shows the state that a thin film material is positioned provisionally.

Here, it is arranged to vibrate the supply air with the tilting of the bases 407 simultaneously in order to facilitate the movement of the thin film, but it is also confirmed that the thin film material is movable without such vibration of air.

Also, for the present embodiment, the vibration given to the supply air is 200 kHz, and the tilting angles of the bases 407 are 10° both for the θX and θY. For the present embodiment, the thin film materials are prepared in two sizes, 9×3 mm and 100×3 mm. For both of them, the accuracy of the provisional positioning is ±10 $\mu$m or less. Also, in accordance with the present embodiment, an image processing method is used for positioning the thin film material on the substrate having the heat generating elements arranged therefor. For the present embodiment, the area useable for such image processing is 100 $\mu$m×100 $\mu$m. With the precision of the provisional positioning made available by the present embodiment, the thin film material is positioned and carried over to the image processing area. As a result, it is possible to reliably place the positioning reference of the thin film material in the image processing area.

Also, as a method for tilting the bases 407, it is good enough to drive in wedges by use of cylinders or the like. In this case, the system is significantly advantageous costwise.

Figure 33:
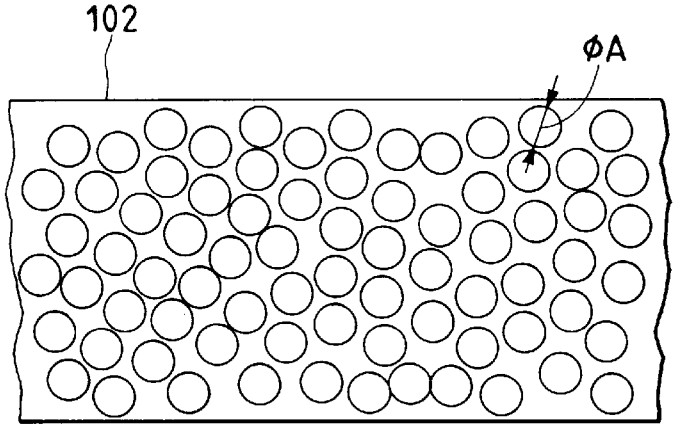
FIG. 33 is a view which schematically shows a medium having fine hole diameters.

FIG. 33 is a view which schematically shows the medium having micro hole diameters used for the present embodiment.

For the present embodiment a porous element is used for the medium 402 having micro hole diameters. The hole diameter ϕA of the porous element is arranged in three kinds, 20 μm, 50 μm, and 100 μm. Any one of them does not affect the precision of the intended provisional positioning. If a thin film material 401 is micro processed, it is advantageous to adopt the smaller hole diameter for the medium. For the present embodiment, the thin film material 401 is processed in approximately 30 μm. Therefore, it is prepared to adopt the porous element having its hole diameter of 20 μm or less. As a result, the micro process given to the thin film material is not deformed, and there is also no possibility that it is damaged, although the thin film material is caused to abut upon the abutting reference materials 406 before being adsorbed to the porous element for the provisional fixation. This is because the micro hole diameters of the porous element is smaller than the micro processed pattern of the thin film material.

Figure 34:
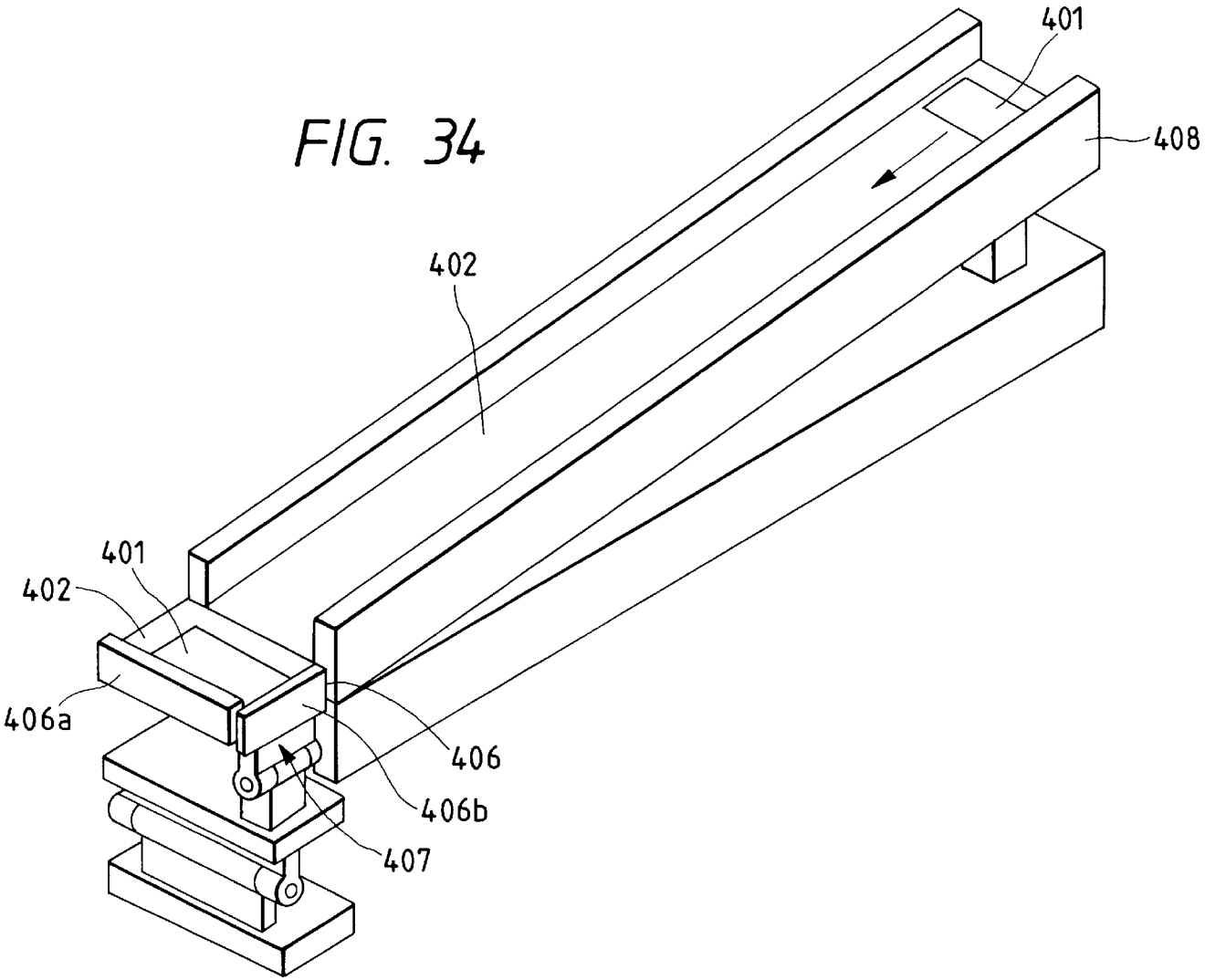
FIG. 34 is a carrier base for supplying thin film materials to a base for use of positioning.

FIG. 34 is a view which shows the carrier base 408 for carrying the thin film material to supply it to the positioning bases 407 represented in FIG. 31.

As shown in FIG. 34, when carrying the thin film material, the carrier base 408 is tilted in advance, while eliminating friction force between the thin film material and the carrier base 408 by the application of the floating principle thereof in accordance with the present invention, thus allowing the thin film material 401 to shift onto the bases 407 for positioning use. Here, in order not to allow the thin film material 401 to rotate or fly out from the carrier base 408 at this juncture, the guide is arranged for the carrier base. Also, the carrier base 408 is tilted at an angle of 10° for the present embodiment, but it is necessary to change such angle depending on the sides of the thin film material, the carrying distance, and some other factors.

As described above, in accordance with the present embodiment, the following effects are obtainable:

(1) It is possible to carry and position thin film materials having different thicknesses in high precision without damaging them when a liquid jet head or others are manufactured. One and the same method is applicable without any modification due to the configuration and others of the thin film material.

(2) There is no influence exerted by static electricity, which usually presents a problem in handling a thin film material. The system can be structured simply at low cost. It is also possible to make the system smaller.

(3) By use of a medium having micro hole diameters, it is possible to perform micro processing freely for the thin film material to be used. As a result, the range of design consideration is made wider.

(Embodiment 7)

The present embodiment describes another method preferably applicable up to the positioning of the thin film material with respect to the elemental substrate or the ceiling plate.

An assembling robot system that assembles a plurality of small components with each other is arranged to face the base to stack sheet members (thin film material) on it as a small component in the station of assembling operation, for example. The carrier jig that holds the sheet member in the assembling robot system is carried to the installation surface of the base along given carrier path, and then, the driving of the carrier jig is controlled so that the sheet member is allowed to be placed on the installation surface after being positioned properly.

For a system of the kind, the surface portion of the carrier jig, which is on the reverse side with respect to the contact surface of the sheet member, is held by means of air pressure supplied to a member, such as an adsorptive member of the carrier jig.

Also, when the sheet member is positioned to the installation surface of the base and stacked on it in high precision, the carrier jig holds the sheet member so that the contact surface thereof and the installation surface of the base are allowed to face each other and to be substantially in parallel to each other, and that the carrier jig should hold it above the installation surface of the base. Whether or not the contact surface of the sheet member held by the carrier jig and the installation surface of the base are allowed to face each other, and the sheet member is placed, while keeping its parallel condition within an allowable range, are inspected in advance in the inspection station by use of a measuring instrument as to the parallel condition of each sheet member with respect to the installation surface of the base, and the thickness of the sheet member per sheet per base as well. After that, only the sheet member and the base that have passed such inspection are carried over to the assembling station while being head by the carrier jig.

Then, when positioning the sheet member with respect to the installation surface of the base, the driving of the corresponding carrier jig is controlled so that the position of the sheet member thus held is regulated to be in the given position with respect to the installation surface of the base. To regulate the position of the carrier jig, it is possible to use the imaging signals being transmitted from a video camera or other imaging device that photographs the position of the sheet member with respect to the installation surface of the base. In other words, there is provided an image processing system that executes the given image processing in accordance with the imaging signals obtainable from the imaging device, thus transmitting the relative positional data on the sheet member.

However, there is a drawback that it takes a comparatively long time to shift the carrier jig between the inspection station and the assembling station, and to execute the series of operations from the positioning of the sheet member with respect to the installation surface of the base to the stacking of the sheet member because of the inspection thus required. Also, when positioning the sheet member, it is necessary to adjust positions along each of the coordinating axes of the orthogonal coordinating system arranged in the virtual plane parallel to the installation surface of the base. Therefore, a plurality of image processing system described above are arranged for each of the coordinating axes orthogonal to the coordinating system, thus leading to the provision of a larger equipment eventually.

In consideration of the problems described above, the present embodiment is designed and aimed at providing a method for positioning a sheet member to position the contact surface of the sheet member with respect to the installation surface of a base for which the sheet member is arranged, and to provide a system for positioning a sheet member using this method, which is capable of shortening the time required for the execution of a series of operations from the position of the sheet member with respect to the installation surface of the base to the stacking thereof, with a method whereby to attempt making the assembling system smaller.

In order to achieve the objectives set for the present embodiment, the method for positioning a sheet member is structured by including the steps of arranging a carrier jig having a connecting surface and magnetically holding a sheet member formed by magnetic material in a position facing a base having the installation surface allowing the connecting surface of the sheet member to abut upon the installation surface of the base; of performing the positional adjustment for the sheet member held by the carrier jig with respect to the specific position of the base in a state of the one directional position of the carrier jig being regulated with respect to the installation surface of the base; and of causing the sheet member whose position has been adjusted with respect to the specific position of the base to part from the carrier jig.

Also, a system for positioning a sheet member comprises a unit of positional adjustment mechanism provided with a jig selectively holding edges orthogonal to the connecting surface of a sheet member, being arranged to face a base having an installation surface to arrange the sheet member thereon; a position detecting unit for detecting the relative position of the sheet member held by the carrier jig with respect to the installation surface of the base; and a unit of positional adjustment mechanism for controlling the operation of positional adjustment for the sheet member held by the carrier jig with respect to the installation surface of the base in accordance with the detection output from the position detecting unit in a state of the edges of the carrier jig and the base abutting upon each other between them to regulate one direction of the carrier jig with respect to the installation surface of the base.

Figure 38:
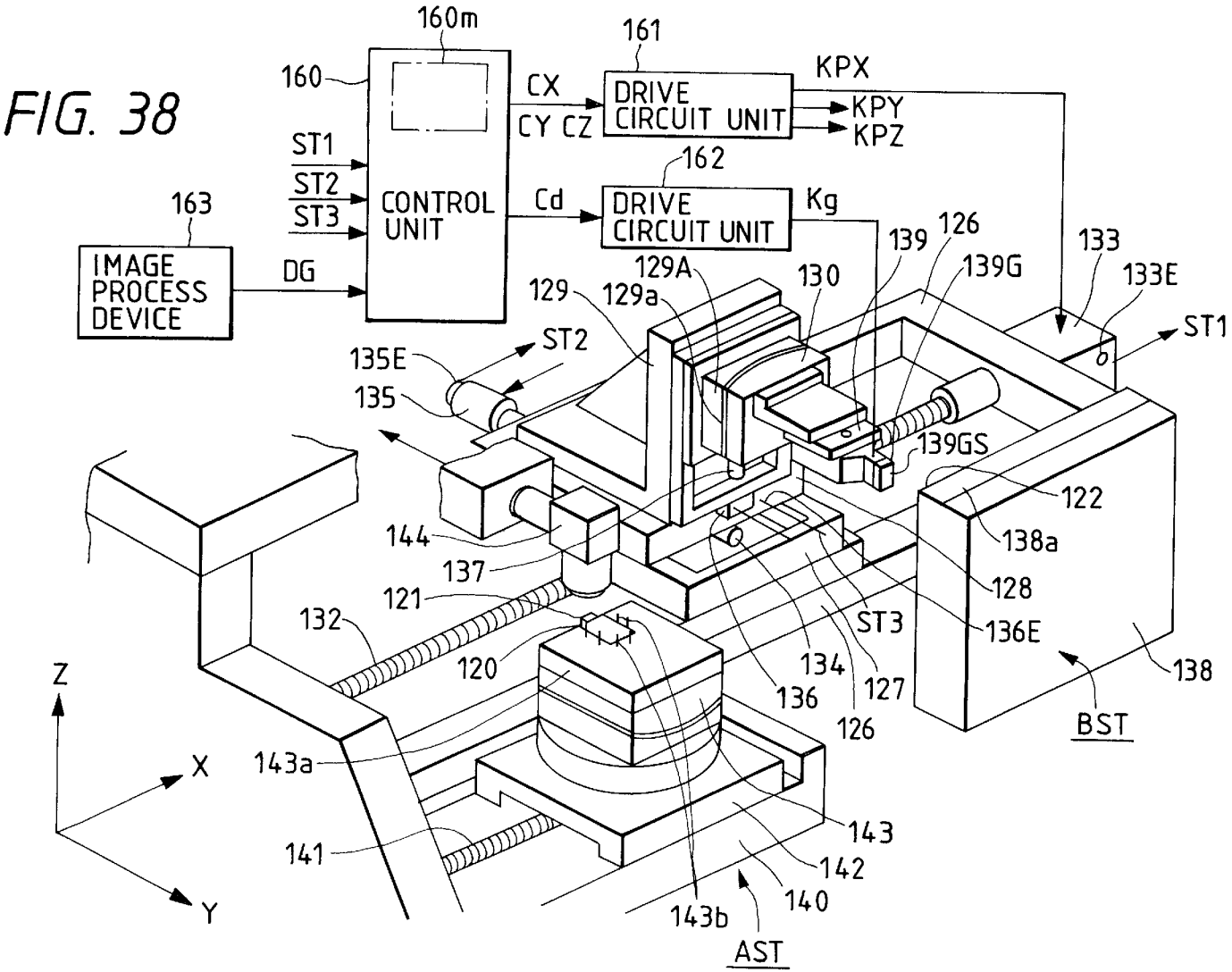
FIG. 38 is a perspective view which shows the outline of the structure of the positioning apparatus to which is applied one example of the method for positioning a sheet member of the present invention.

FIG. 38 is a view which schematically shows the structure of an assembling apparatus to which is applied one example of the method for positioning a sheet member (thin film material) in accordance with the present invention.

For the apparatus shown in FIG. 38, a handling station BST, on which a sheet member 122 is stacked for assembling, and an assembling station AST, on which the sheet member 122 is assembled on the elemental substrate 121, are arranged to face each other. The assembling apparatus is structured by including the following main constituents:

a first movable table 127 slidably supported on a pair of table base members 126, which are arranged to face each other, along the coordinate axis X indicated in FIG. 38;

a second movable table 128 slidably supported on the upper surface of the first movable table 127 along the coordinate axis Y orthogonal to the coordinate axis X shown in FIG. 38; and a handle unit base 129 arranged on the upper face of the second movable table 128 with a handle portion 130 to hold the sheet member 122 as a work piece.

The first movable table 127 is fitted over a ball screw shaft 132, which is rotatively supported at both ends thereof in the direction of the coordinate axis X, having its female screw (not shown) installed in the table base member 126. On the one end portion of the ball screw shaft 132, which extends in the coordinate axis X direction, a stepping motor 133 is connected as a driving unit. For the stepping motor 133, an absolute encoder 133E is mounted to detect the shifting amount of the first movable table 127. The driving of the stepping motor 133 is controlled by the driving control pulse signals emitted from the driving circuit unit 162 to be described later. Also, the encoder 133E transmits the detection output signals ST1 that indicate the shifting amount of the first movable table 127. In this way, when the stepping motor 133 is driven, the first movable table 127 reciprocates between the handling station BST and the assembling station AST for a given shifting amount in the coordinate axis direction X.

The second movable table 128 is fitted over a ball screw shaft 134, which is rotatively supported at both ends thereof in the direction of the coordinate axis Y, having its female screw (not shown) installed in the table base member 126. On the one end portion of the ball screw shaft 134, a stepping motor 135 is connected as a driving unit. For the stepping motor 135, an absolute encoder 135E is mounted to detect the shifting amount of the second movable table 128 in the coordinate axis direction X. The driving of the stepping motor 135 is controlled by the driving control pulse signals emitted from the driving circuit unit 162. Also, the encoder 135E transmits the detection output signals ST2 that indicate the shifting amount of the second movable table 128. In this way, when the stepping motor 135 is driven, the second movable table 128 reciprocates between the handling station BST and the assembling station AST for a given shifting amount in the coordinate axis direction Y.

On the end portion of the handle unit base 129 in the coordinate axis direction Y, there is provided a support reception unit 129A, which expands wider along the coordinate axis Z orthogonal to the coordinate axes X and Y shown in FIG. 38, in order to slidably support the hand unit 130 in the top to bottom direction. For the support reception unit 129A, a slidable unit 129*b* is provided with the formation of slidable surface in a bending configuration, thus supporting the hand unit 130. In the support reception unit 129A, there is inserted a ball screw shaft 137 extending in the top to bottom direction with one end side thereof being rotatively supported. On the other end portion of the ball screw shaft 137, the female screw of the hand unit 130 is fitted over it. With one end of the ball screw shaft 137, a stepping motor 136 is connected as the driving unit. For the stepping motor 136, an absolute encoder 136E is mounted to detect the shifting amount of the hand unit 130 in the coordinate axis direction Z. The driving of the stepping motor 136 is controlled by the driving control pulse signals emitted from the driving circuit unit 162. Also, the encoder 136E transmits the detection output signals ST3 that indicate the shifting amount of the hand unit 130 in the coordinate axis direction Z. In this way, when the stepping motor 136 is driven, the hand unit 130 is supported and guided by the slidable unit 129*a* of the support reception unit 129A to reciprocates for a given shifting amount in the coordinate axis direction Z.

A finger unit 139, which is extended in the coordinate axis direction X and provided with an electromagnetic unit 139G as a carrier jig to hold the sheet member 122, is connected with the end portion of the hand unit 130. The electromagnetic unit 139G is provided with the holding reference surface 139GS to hold the sheet member 122. The driving of the electromagnetic unit 139G is controlled by the driving circuit unit 162, which will be described later, so as to selectively present the energized state and de-energized state. FIG. 38 shows the state that the finger unit 139 is in the standby position.

For the handling station BST, a work supporting base 138 is arranged, which is provided with a flat reference surface 138*a* where the sheet member 122 is stacked.

For the assembling station AST, a table base member 140 is arranged to be extended substantially in parallel with the table base member 126. For the table base member 140, a ball screw shaft 141 is rotatively supported at both ends thereof. On the upper surface of the table base member 140, a movable table 142 is arranged to be slidably supported with a female screw unit which is fitted over the ball screw shaft 141.

Also, on the above the surface table 143*a*, an image processing system 163 is arranged including the photographing equipment 144 the photographs the elemental substrate 121 and the sheet member 122. The photographing equipment 144 is a video camera having CCD (charge coupled device) is incorporated in it as photo-electric transfer elements, for example, and photographs the positioning mark provided for the elemental substrate 121, and the positioning mark provided for the sheet member 122 for transmitting them as image signals to the signal processing unit. The signal processing unit produces image data DG that indicate the configuration of marks by means of given signal processing in accordance with the image signals, and then, supply them to the control unit 160, which will be described later.

The assembling apparatus thus structured adopts a teaching play back method whereby to enable the hand it 130 and finger unit 139 of the assembling apparatus to shift along the operation path having the continuation of the respective teaching points defined in advance.

For the assembling apparatus, a control unit 160 is also provided to perform the operational control of the assembling apparatus.

To the control unit 160, detection output signals ST1, ST2, and ST3 are supplied from the encoder units 133E, 135E, and 136E, and also, image data DG is supplied from the image processing system 163.

The control unit 160 is provided with the memory unit 160*m* that stores the operational program data supplied from the host computer; the data on the operational passages of the hand unit 130 and finger unit 139; the positional data on each of the teaching points for each of the coordinate axes defined in advance; data on operational speeds; and the image data DG from the image processing system 163, among some others.

When the control unit 160 controls the operation of the assembling apparatus, one sheet member 122 is placed by means of a carrier device (not shown) in advance at the corners of the flat reference surface 138*a* of the work supporting base 138 of the handling station BST. Also, on the assembling station AST, the supporting element 120, having the elemental substrate 121 fixed in a given position thereon by means of a carrier device (not shown), is regulated by the position regulating pin 143*b* and stacked on the surface table 143*a*.

At this juncture, the longer side of the sheet member 122 agrees with the circumferential edge of the work supporting base 138 in the longitudinal direction, and the contact surface 122*a* of the sheet member 122 abuts upon the flat reference surface 128*a* of the work supporting base 138. Also, the longer side of the elemental substrate 121 is arranged substantially in parallel with the longer side of the sheet member 122 stacked on the work supporting base 138, and the surface 146*a* of the elemental substrate 121 for installation is arranged to face the photographing equipment 144.

The control unit 160 produces, at first, the driving control signals Cx, Cy, and Cz corresponding to the respective operations of the stepping motors 133, 135, and 136 in order to shift the holding reference surface 139GS of the electromagnetic unit 139G of the hand unit 130 and finger unit 139 from the initial position so that this surface abuts upon the side end portion of the work supporting base 138.

The driving circuit unit 162 produces the driving pulse signals KPx, KPy, and KPz that indicate the shifting amounts in accordance with each of the driving control signals Cx, Cy, and Cz, and then, supplies them to the stepping motors 133, 135, and 136, respectively. In this way, the holding reference surface 139GS of the electromagnetic unit 139G abuts upon the side end portion of the work supporting base 138. At the same time, the central part of the holding reference surface 139GS is placed closely to the side end portion of the sheet member 122.

Then, the control unit 160 suspends the supply of the driving control signals Cx, Cy, and Cz when it is confirmed that the holding reference surface 139GS of the electromagnetic unit 139G has abutted upon the side end portion of the work supporting base 138 in accordance with the detection output signals ST1, ST2, and ST3, and produces the driving control signal Cd in order to put the electromagnetic unit 139G in the magnetized state, which is supplied to the driving circuit unit 162. The driving circuit unit 162 produces the driving signal Kg in accordance with the driving control signal Cd and supplies it to the magnetic unit 139*g*.

Figure 37:
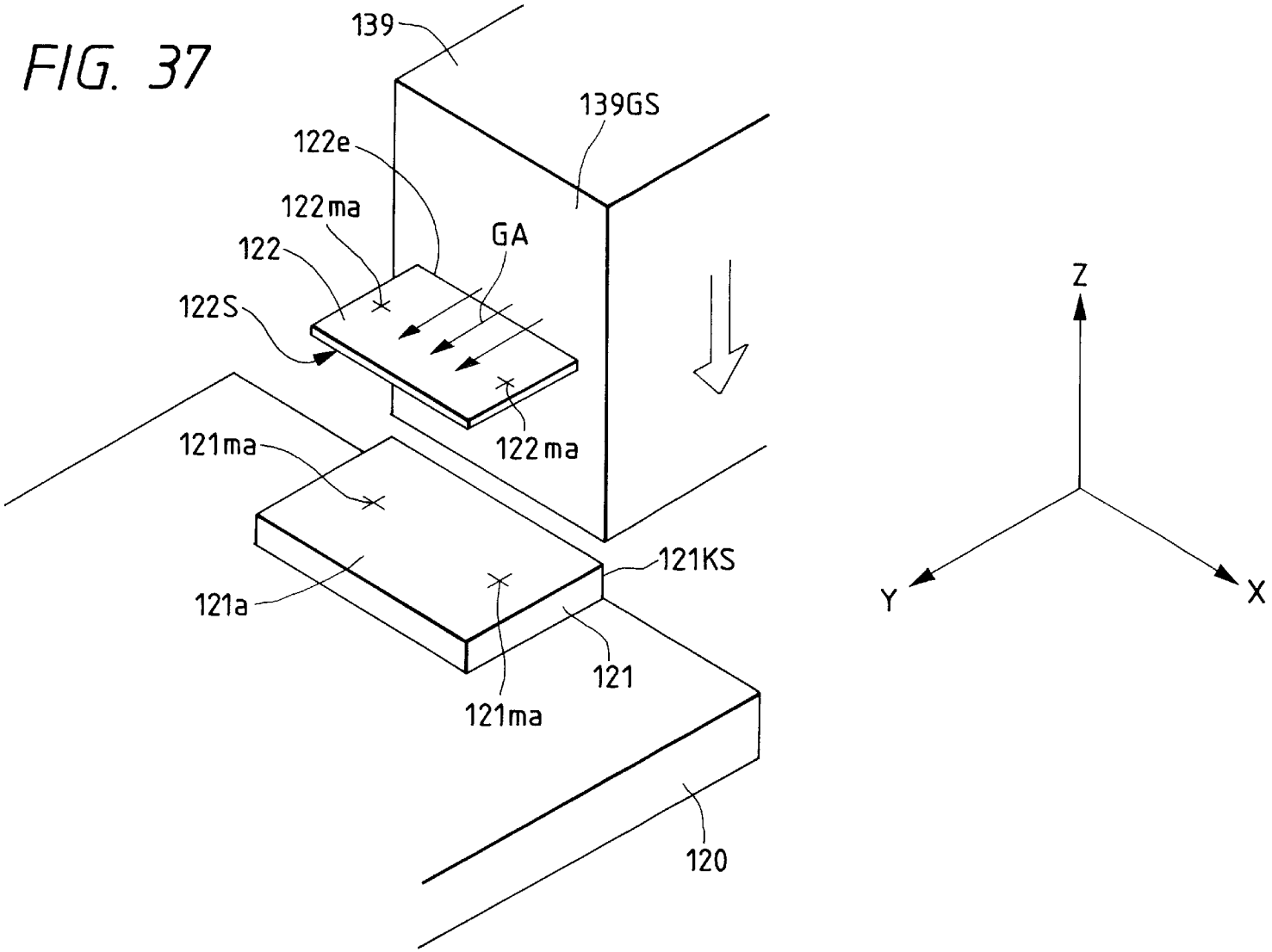
FIG. 37 is a perspective view which illustrates the method for positioning a sheet member in accordance with the present invention, and the operation of one example of the positioning apparatus using such method.

In this way, the magnetic field GA is formed on the holding reference surface 139GS, which is substantially in parallel with the flat reference surface 138*a* of the work supporting base 138 as shown in FIG. 37.

As a result, the side end portion 122*e* of the longer side of the sheet member 122 is held on the holding reference surface 139GS, thus the sheet member 122 being supported by magnetic force substantially perpendicular to the holding reference surface 139GS.

Figure 36A:
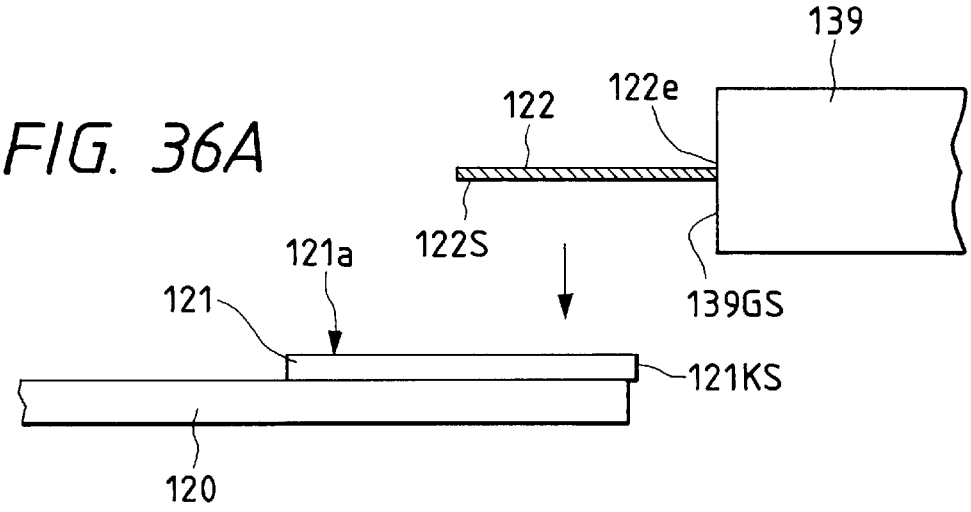
FIGS. 36A, 36B, and 36C are views which illustrate a method for positioning a sheet member in accordance with the present invention, and the operation of a positioning apparatus using such method in accordance with a first embodiment thereof.
Figure 36B:
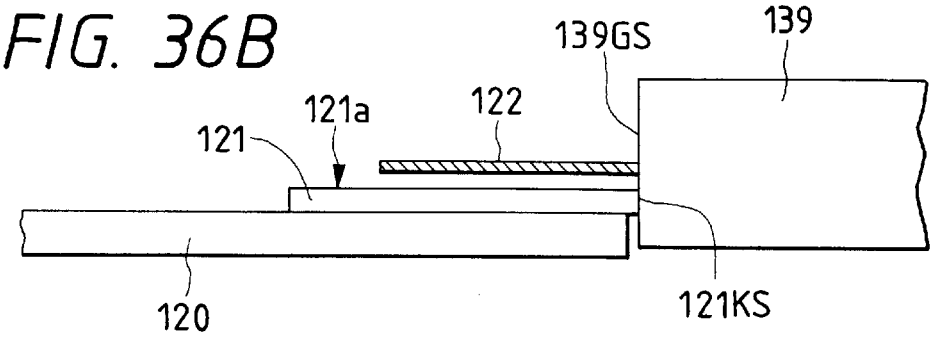

In continuation, as shown in FIG. 36A and FIG. 37, the control unit 160 shifts the finger unit 139 to a given setting position in which the contact surface 122*a* of the sheet member 122 held on the holding reference surface 139GS faces the installation surface 121*a* of the elemental substrate 121, almost in parallel therewith, on the work base 143 of the assembling station AST. Further, as shown in FIG. 36B, the control unit 160 causes the finger unit 139 to descend to a given position in order to allow the contact surface 122*a* of the sheet member 122 to approach the installation surface 121*a* of the elemental substrate 121 from the position described above. Then, the control unit produces driving control signals Cx, Cy, and Cz to enable the holding reference surface 139GS to abut upon the reference contact surface 146*ks* of the elemental substrate 121 that faces the holding reference surface 139GS, and supplies them to the driving circuit unit 162.

Then, while keeping the control unit 160 in the state as it is, the sheet member 122 is positioned with respect to the elemental substrate 121. In positioning the sheet member 122 with respect to the elemental substrate 121, there are provided cross marks 122*ma* and 122*ma* on the surface of the sheet member 122 and the installation surface 121*a* of the elemental substrate 121 as shown in FIG. 37, for example. When these marks are overlapped to be in agreement, the position of each heat generating element on the elemental substrate 121 and the position of each movable wall 122*a* are placed in the regular positional relations. The marks 122*ma* and 122*ma* are configured to be in the same width and length to each other. Also, the marks 122*ma* and 122*ma* are arranged at the same interval, respectively.

Thus, the image of the mark 122*ma* that has been obtained by photographing in advance, and the image of the mark 122*ma* being photographed are in agreement with each other when these images are overlapped at the time of the position of each heat generating element of the elemental substrate 121 and the position of each movable wall 122*a* being placed in the regular positional relations, that is, the sheet member 122 being positioned to the regular position of the installation surface 121*a* of the elemental substrate 121. On the other hand, if the position of each heat generating element of the elemental substrate 121 and the position of each movable wall 122*a* is not in the regular positional relations, the image of the mark 122*ma* obtained by photographing in advance and the image being photographed are not in agreement with each other when these images are overlapped.

The control unit 160 stores the image data DG on the mark 122*ma* from the image processing system 163 in the memory unit 160*m* in advance, and compares the image data on the mark 122*ma* read out from the memory unit 160*m* with the image data DG on the obtained mark 122*ma* in order to produce the driving control signal Cx for use of the positional adjustment to enable the image data DG to agree with the image data on the mark 122*ma*, and then, supply such signal to the driving circuit unit 162.

Therefore, the position of the holding reference surface 139GS is adjusted in a state that it slides on the reference contact surface 146*ks*. As a result, there is no need for the performance of the positional adjustment in the coordinate axis direction Y shown in FIG. 37. It becomes possible to execute positioning on the coordinate axis X and the surface Y easily just by performing the positional adjustment only in the coordinate axis direction X.

Figure 36C:
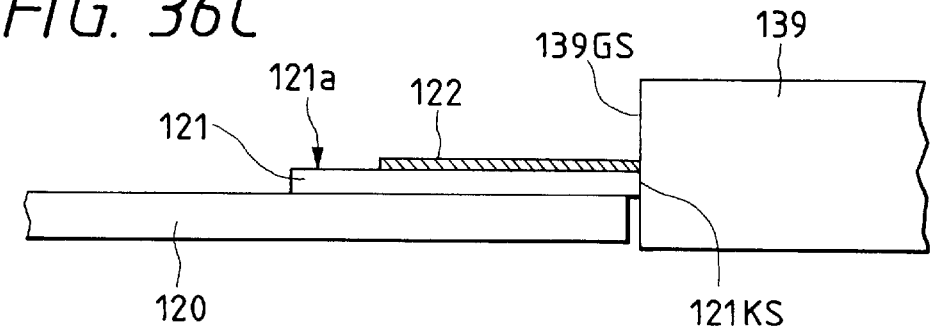

When the control unit 160 confirms that these image data DG are in agreement with each other, it produces the driving control signal Cz to enable the finger unit 139 to descend from that position in a given shifting amount so that the contact surface 122*a* of the sheet member 122 is allowed to approach the installation surface 121*a* of the elemental substrate 121 and to abut upon it, and supplies the signal thus produced to the driving circuit unit 162. In this way, as shown in FIG. 36C, the contact surface 122*a* of the sheet member 122 is stacked on the installation surface 121*a* of the elemental substrate 121.

At this juncture, the control unit 160 suspends the supply of the driving control signal Cd to the electromagnetic unit 139G. Also, it produces driving control signals Cx, Cy, and Cz in order to enable the finger unit 139 to return to the standby position at the initial stage, and supplies them to the driving circuit unit 162. Here, the liquid for use of provisional fixation is applied to the installation surface 121*a* of the elemental substrate 121.

As a result, the sheet member 122 adheres to the installation surface 121*a* of the elemental substrate 121. After that, the supporting element 120, having the sheet member 122 adhering to the installation surface 121*a* of the elemental substrate 121, is carried to another operational station by means of the carrier device (not shown), and then, a new supporting element 120 and elemental substrate 121 are mounted on the work base 143.

(First Variational Example)

For the example described above, the positional adjustment is performed in the coordinate axis direction X by means of the images of the marks 122*ma* and 122*ma* in the state represented in FIG. 36B. However, the present invention is not necessarily limited to such example. For example, as shown in FIG. 39, it may be possible to perform the positional adjustment in the coordinate axis direction X for the sheet member 122 with respect to the installation surface 121*a* of the elemental substrate 121 by the provision of a rectangular through hole 145H in a given position on the sheet member 145 in advance, while a positioning pin 146P being arranged on the corner on the installation surface 146*a* of the elemental substrate 146.

Figure 39:
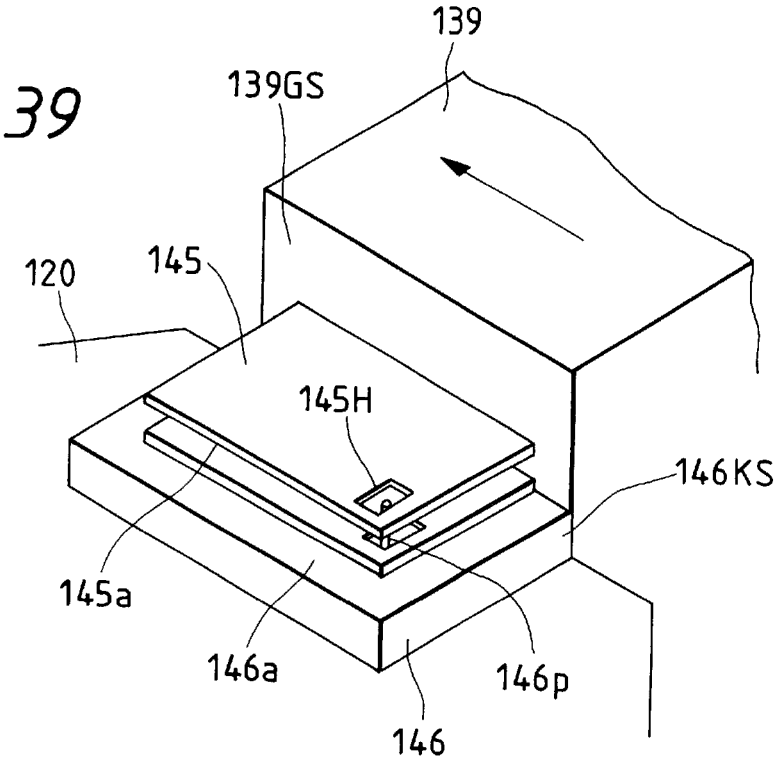
FIG. 39 is a view which illustrates the method for positioning a sheet member in accordance with the present invention, and the operation of the positioning apparatus using such method in accordance with a second embodiment thereof.

For the example shown in FIG. 39, the positioning pin 146P has a diameter of 20 to 1,145 μm, and the height from the installation surface 146*a* to the tip of the pin is 10 to 30 μm. Also, the area of the through hole 145H is arranged to be approximately two times the horizontally sectional area of the positioning pin 146P. This arrangement is made to enable the positioning pin 146P to be inserted into the through hole 145H at all times in consideration of the errors from given position of reference of the relative position with respect to the holding reference surface 139GS of the sheet member 145 when the sheet member 145 is held on the holding reference surface 139GS of the magnetic unit 139G on the handling station BST in the state where the holding reference surface 139GS abuts upon the reference contact surface 146*ks* of the elemental substrate 121 that faces the holding reference surface 139G.

In this condition, the control unit 160 produces the driving control signal Cz to cause the electro-magnetic unit 139G to descend until the contact surface 145*a* of the sheet member 145 abuts upon the installation surface 146*a* in the same way as shown in FIG. 36B. This is the position where the tip of the positioning pin 146P is inserted into the through hole 145H of the sheet member 145 in the state where the holding reference surface 130GS abuts upon the reference surface 146*ks* of the elemental substrate 121 that faces the holding reference surface 139GS, and further, this is the position indicated by one-dot chain line in FIG. 39. The signal thus produced by the control unit is supplied to the driving circuit unit 162. After that, the control unit 160 causes the sheet member 145 to shift in a given shifting amount in the direction indicated by an arrow Xa, and produces the driving control signal Cx for the performance of the positional adjustment in the coordinate axis direction X. The signal thus produced is supplied to the driving circuit unit 162. Here, the shifting amount is assumed to be the maximum distance up to the tip of the positioning pin 146P approaching closely the inner circumferential surface of the through hole on one side, for example. Then, the control unit 160 suspends the supply of the driving control signal Cd to the electromagnetic unit 139G as in the example described above.

Figure 40:
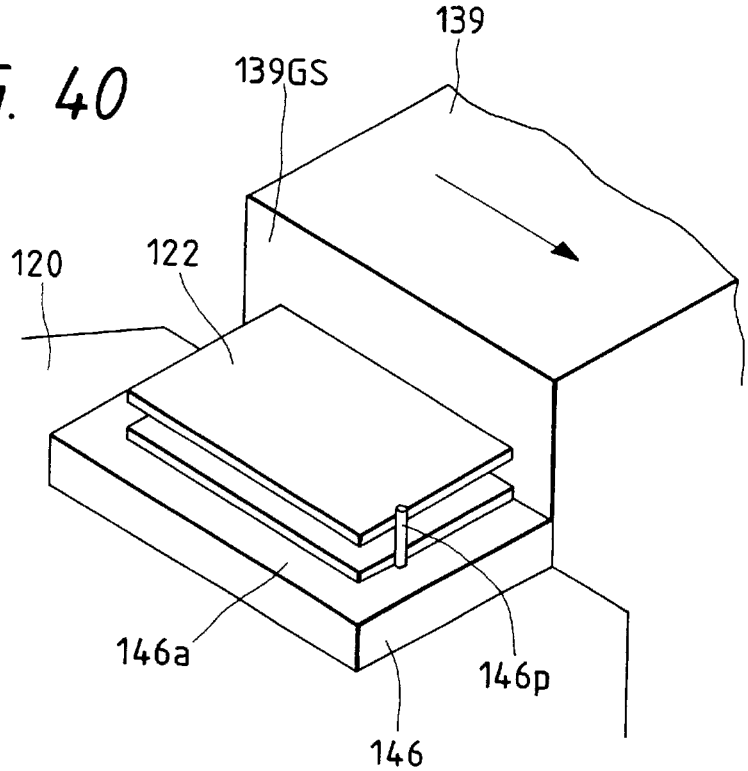
FIG. 40 is a view which illustrates the method for positioning a sheet member in accordance with the present invention, and the operation of the positioning apparatus using such method in accordance with a third embodiment thereof.

Further, the example shown in FIG. 40 is such that a positioning pin 146P of the same type as described above is arranged in the vicinity of the circumferential edge portion of the installation surface 146*a* of the elemental substrate 146, but no through hole is provided for the sheet member 122 unlike the example shown in FIG. 39 in which the rectangular through hole 145H is arranged on a given position of the sheet member 145, while the positioning pin 146P is arranged on the corner in the installation surface 146*a* of the elemental substrate 146.

(Second Variational Example)

For the example shown in FIG. 40, the control unit 160 produces the driving control signal Cz to cause the electromagnetic unit 139G to descend until the contact surface 122*a* of the sheet member 122 abuts upon the installation surface 146*a* in the same way as shown in FIG. 36B. This is the position where the holding reference surface 130GS abuts upon the reference surface 146*ks* of the elemental substrate 121 that faces the holding reference surface 139GS, and further, this is the position indicated by one-dot chain line in FIG. 40. The signal thus produced by the control unit is supplied to the driving circuit unit 162. After that, the control unit 160 causes the sheet member 122 to shift in a given shifting amount in the direction indicated by an arrow Xb, and produces the driving control signal Cx for the performance of the positional adjustment in the coordinate axis direction X. The signal thus produced is supplied to the driving circuit unit 162. Here, the shifting amount is assumed to be the maximum distance up to the end face of the shorter side of the sheet member 122 approaching closely the positioning pin 146P, for example. Then, the control unit 160 suspends the supply of the driving control signal Cd to the electromagnetic unit 139G as in the example described above.

Therefore, in accordance with the examples shown in FIG. 39 and FIG. 40, the positional adjustment is executed in the state where the holding reference surface 139G slides on the reference contact surface 146*ks*. As a result, there is no need for the performance of the positional adjustment in the coordinate axis direction Y, thus making it possible to execute positioning with respect to the coordinate axis X and surface Y just by the positional adjustment only in the coordinate axis direction X.

(Third Variational Example)

For the examples shown in FIG. 36A to FIG. 40, the contact surface 122*a* of the sheet member 122, which is held on the holding reference surface 139GS of the electromagnetic unit 139G, and the installation surface 121*a* of the elemental substrate 121 are kept in the state that both of them are in parallel with each other as shown in FIG. 36A. For example, however, if the thickness is not even all over due to the varied thickness of each elemental substrate fixed to the supporting element 120 or the thickness of the supporting element 120 itself is not even due to the varied thickness of each supporting member 120, there are some cases where the parallel condition cannot be obtained as desired between the contact surface 122*a* of the sheet member 122 on the holding reference surface 139G and the installation surface 121*a* of the elemental substrate 121.

FIGS. 41A to 41E are views which illustrate one example of the method for positioning a sheet member in accordance with the present invention in such case described above. In FIGS. 41A to 41E, the same reference marks are applied to the same constituents appearing in the examples shown in FIGS. 36A to 36C and FIG. 37. Here, any repeated description thereof will be omitted.

The thickness of the elemental substrates 147 is not even for any one of them all over, and the installation surface 147*a* of the elemental substrate 147 tends to be inclined in one direction along the coordinate axis X with respect to the contact surface 122*a* of the sheet member 122 held on the holding reference surface 139GS of the electromagnetic unit 139G, for example. Also, on the installation surface 147*a*, a pair of cross marks 147*ma* are arranged. As in the examples described above, the respective marks are caused to be overlapped to be in agreement with each other, the position of each heat generating element on the elemental substrate 147 and the position of each movable wall 122*a* present the regular positional relationship.

With a structure of the kind, the control unit 160 shifts the finger unit 139 to a given setting position in which the contact surface 122*a* of the sheet member 122 held on the holding reference surface 139GS faces the installation surface 121*a* of the elemental substrate 121 on the work base 143 of the assembling station AST as shown in FIG. 41A. Further, as shown in FIG. 41B, the control unit 160 causes the finger unit 139 to descend to a given position in order to allow the contact surface 122*a* of the sheet member 122 to approach the installation surface 121*a* of the elemental substrate 121 from the position described above. Then, the control unit produces driving control signals Cx, Cy, and Cz to enable the holding reference surface 139GS to abut upon the reference contact surface 146*ks* of the elemental substrate 121 that faces the holding reference surface 139GS, and supplies them to the driving circuit unit 162.

In continuation, as shown in FIG. 41B and FIG. 41C, a part of the contact surface 122*a* of the sheet member 122 abuts, at first, upon the installation surface 147*a* of the elemental substrate 147, which has the largest thickness, while the control unit 160 is kept in the state as it is. Then, the control unit produces the driving control signal Cz in order to cause the finger unit 139 to descend further in a given shifting amount form that position so that the sheet member 122 follows the installation surface 147*a* to allow the entire area of the contact surface 122*a* of the sheet member 122 abuts upon the installation surface 147*a* of the elemental substrate 147, and supplies the signal thus produced to the driving circuit unit 162. In this way, as shown in FIG. 41C, the contact surface 122*a* of the sheet member 122 is stacked on the installation surface 147*a* of the elemental substrate 147. Here, the sheet member 122 is held on the holding reference surface 139GS by the application of given magnetic force. Then, after a part of the contact surface 122*a* of the sheet member 122 abuts upon the installation surface 147*a* of the elemental substrate 147, which has the largest thickness, the other part of the contact surface 122*a* of the sheet member 122 follows the downward shifting of the holding reference surface 139GS to abut upon the installation surface 147*a* eventually.

Continuously, then, as shown in FIG. 41D, the control unit 160 causes the finger unit 139 to shift upward once in a given shifting amount in the state where the holding reference surface 139GS slides on the reference contact surface 147*k*. After that, as in the examples described above, the positioning is performed by means of marks 122*ma* and 147*ma*. Here, the control unit produces the driving control signal Cz to cause the finger unit 139 to descend from that position in a given shifting amount in the direction indicated by an arrow UD so as to allow the contact surface 122*a* of the sheet member 122 to abut upon the installation surface 147*a* of the elemental substrate 147 again, and supplies the signal thus produced to the driving circuit unit 162.

In this way, as shown in FIG. 41E, the contact surface 122*a* of the sheet member 122 is stacked on the installation surface 147*a* of the elemental substrate 147. At this juncture, the control unit 160 suspends the supply of the driving control signal Cd to the electromagnetic unit 139G, and also, produces the driving signals Cx, Cy, and Cz to allow the finger unit 139 to return to the standby position at the initial stage. The signals thus produced are supplied to the driving circuit unit 162.

Therefore, it is possible to perform an appropriate positioning even when the contact surface 122*a* of the sheet member 122 held on the holding reference surface 139GS and the installation surface 147*a* of the elemental substrate 147 are not kept in the state that these surfaces are in parallel with each other.

(Fourth Variational Example)

Now, in the example shown in FIGS. 41A to 41E, the control unit 160 causes the finger unit 139 to ascend once in a given shifting amount in the state that the holding reference surface 139GS slide on the reference surface 147*ks* as shown in FIG. 41D, and then, the positioning is performed by means of marks 122ma and 147*ma*. Here, FIGS. 42A to 42D illustrate an example that omits the operation of ascending the finger unit 139 once, while the holding reference surface 139GS is in the state of sliding on the reference surface 147*ks*.

Figure 42B:
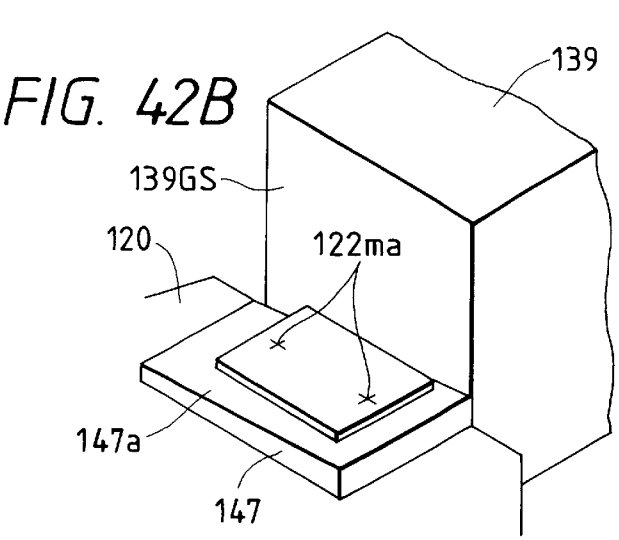
FIGS. 42A, 42B, 42C, and 42D are views which illustrate the method for positioning a sheet member in accordance with the present invention, and the operation of the positioning apparatus using such method in accordance with a fifth embodiment thereof.
Figure 42A:
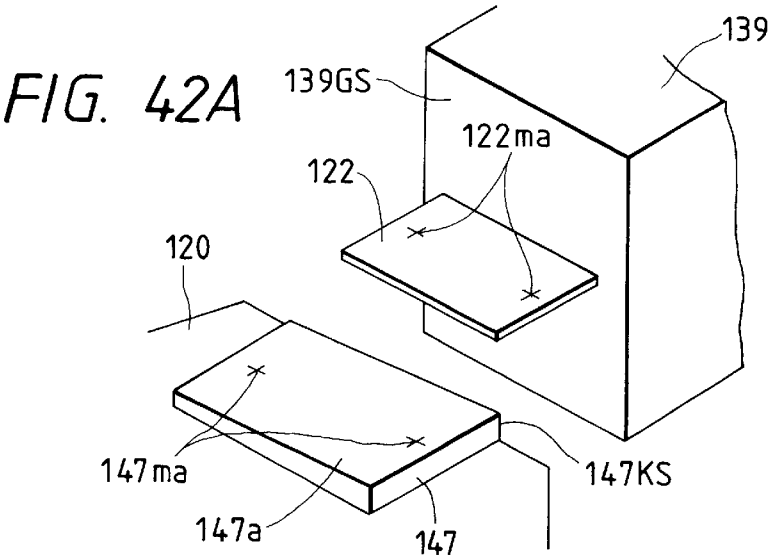
Figure 42D:
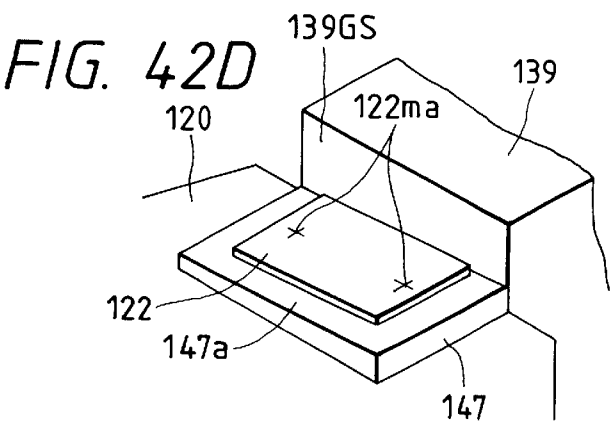

For the example shown in FIGS. 42A to 42D, the control unit 160 shifts the finger unit 139 to a given setting position in which the contact surface 122*a* of the sheet member 122 held on the holding reference surface 139GS faces the installation surface 121*a* of the elemental substrate 121 on the work base 143 of the assembling station AST as shown in FIGS. 42A and 42B in the same manner as the example shown in FIGS. 41A and 41B. Further, the control unit 160 causes the finger unit 139 to descend to a given position in order to allow the contact surface 122*a* of the sheet member 122 to approach the installation surface 121*a* of the elemental substrate 121 from the position described above. Then, the control unit produces driving control signals Cx, Cy, and Cz to enable the holding reference surface 139GS to abut upon the reference contact surface 146*ks* of the elemental substrate 121 that faces the holding reference surface 139GS, and supplies them to the driving circuit unit 162.

Figure 42C:
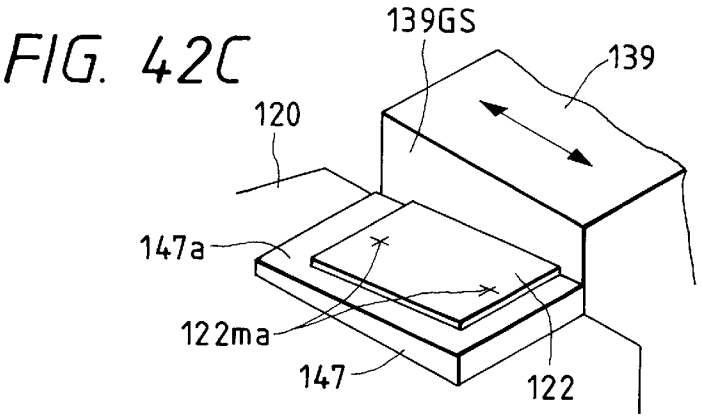

In continuation, the control unit 160 produces the driving signal Cz to allow the finger unit 139 to descend further from that position, while the control unit is kept as it is, so that the sheet member 122 follows the installation surface 147*a*, and that the entire area of the contact surface 122*a* of the sheet member 122 abuts upon the installation surface 147*a* of the elemental substrate 147 as shown in FIG. 42C. The signal thus produced is supplied to the driving circuit unit 162. In this way, as shown in FIG. 42C, the contact surface 122*a* of the sheet member 122 is stacked on the installation surface 147*a* of the elemental substrate 147.

Continuously, then, the control unit 160 produces the driving control signal Cx so that positioning is performed by means of marks 122*ma* and 147*ma* in the direction indicated by an arrow Xc in FIG. 42C, while the contact surface 122*a* of the sheet member 122 is in the state that it slides on the installation surface 147*a* of the elemental substrate 147 as in the example shown above, and supplies the signal thus produced to the driving circuit unit 162. In this way, the contact surface (joint surface) 122*a* of the sheet member 122 is stacked in a given position of the installation surface 147*a* of the elemental substrate 147.

Therefore, it is possible to perform an appropriate positioning even when the contact surface 122*a* of the sheet member 122 held on the holding reference surface 139GS and the installation surface 147*a* of the elemental substrate 147 are not kept in the state that these surfaces are in parallel with each other. Moreover, the time required for a series of assembling operation can be shortened as compared with the example shown in FIGS. 41A to 41E.

In this respect, for the third variational example and the fourth variational example, it may be possible to arrange the structure so that the first and second variational examples are made applicable to them, respectively.

In accordance with the present embodiment, it is possible to obtain the following effects:

(A) Since the contact portion for the sheet member and the carrier jig is small, the probability that the sheet member is damaged or deformed by means of the carrier jig is small. (The sheet member is extremely thin, and it is liable to be damaged or deformed.)

(B) The sheet member is held by the carrier jig by use of magnetic force. In this holding condition, if any external force is given to the sheet member, the holding condition changes. By the utilization of this function, that is, by allowing the contact surface of the sheet member to follow the base, it is possible to keep them in parallel with each other themselves.

(C) Since the holding condition of the sheet member can change, it is possible to prevent the sheet member from being deformed or damaged by the provision of appropriate means for giving an external force. Also, it is possible to perform abutting by means of an abutting reference without damaging the sheet member. Therefore, an abutting method is adoptable for positioning.

(D) It is possible to simplify the system with the effective arrangements as referred to in the paragraphs (B) and (C). Costs can be reduced for the provision of each apparatus, while making the size of the system smaller.

(E) It is possible to attempt the tact up because the inspection step and others by means of image processing or the adaption of a parallel detector (laser displacement gauge) can be eliminated.

(Discharging Liquid and Foaming Liquid)

In accordance with the present invention described above, it is possible to discharge liquid with higher discharging power and discharging efficiency than the conventional liquid jet head with the adoption of the structure provided with the movable member described earlier. It is also capable of discharging liquid higher speeds. When the same liquid is used as foaming liquid supplied to each air bubble generating area and as discharging liquid supplied to the liquid flow path, it is possible to use various kinds of liquids if only the applying liquid is such that its quality is not deteriorated by means of heating, it does not generate deposition easily on the heating elements when being heated, and also, it is capable of presenting reversible change of states by means of vaporization and condensation when being heated, and further, it does not cause each liquid flow path, movable member, and wall member to be deteriorated.

Of such liquids, it is possible to use ink having the composition used for the conventional bubble jet apparatus as liquid to be used for recording (recording liquid), for example.

On the other hand, when different liquids are used as discharging liquid and foaming liquid, respectively, by use of a head having the two-flow path structure of the present invention, it should be good enough to use liquid having the properties described above as foaming liquid. More specifically, the following can be named: methanol, ethanol, n-propanol, isopropanol, n-hexan, n-heptane, n-octane, toluene, xylene, ethylene dichloride, trichrolo ethylene, Freon TF, Freon BF, ethyl ether, dioxane, cyclohexane, methyl acetate, ethyl acetate, acetone, methyl ether ketone, water, and its mixtures, among others.

As discharging liquid, various kinds of liquid can be used without the presence and absence of foaming liquid and thermal properties. Also, even the liquid whose foaming capability is low to make discharging difficult by use of the conventional head, the liquid whose properties are easily changeable or deteriorated when receiving heat or the liquid whose viscosity is high can be used as discharging liquid.

However, as the properties of discharging liquid, it is desirable that such liquid is the one that does not hinder discharging, foaming, and the operation of the movable member or the like by the discharging liquid itself or by reaction caused by its contact with foaming liquid.

As discharging liquid for recording, it is possible to use highly viscous ink or the like. As other discharging liquids, it may be possible to name such liquid as the medicine and perfume whose properties are not strong against heat.

For the present invention, recording is performed using ink having the following composition as a recording liquid capable of being used as both discharging liquid and foaming liquid; with the enhanced discharging power, the discharging speed of ink becomes high, making it possible to obtain recorded image of extremely high quality resulting from the enhanced impact accuracy of droplets:

Colorant ink having a viscosity of 2 cp:

| | |
|---|---|
| (C.I food black 2) Colorant | 3 wt % |
| diethylene glycol | 10 wt % |
| thiodiglycol | 5 wt % |
| ethanol | 3 wt % |
| water | 77 wt % |

Also, recording is performed by combining liquid having the following composition with foaming liquid and discharging liquid; as a result, it becomes possible to discharge liquid having a high viscosity of 150 cp, not to mention the one having that of ten and several cp, in good condition, which the conventional head cannot effectuate easily, and obtain recorded images of high quality:

Foaming Liquid 1

| | |
|---|---|
| ethanol | 40 wt % |
| water | 60 wt % |

Foaming Liquid 2

| | |
|---|---|
| water | 100 wt % |

Foaming Liquid 3

| | |
|---|---|
| isopropyl alcohol | 10 wt % |
| water | 90 wt % |

Discharge Liquid 1; Colorant Ink (Viscosity Approximately 15 cp)

| | |
|---|---|
| carbon black | 5 wt % |
| styrene-acrylic acid-acrylic acid ethylepolymer (oxide 140, weight mean molecular quantity 8,000) | 1 wt % |
| monoethanol amine | 0.25 wt % |
| glycerine | 69 wt % |
| thiodiglycol | 5 wt % |
| ethanol | 3 wt % |
| water | 16.75 wt % |

Discharge Liquid 2 (Viscosity 55 cp)

| | |
|---|---|
| polyethylene glycol 200 | 100 wt % |

Discharging Liquid 3 (Viscosity 150 cp)

| | |
|---|---|
| polyethylene glycol 600 | 100 wt % |

Now, when using the liquid which cannot be discharged easily by means of the conventional discharging described above, the variation of discharging orientation is promoted because of slower discharging speeds. As a result, the impact accuracy of dots on a recording sheet becomes unfavorable, making it difficult to obtain images of high quality. However, with the embodiments structured as described above, the air bubbles can be created sufficiently and stably by use of foaming liquid. Consequently, it is possible to enhance the impact accuracy of droplets and stabilize the discharging amount of ink, hence leading to the significant enhancement of the quality of recorded images.

As described above, in accordance with the liquid discharging method and head of the present invention based on the new discharging principle using the movable members, it is possible to obtain a mutually potentionating effect by means of the created air bubbles and the movable members capable of being displaced thereby. Hence, liquid residing in the vicinity of discharge ports can be discharged efficiently, making it possible to obtain various effects, such as the significant enhancement of discharging efficiency, in particular, as compared with the conventional bubble jet discharging method and heads.

In accordance with the method of manufacture of the present invention, it is possible to effectuate adhesive bonding of the ceiling plate and heater board, while adjusting the position of the ceiling plate with respect to the heater board by allowing the reference surface of the ceiling plate to abut upon the cutting face of the heater board even for an ink jet head having thin film valves in it in such a manner that the thin film valves adhering to the ceiling plate are displaced to the corresponding groove side slightly.

In this respect, it is of course possible to apply the present invention to the heads of side shooter type where discharge ports are positioned to face the surface of the heat generating elements.

What is claimed is:

1. A method for manufacturing a liquid jet head having a plurality of liquid paths and a plurality of movable members formed in a thin film material corresponding thereto for use in discharging a liquid comprising the steps of:

providing said thin film material on a support member which supports the movable members;

providing said movable members and a component having a plurality of recessed portions corresponding to said movable members; and displacing said movable members with respect to said recessed portions of said component as said liquid jet head is assembled, so that during such assembly the movable members provided in the thin film material are retracted toward the support member.

2. A method for manufacturing a liquid jet head according to claim 1, wherein said step of displacing said movable members with respect to said recessed portions is effected by applying vacuum suction from the recessed portions of said component.

3. A method for manufacturing a liquid jet head according to claim 1, wherein said movable members are formed from a film of magnetic metal.

4. A method for manufacturing a liquid jet head using the component manufactured according to any one of claims 1 to 3, further comprising the step of placing a substrate having a plurality of heat generating elements relative to said component so that said heat generating elements are positioned at locations corresponding to said movable members.

* * * * *